US008962225B2

(12) United States Patent
Sasaki et al.

(10) Patent No.: US 8,962,225 B2
(45) Date of Patent: Feb. 24, 2015

(54) CHARGE TRANSPORTING FILM, PHOTOELECTRIC CONVERSION DEVICE, ELECTROPHOTOGRAPHIC PHOTORECEPTOR, PROCESS CARTRIDGE, AND IMAGE FORMING APPARATUS

(71) Applicant: Fuji Xerox Co., Ltd., Tokyo (JP)

(72) Inventors: Tomoya Sasaki, Kanagawa (JP); Katsumi Nukada, Kanagawa (JP); Wataru Yamada, Kanagawa (JP); Hidekazu Hirose, Kanagawa (JP); Kenji Kajiwara, Kanagawa (JP); Yuko Iwadate, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/861,164

(22) Filed: Apr. 11, 2013

(65) Prior Publication Data

US 2014/0072341 A1 Mar. 13, 2014

(30) Foreign Application Priority Data

Sep. 12, 2012 (JP) ..... 2012-200793

(51) Int. Cl.
*G03G 5/047* (2006.01)
*G03G 5/147* (2006.01)
(Continued)

(52) U.S. Cl.
CPC ..... *G03G 5/14717* (2013.01); *G03G 5/047* (2013.01); *G03G 15/751* (2013.01);
(Continued)

(58) Field of Classification Search
CPC . G03G 5/0532; G03G 5/14717; G03G 5/071; G03G 5/14786
USPC ..... 430/58.7, 58.05, 66; 399/159, 111; 526/310, 312
See application file for complete search history.

(56) References Cited

U.S. PATENT DOCUMENTS 5,411,827 A 5/1995 Tamura et al.
5,427,880 A 6/1995 Tamura et al.
(Continued)

FOREIGN PATENT DOCUMENTS

JP A-62-251757 11/1987
JP A-05-040360 2/1993
(Continued)

*Primary Examiner* — Christopher Rodee
(74) *Attorney, Agent, or Firm* — Oliff PLC

(57) ABSTRACT

A charge transporting film includes a cured film of a composition containing at least one selected from reactive compounds represented by the following Formula (I):

(I)

$$F-(D)_m$$

(IIa)

$$*-L-(E)_m$$

(IIb)

wherein F represents a charge transporting skeleton, D represents a group represented by Formula (IIa), m represents an integer of from 1 to 8, E represents a group represented by Formula (IIb), L represents a (n+1)-valent linking group including two or more selected from the group consisting of an alkylene group, an alkenylene group, —C(=O)—, —N(R)—, —S—, —O—, and a trivalent or tetravalent group derived from alkane or alkene, R represents a hydrogen atom, an alkyl group, an aryl group, or an aralkyl group, n represents an integer of from 1 to 3, $R^0$ represents a halogen atom, an alkyl group, or an alkoxy group, and n0 represents an integer of from 0 to 3.

8 Claims, 11 Drawing Sheets

(51) Int. Cl.
*G03G 15/00* (2006.01)
*G03G 5/05* (2006.01)
*G03G 5/07* (2006.01)

(52) U.S. Cl.
CPC ..... *G03G5/0532* (2013.01); *G03G 5/0592* (2013.01); *G03G 5/0596* (2013.01); *G03G 5/071* (2013.01); *G03G 5/14786* (2013.01); *G03G 5/14791* (2013.01); *G03G 5/14795* (2013.01); *G03G 2215/00957* (2013.01)
USPC ..... 430/58.7; 430/66; 526/310; 526/312

(56) References Cited

U.S. PATENT DOCUMENTS

| | | | | |
|---|---|---|---|---|
| 5,456,989 | A | 10/1995 | Nogami et al. | |
| 5,496,671 | A | 3/1996 | Tamura et al. | |
| 7,872,411 | B2 * | 1/2011 | Yamaguchi et al. | 313/504 |
| 2002/0119382 | A1 | 8/2002 | Nakata et al. | |
| 2004/0043312 | A1 | 3/2004 | Kikuchi et al. | |
| 2006/0049750 | A1 * | 3/2006 | Shirota et al. | 313/504 |
| 2007/0155928 | A1 * | 7/2007 | Koyama et al. | 526/310 |
| 2007/0178400 | A1 | 8/2007 | Kikuchi et al. | |
| 2012/0018710 | A1 * | 1/2012 | Eida et al. | 257/40 |
| 2012/0123073 | A1 * | 5/2012 | Tanaka et al. | 526/241 |
| 2013/0052571 | A1 * | 2/2013 | Yamada et al. | 430/56 |
| 2013/0052572 | A1 * | 2/2013 | Nukada et al. | 430/56 |
| 2013/0052573 | A1 * | 2/2013 | Sasaki et al. | 430/56 |

FOREIGN PATENT DOCUMENTS

| | | |
|---|---|---|
| JP | A-05-216249 | 8/1993 |
| JP | A-05-323630 | 12/1993 |
| JP | A-07-072640 | 3/1995 |
| JP | A-07-146564 | 6/1995 |
| JP | B2-2546739 | 10/1996 |
| JP | A-11-052603 | 2/1999 |
| JP | B2-2852464 | 2/1999 |
| JP | A-11-249444 | 9/1999 |
| JP | A-2000-019749 | 1/2000 |
| JP | A-2000-206715 | 7/2000 |
| JP | A-2000-264961 | 9/2000 |
| JP | A-2001-166510 | 6/2001 |
| JP | A-2001-175016 | 6/2001 |
| JP | A-2002-082469 | 3/2002 |
| JP | B2-3287678 | 6/2002 |
| JP | A-2004-012986 | 1/2004 |
| JP | A-2005-002291 | 1/2005 |
| JP | A-2006-084711 | 3/2006 |
| JP | A-2007-011005 | 1/2007 |
| JP | B2-4115055 | 7/2008 |
| JP | B2-4115056 | 7/2008 |
| JP | B2-4136238 | 8/2008 |
| JP | A-2008-262232 | 10/2008 |
| JP | B2-4217360 | 1/2009 |
| JP | A-2011-070023 | 4/2011 |

* cited by examiner

CHARGE TRANSPORTING FILM, PHOTOELECTRIC CONVERSION DEVICE, ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2012-200793 filed Sep. 12, 2012.

BACKGROUND

1. Technical Field

The present invention relates to a charge transporting film, a photoelectric conversion device, an electrophotographic photoreceptor, a process cartridge, and an image forming apparatus.

2. Related Art

Cured films having a charge transporting property are used in various fields, for example, electrophotographic photoreceptors, organic electroluminescent devices, memory devices, and photoelectric conversion devices such as wavelength conversion elements.

For example, in electrophotographic image forming apparatuses, a surface of an electrophotographic photoreceptor is charged to a predetermined polarity and a predetermined potential by a charging device, and the surface of the electrophotographic photoreceptor, after charging, is selectively erased by an image exposure to form an electrostatic latent image. Next, a toner is adhered to the electrostatic latent image by a developing device to develop the latent image as a toner image, and the toner image is transferred onto a recording medium by a transfer unit to be discharged as a product with an image formed thereon.

Photoreceptors having a protective layer provided on a surface are proposed as the electrophotographic photoreceptor from the viewpoint of improving the strength.

In recent years, protective layers formed from acrylic materials have attracted attention.

These acrylic materials are strongly affected by a curing condition, a curing atmosphere, and the like.

SUMMARY

According to an aspect of the invention, there is provided a charge transporting film including a cured film of a composition containing at least one selected from reactive compounds represented by the following Formula (I):

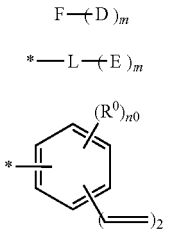

(I)

(IIa)

(IIb)

wherein F represents a charge transporting skeleton, D represents a group represented by Formula (IIa), m represents an integer of from 1 to 8, E represents a group represented by Formula (IIb), L represents a (n+1)-valent linking group including two or more selected from the group consisting of an alkylene group, an alkenylene group, —C(=O)—, —N(R)—, —S—, —O—, and a trivalent or tetravalent group derived from alkane or alkene, R represents a hydrogen atom, an alkyl group, an aryl group, or an aralkyl group, n represents an integer of from 1 to 3, $R^0$ represents a halogen atom, an alkyl group, or an alkoxy group, n0 represents an integer of from 0 to 3, and when n0 represents an integer of 2 or 3, $R^0$ may represent the same group or a different group.

BRIEF DESCRIPTION OF THE DRAWINGS

Exemplary embodiments of the present invention will be described in detail based on the following figures, wherein.

DETAILED DESCRIPTION

Figure 1:
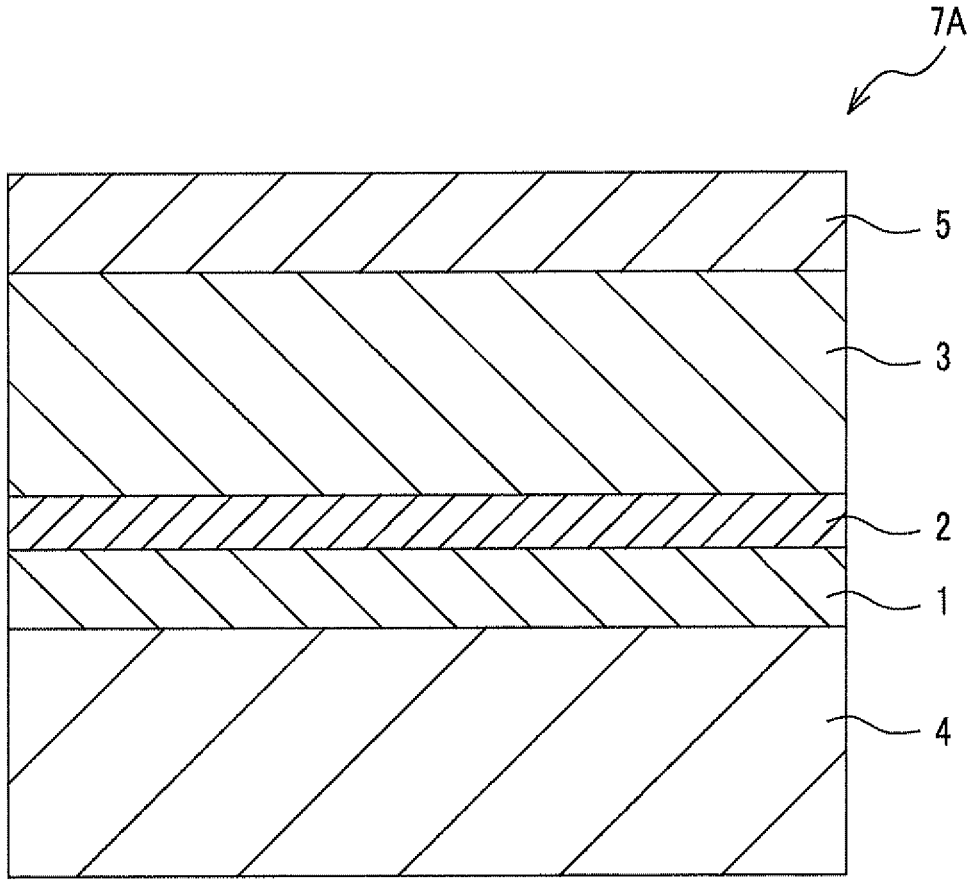
FIG. 1 is a schematic partial cross-sectional view showing an example of a layer configuration of an electrophotographic photoreceptor according to an exemplary embodiment.

Hereinafter, an exemplary embodiment of the invention will be described.

Electrophotographic Photoreceptor

An electrophotographic photoreceptor according to this exemplary embodiment has a conductive substrate and a photosensitive layer provided on the conductive substrate, and its outermost layer is configured by a cured film (charge transporting film) of a composition containing at least one selected from reactive compounds represented by Formula (I) (hereinafter, referred to as "specific reactive group-containing charge transporting materials").

Here, when the outermost layer of the electrophotographic photoreceptor is configured by a cured film using a reactive group-containing charge transporting material, the mechanical strength of the surface is improved, but initial electric characteristics and stability of the electric characteristics become insufficient. The reason for this is not clear. However, it is thought that the reason is that in the reactive group (chain polymerizable group)-containing charge transporting material, an intermolecular distance and a conformation of a chemical structure (charge transporting skeleton) having a charge transporting property vary from the state before curing due to the curing, or chemical structures around the reactive groups and chemical structures having a charge transporting property aggregate, respectively, due to curing and the film state before the curing varies. Particularly, it is thought that as the number of the reactive groups in the molecule is increased in order to improve the mechanical strength of the surface of the electrophotographic photoreceptor, the number of connecting points which connect the charge transporting skeletons (chemical structures having a charge transporting property) and the reactive groups increases, and thus a degree of freedom of the charge transporting skeleton due to the curing is reduced and the initial electric characteristic and the stability of the electric characteristics deteriorate.

It is also thought the reason is that when curing a composition containing a resin in addition to the reactive group-containing charge transporting material, compatibility between the structure of the charge transporting material and the resin is reduced due to the curing.

As above, the initial electric characteristics of the electrophotographic photoreceptor, the stability of the electric characteristics, and the mechanical strength of the surface are not sufficient, and improvements thereof are desired.

Accordingly, in the electrophotographic photoreceptor according to this exemplary embodiment, the outermost layer thereof is configured by a cured film (charge transporting film) of a composition containing at least one selected from specific reactive group-containing charge transporting materials, and thus the electrophotographic photoreceptor becomes excellent in the initial electric characteristics, the stability of the electric characteristics, and the mechanical strength of the surface.

The reason for this is not clear. However, it is thought this is due to the following reasons.

First, the specific reactive group-containing charge transporting material is a reactive compound in which one or more charge transporting skeletons and one or more divinyl benzene skeletons in the same molecule are connected to each other.

That is, it is thought that the specific reactive group-containing charge transporting material has a divinyl benzene skeleton as a reactive group (chain polymerizable group) and has good compatibility with the charge transporting skeleton (aryl group) as a main skeleton, and aggregation of the chemical structures (charge transporting skeletons) having a charge transporting property and the structures around the reactive groups due to the curing is suppressed, and thus the initial electric characteristics of the electrophotographic photoreceptor become excellent.

In addition, it is thought that when the aggregation of the chemical structures having a charge transporting property and the structures around the reactive groups due to the curing is suppressed, an intermolecular distance and a conformation of the chemical structure having a charge transporting property do not greatly vary even when the surface of the electrophotographic photoreceptor receives a mechanical load due to repeated use, whereby the electric characteristics are easily maintained and the stability increases.

Particularly, it is thought that since the specific reactive group-containing charge transporting material has a divinyl benzene skeleton as a reactive group (chain polymerizable group), the number of the reactive groups in the molecule is increased without an increase in the number of the connecting points which connect the charge transporting skeletons (chemical structures having a charge transporting property) and the reactive groups, and thus both of the mechanical strength and the electric characteristics are easily improved compared with the case in which the specific reactive group-containing charge transporting material has a styrene skeleton (monovinyl benzene skeleton).

In addition, it is thought that when the number of styrene skeletons (monovinyl benzene skeletons) as reactive groups (chain polymerizable groups) is increased in the same molecule, an influence of an increase in the molecular weight due to the benzene ring increases, and thus a ratio of the charge transporting skeletons per weight is reduced or a ratio of the vinyl groups ($CH_2$═CH—) per weight is difficult to be effectively increased, but in the divinyl benzene skeleton, since only the number of the vinyl groups in the same molecule is increased and an increase in the molecular weight due to the benzene ring is thus small, both of the mechanical strength and the electric characteristics are easily improved.

In addition, it is thought that as compared with the case in which a thought of increasing the number of the reactive groups in the molecule is realized using a (meth)acrylic group as a reactive group, without increasing the number of the connecting points which connect the charge transporting skeletons and the reactive groups, both of the mechanical strength and the electric characteristics are easily improved in the case of the divinyl benzene skeleton. It is thought that the reason for this is that since the (meth)acrylic group takes such a conformation that polymerization of (meth)acrylic groups in the same molecule is possible, it is difficult to efficiently proceed the cross-linking between the molecules. It is also thought that the reason is that in the divinyl benzene skeleton, since the vinyl groups in the same molecule are directly bonded to the rigid benzene ring, the polymerization in the same molecule almost does not occur.

As described above, it is thought that the electrophotographic photoreceptor according to this exemplary embodiment is excellent in the initial electric characteristics, the stability of the electric characteristics, and the mechanical strength of the surface. In addition, an increase in the lifetime of the electrophotographic photoreceptor according to this exemplary embodiment is easily realized.

In an image forming apparatus (process cartridge) having the electrophotographic photoreceptor according to this exemplary embodiment, images in which image defects (for example, afterimage phenomenon (ghosting) in which the remnant of the previous cycle remains, image deterioration) resulting from the electric characteristics of the electrophotographic photoreceptor and the mechanical strength of the surface are suppressed are obtained.

Hereinafter, a configuration of the photoreceptor according to the exemplary embodiment will be described in detail with reference to Figs.

Figure 2:
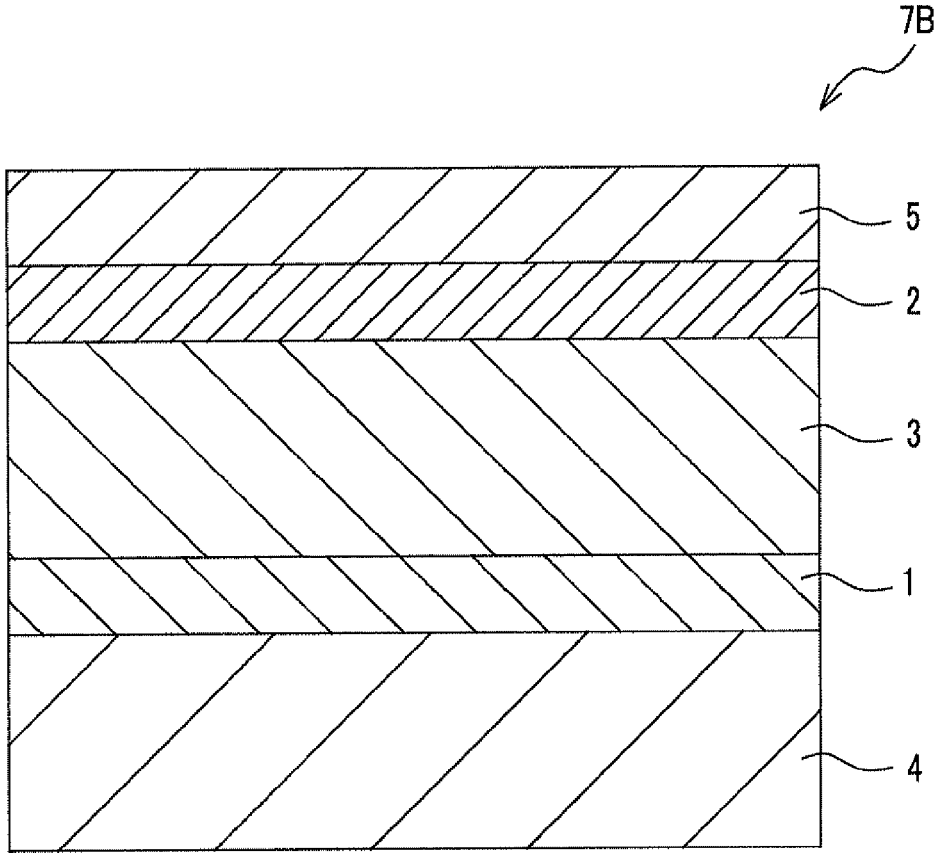
FIG. 2 is a schematic partial cross-sectional view showing another example of the layer configuration of the electrophotographic photoreceptor according to the exemplary embodiment.
Figure 3:
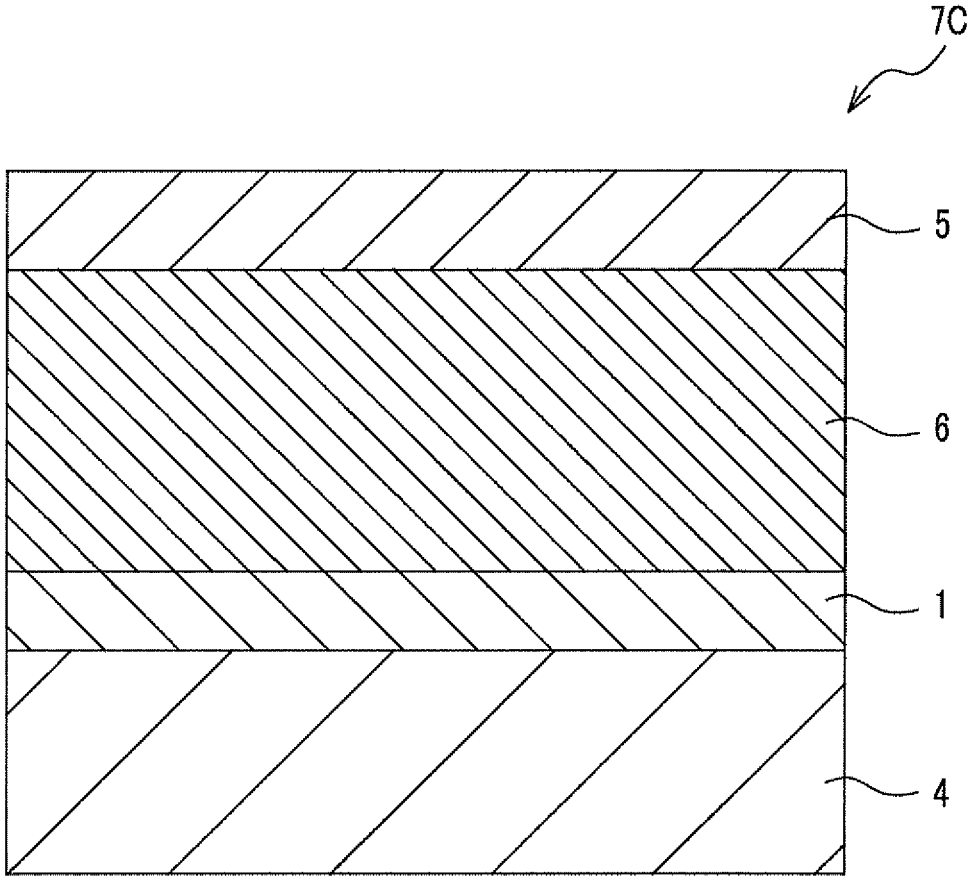
FIG. 3 is a schematic partial cross-sectional view showing a further example of the layer configuration of the electrophotographic photoreceptor according to the exemplary embodiment.

FIG. 1 is a cross-sectional view schematically illustrating a preferred example of the electrophotographic photoreceptor according to the exemplary embodiment. FIGS. 2 and 3 are cross-sectional views schematically illustrating other examples of the electrophotographic photoreceptor according to the exemplary embodiment.

An electrophotographic photoreceptor 7A illustrated in FIG. 1 is a so-called functional separation type photoreceptor (or layered photoreceptor) in which an undercoat layer 1 is provided on a substrate 4; a photosensitive layer in which a charge generating layer 2 and a charge transporting layer 3 are formed in this order is provided thereon; and a protective layer 5 is provided thereon. In the electrophotographic photoreceptor 7A, the photosensitive layer composed of the charge generating layer 2 and the charge transporting layer 3 correspond to the photosensitive layer.

Similarly to the electrophotographic photoreceptor 7A illustrated in FIG. 1, an electrophotographic photoreceptor 75 illustrated in FIG. 2 is a functional separation type photoreceptor in which the charge generating layer 2 and the charge transporting layer 3 are functionally separated. In this configuration, the undercoat layer 1 is provided on the substrate 4; a photosensitive layer in which the charge transporting layer 3 and the charge generating layer 2 are formed in this order is provided thereon; and the protective layer 5 is provided thereon. In the electrophotographic photoreceptor 7B, the photosensitive layer composed of the charge transporting layer 3 and the charge generating layer 2 correspond to the photosensitive layer.

An electrophotographic photoreceptor 7C illustrated in FIG. 3 includes a charge generating material and a charge transporting material in the same layer (single-layered photosensitive layer 6). The electrophotographic photoreceptor 7C illustrated in FIG. 3 has a structure in which the undercoat layer 1 is provided on the substrate 4; and the single-layered photosensitive layer 6 and the protective layer 5 are formed in this order thereon.

In the electrophotographic photoreceptors 7A, 7B, and 7C shown in FIGS. 1, 2, and 3, the protective layer 5 is an outermost layer arranged farthest from the conductive substrate 4, and the outermost layer has the above-described structure.

In the electrophotographic photoreceptors shown in FIGS. 1, 2, and 3, the undercoat layer 1 may or may not be provided.

Hereinafter, the respective elements will be described on the basis of the electrophotographic photoreceptors 7A shown in the FIG. 1 as representative examples. The reference numbers will be omitted.

Conductive Substrate

The conductive substrate may be freely selected from existing ones, such as plastic films having thereon a thin film for example, a metal such as aluminum, nickel, chromium, stainless steel, or a film of aluminum, titanium, nickel, chromium, stainless steel, gold, vanadium, tin oxide, indium oxide, or indium tin oxide (ITO)), paper coated or impregnated with a conductivity-imparting agent, and plastic films coated or impregnated with a conductivity-imparting agent. The substrate may be in the form of a cylinder, a sheet, or a plate. The conductive substrate particles preferably have a volume resistivity of, for example, less than $10^7$ Ω·cm.

When the conductive substrate is a metal pipe, the surface thereof may be untreated or treated by mirror finishing, etching, anodic oxidation, rough cutting, centerless grinding, sandblast, or wet honing.

Undercoat Layer

The undercoat layer is formed if necessary for the purpose of preventing light reflection on the conductive substrate surface, and inflow of unnecessary carriers from the conductive substrate into the photosensitive layer.

The undercoat layer is configured to contain, for example, a binder resin and other optional additives.

Examples of the binder resin contained in the undercoat layer include known polymer resin compounds such as acetal resins e.g. polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenol resins, phenol-formaldehyde resins, melamine resins, unsaturated urethane resins, polyester resins, alkyd resins, and epoxy resins, charge transporting resins having a charge transporting group, and conductive resins such as polyaniline.

Among them, as the binder resin, resins which are insoluble in the coating solvent for the upper layer (charge generating layer) are preferable, and resins which are obtained by the reaction of a curing agent and at least one selected from the group consisting of thermosetting resins such as urea resins, phenol resins, phenol-formaldehyde resins, melamine resins, urethane resins, unsaturated polyester resins, alkyd resins, and epoxy resins, polyamide resins, polyester resins, polyether resins, acrylic resins, polyvinyl alcohol resins, and polyvinyl acetal resins are particularly preferable.

When using the binder resins in combination of two or more kinds thereof, the mixing ratio is set as necessary.

The undercoat layer may contain a metal compound such as a silicon compound, an organozirconium compound, an organotitanium compound, or an organoaluminum compound.

The ratio of the metal compound to the binder resin is not specified, and is selected so as to achieve intended electrophotographic photoreceptor properties.

The undercoat layer may contain resin particles for controlling the surface roughness. Examples of the resin particles include silicone resin particles and crosslinked poly(methyl methacrylate) (PMMA) resin particles. For the purpose of controlling the surface roughness, the surface of the undercoat layer provided on a conductive substrate may be polished by, for example, buff polishing, sandblasting, wet honing, or grinding.

The undercoat layer may contain, for example, at least a binder resin and conductive particles. The conductive particles preferably have, for example, a volume resistivity of less than $10^7$ Ω·cm.

Examples of the conductive particles include metallic particles (for example, aluminum, copper, nickel, and silver particles), conductive metallic oxide particles (for examples, antimony oxide, indium oxide, tin oxide, and zinc oxide particles), and conductive substance particles (carbon fiber, carbon black, and graphite powder particles). Among them, conductive metal oxide particles are preferred. The conductive particles may be used in combination of two or more thereof. The conductive particles may be subjected to surface treatment with a hydrophobizing agent (for example, a coupling agent), thereby controlling the resistance. The content of the conductive particles is, for example, preferably from 10% by weight to 80% by weight with respect to the binder resin, and more preferably from 40% by weight to 80% by weight.

The formation of the undercoat layer is not particularly limited, and a well-known formation method is used. For example, the undercoat layer is formed by forming a coating film of an undercoat layer-forming coating solution obtained by adding the above-described components to a solvent; and drying (optionally, heating) the coating solution.

Examples of the method for coating the undercoat layer forming coating liquid to the conductive substrate include dip coating, push-up coating, wire-bar coating, spray coating, blade coating, knife coating, and curtain coating.

Examples of the method for dispersing particles in the undercoat layer forming coating liquid include media dispersers such as a ball mill, a vibrating ball mill, an attritor, a sand mill, and a horizontal sand mill; and medialess dispersers such as a stirrer, an ultrasonic disperser, a roll mill, and a high pressure homogenizer. The high pressure homogenizer may be of a collision type which achieves dispersion by liquid-liquid collision or liquid-wall collision under high pressure, or of a penetrating type which achieves dispersion by penetrating through fine channels under high pressure.

The thickness of the undercoat layer is preferably 15 μm or more, and more preferably from 20 μm to 50 μm.

Here, although omitted in the drawings, an intermediate layer may be further provided between the undercoat layer and the photosensitive layer. Examples of the binder resins for use in the intermediate layer include polymeric resin compounds e.g., acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins; and organic metallic compounds containing zirconium, titanium, aluminum, manganese, and silicon atoms. These compounds may be used singly or as a mixture or polycondensate of the plural compounds. Among them, an organic metallic compound containing zirconium or silicon is preferable because it has a low residual potential, and thus a change in potential due to the environment is small, and a change in potential due to the repeated use is small.

The formation of the intermediate layer is not particularly limited, and a well-known formation method is used. For example, the intermediate layer is formed by forming a coating film of an intermediate layer-forming coating solution obtained by adding the above-described components to a solvent; and drying (optionally, heating) the coating solution.

As a coating method for forming the intermediate layer, a general method is used such as a dipping coating method, an extrusion coating method, a wire bar coating method, a spray coating method, a blade coating method, a knife coating method, or a curtain coating method.

The intermediate layer improves the coating property of the upper layer and also functions as an electric blocking layer. However, when the thickness is excessively large, an electric barrier becomes excessively strong, which may cause desensitization or an increase in potential due to the repeated use. Accordingly, when an intermediate layer is formed, the thickness may be set to from 0.1 μm to 3 μm. In this case, the intermediate layer may be used as the undercoat layer.

Charge Generating Layer

The charge generating layer includes, for example, a charge generating material and a binder resin. Also the charge generating layer may include a vapor deposition film of a charge generating material.

Examples of the charge generating material include phthalocyanine pigments such as metal-free phthalocyanine, chlorogallium phthalocyanine, hydroxygallium phthalocyanine, dichlorotin phthalocyanine, and titanyl phthalocyanine. Particularly, there are exemplified a chlorogallium phthalocyanine crystal having strong diffraction peaks at least at Bragg angles (2θ±0.2°) of 7.4°, 16.6°, 25.5°, and 28.3° with respect to CuKα characteristic X-ray, a metal-free phthalocyanine crystal having strong diffraction peaks at least at Bragg angles (2θ±0.2°) of 7.7°, 9.3°, 16.9°, 17.5°, 22.4°, and 28.8° with respect to CuKα characteristic X-ray, a hydroxygallium phthalocyanine crystal having strong diffraction peaks at least at Bragg angles (2θ±0.2°) of 7.5°, 9.9°, 12.5°, 16.3°, 18.6°, 25.1°, and 28.3° with respect to CuKα characteristic X-ray, and a titanyl phthalocyanine crystal having strong diffraction peaks at least at Bragg angles (2θ±0.2°) of 9.6°, 24.1°, and 27.2° with respect to CuKα characteristic X-ray.

Other examples of the charge generating material include quinone pigments, perylene pigments, indigo pigments, bisbenzimidazole pigments, anthrone pigments, and quinacridone pigments. These charge generating materials may be used singly or in mixture of two or more types.

Examples of the binder resin constituting the charge generating layer include a polycarbonate resins such as a bisphenol-A type and a bisphenol-Z type, acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, and poly-N-vinylcarbazole resins. These binder resins may be used singly or in mixture of two or more types.

The blending ratio of the charge generating material to the binder resin is, for example, preferably from 10:1 to 1:10.

The charge generating layer may contain other known additives.

The formation of the charge generating layer is not particularly limited, and a well-known formation method is used. For example, the charge generating layer is formed by forming a coating film of a charge generating layer-forming coating solution obtained by adding the above-described components to a solvent; and drying (optionally, heating) the coating solution. Also the charge generating layer may be formed by deposition of the charge generating materials.

Examples of the method of coating the undercoat layer with the coating liquid for charge generating layer formation include a dipping coating method, an extrusion coating method, a wire bar coating method, a spray coating method, a blade coating method, a knife coating method, and a curtain coating method.

As a method of dispersing the particles (for example, charge generating material) in the coating liquid for charge generating layer formation, a media disperser such as a ball mill, a vibrating ball mill, an attritor, a sand mill, or a horizontal sand mill, or a media-less disperser such as a stirrer, an ultrasonic disperser, a roll mill, or a high-pressure homogenizer is used. Examples of the high-pressure homogenizer include a collision-type homogenizer in which a dispersion is dispersed under high pressure by liquid-liquid collision or liquid-wall collision, and a penetration-type homogenizer in which a dispersion is dispersed by allowing it to penetrate through a minute channel under high pressure.

The thickness of the charge generating layer is preferably set to from 0.01 μm to 5 μm, and more preferably from 0.05 μm to 2.0 μm.

Charge Transporting Layer

The charge transporting layer includes a charge transporting material, and if necessary, a binder resin.

Examples of the charge transporting material include hole transporting substances e.g., oxadiazole derivatives such as 2,5-bis(p-diethylaminophenyl)-1,3,4-oxadiazole, pyrazoline derivatives such as 1,3,5-triphenyl-pyrazoline and 1-[pyridyl-(2)]-3-(p-diethylaminostyryl)-5-(p-diethylamino styryl)pyrazoline, aromatic tertiary amino compounds such as triphenylamine, tris[4-(4,4-diphenyl-1,3-butadienyl)phenyl]amine, N,N'-bis(3,4-dimethylphenyl)biphenyl-4-amine, tri(p-methylphenyl)aminyl-4-amine, and dibenzylaniline, aromatic tertiary diamino compounds such as N,N'-bis(3-methylphenyl)-N,N'-diphenylbenzidine, 1,2,4-triazine derivatives such as 3-(4'-dimethylaminophenyl)-5,6-di-(4'-methoxyphenyl)-1,2,4-triazine, hydrazone derivatives such as 4-diethylaminobenzaldehyde-1,1-diphenylhydrazone, quinazoline derivatives such as 2-phenyl-4-styryl-quinazoline, benzofuran derivatives such as 6-hydroxy-2,3-di(p-methoxyphenyl)benzofuran, α-stilbene derivatives such as p-(2,2-diphenylvinyl)-N,N-diphenylaniline, enamine derivatives, carbazole derivatives such as N-ethylcarbazole, and poly-N-vinylcarbazole and derivatives thereof; electron transporting substances e.g., quinone compounds such as chloranil and bromoanthraquinone, tetracyanoquinodimethane compounds, fluorenone compounds such as 2,4,7-trinitrofluorenone and 2,4,5,7-tetranitro-9-fluorenone, xanthone compounds, and thiophene compounds; and polymers having a group composed of the above-described compounds as a main chain or side chain thereof. These charge transporting materials may be used singly or in combination of two or more types.

Examples of the binder resin in the charge transporting layer include insulating resins such as polycarbonate resins (polycarbonate resins such as bisphenol-A polycarbonate resins and bisphenol-Z polycarbonate resins), acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, and chloride rubber, and organic photoconductive polymers such as polyvinyl carbazole, polyvinyl anthracene, and polyvinyl pyrene. The binder resins may be used singly, or as a mixture of two or more kinds thereof.

Among them, polycarbonate is preferable, and polycarbonate copolymers in which a solubility parameter calculated by the Feders method is from 11.40 to 11.75 are particularly preferable.

The blending ratio of the charge transporting material to the binder resin is, for example, preferably 10:1 to 1:5 in terms of the weight ratio.

The charge transporting layer may contain other known additives.

The formation of the charge transporting layer is not particularly limited, and a well-known formation method is used. For example, the charge transporting layer is formed by forming a coating film of a charge transporting layer-forming coating solution obtained by adding the above-described components to a solvent; and drying (optionally, heating) the coating solution.

As a method of coating the charge transporting layer with the coating liquid for charge transporting layer formation, a general method is used such as a dipping coating method, an extrusion coating method, a wire bar coating method, a spray coating method, a blade coating method, a knife coating method, or a curtain coating method.

As a method of dispersing the particles (for example, fluorine resin particles) in the coating liquid for charge transporting layer formation, a media disperser such as a ball mill, a vibrating ball mill, an attritor, a sand mill, or a horizontal sand mill, or a media-less disperser such as a stirrer, an ultrasonic disperser, a roll mill, or a high-pressure homogenizer is used. Examples of the high-pressure homogenizer include a collision-type homogenizer in which a dispersion is dispersed under high pressure by liquid-liquid collision or liquid-wall collision, and a penetration-type homogenizer in which a dispersion is dispersed by allowing it to penetrate through a minute channel under high pressure.

The thickness of the charge transporting layer is preferably set to from 5 m to 50 μm, and more preferably from 10 μm to 40 μm.

Protective Layer

The protective layer is the outermost layer of the electrophotographic photoreceptor, and is configured by a cured film of a composition containing a specific reactive group-containing charge transporting material.

That is, the protective layer is configured to contain a polymer or a cross-linked product of a specific reactive group-containing charge transporting material.

Radical polymerization by heat, light, or radiation is performed as a method of curing the cured film. When adjustment is carried out to allow the reaction not to proceed too rapidly, the mechanical strength and the electric characteristics of the protective layer (outermost layer) are improved, and occurrence of unevenness and wrinkles in the film is also suppressed. Accordingly, the polymerization is preferably performed under conditions where radicals are generated relatively slowly. From such a viewpoint, thermal polymerization in which the polymerization rate is easily adjusted is preferable. That is, a composition for forming the cured film constituting the protective layer (outermost layer) may preferably contain a thermal radical generating agent or a derivative thereof.

Specific Reactive Group-Containing Charge Transporting Material

The specific reactive group-containing charge transporting material is at least one selected from the reactive compounds represented by Formula (I).

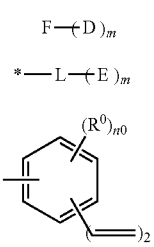

(I)

(IIa)

(IIb)

In Formula (I), F represents a charge transporting skeleton. D represents a group represented by Formula (IIa). m represents an integer of from 1 to 8.

In Formula (IIa), E represents a group represented by Formula (IIb). L represents a (n+1)-valent linking group including two or more selected from the group consisting of an alkylene group, an alkenylene group, —C(=O)—, —N(R)—, —S—, —O—, and a trivalent or tetravalent group derived from alkane or alkene. R represents a hydrogen atom, an alkyl group, an aryl group, or an aralkyl group. n represents an integer of from 1 to 3.

In Formula (IIb), $R^0$ represents a halogen atom, an alkyl group, or an alkoxy group. n0 represents an integer of from 0 to 3. When n0 represents an integer of 2 or 3, $R^0$ may represent the same group or a different group.

In Formula (IIa), "*" represents a single bond, and represents that a group represented by Formula (IIa) is bonded to F in Formula (I) at the position of "*".

In Formula (IIb), "*" represents a single bond, and represents that a group represented by Formula (IIb) is bonded to L in Formula (IIa) at the position of "*".

Here, in Formula (I), the total number of E (divinyl benzene skeletons) of Formula (IIa) is equal to m×n (m of Formula (I)×n of Formula (IIa)). When m or n is other than 1, the plural n may be different from each other. m in Formula (I) preferably represents an integer of from 1 to 6. n in Formula (IIa) preferably represents 1 or 2.

In addition, the total number of E (divinyl benzene skeletons) of Formula (V) is equal to a value of c1×n+c2×n+k×(c3×n+c4×n)+c5×n. The plural n may be different from each other.

The lower limit of the total number of E (divinyl benzene skeletons) is preferably 2 or more, more preferably 3 or more, and even more preferably 4 or more from the viewpoint of obtaining a cured film (cross-linked film) having a higher strength. In addition, the upper limit is preferably 6 or less from the viewpoint that when the number of reactive groups (chain polymerizable groups) in one molecule is excessively large, the polymerization (cross-linking) reaction of the specific reactive group-containing charge transporting material proceeds, and thus the molecules are difficult to move, the reactive groups (chain polymerizable groups) are easily reduced, and thus a ratio of the unreacted reactive groups (chain polymerizable groups) may easily increase.

That is, the total number of E in Formula (I) is preferably from 2 to 6, more preferably from 3 to 6, and even more preferably from 4 to 6.

In Formula (I), F represents a structure having a charge transporting skeleton, that is, a structure having a charge transporting property, and specific examples thereof include structures having a charge transporting property such as phthalocyanine compounds, porphyrin compounds, azobenzene compounds, triarylamine compounds, benzidine compounds, arylalkane compounds, aryl-substituted ethylene compounds, stilbene compounds, anthracene compounds, hydrazone compounds, quinone compounds, and fluorenone compounds.

Examples of the (n+1)-valent linking group represented by L in Formula (IIa) include a (n+1)-valent linking group including a group obtained by combining one selected from the group consisting of —C(=O)—, —N(R)—, —S—, —C(=O)—O—, —C(=O)—N(R)—, —C(=O)—S—, —O—C(=O)—O—, and —O—C(=O)—N(R)— with one or more selected from the group consisting of an alkylene group, an alkenylene group, and a trivalent or tetravalent group derived from alkane or alkene.

The (n+1)-valent linking group represented by L may be a (n+1)-valent linking group including a group obtained by combining one selected from the group consisting of —O— and —C(=O)—O— with one or more selected from the group consisting of an alkylene group, an alkenylene group, and a trivalent or tetravalent group derived from alkane or alkene, from the viewpoint of solubility in the coating liquid, curability, and the like.

The total number of carbon atoms included in the (n+1)-valent linking group represented by L may be, for example, from 1 to 15, and is preferably from 2 to 10 from the viewpoint of solubility in the coating liquid, density and reactivity (chain polymerization reaction) of the divinyl benzene skeleton in the specific reactive group-containing charge transporting material (in its molecule).

Here, the hydrocarbon group (group configured by one or more selected from the group consisting of an alkylene group, an alkenylene group, and a trivalent or tetravalent group derived from alkane or alkene) which is included in the (n+1)-valent linking group represented by L may be linear, branched, or annular. However, it may be linear or branched, and is preferably linear, from the viewpoint of solubility in the coating liquid, curability, and the like.

The trivalent or tetravalent group derived from alkane or alkene means a group in which three or four hydrogen atoms are removed from alkane or alkene, and has the same usage below.

In the case of n=1 in Formula (IIa), L represents a divalent linking group. Examples of the divalent linking group represented by L include a divalent linking group in which —C(=O)—O— is interposed between alkylene groups, a divalent linking group in which —C(=O)—N(R)— is interposed between alkylene groups, a divalent linking group in which —C(=O)—S— is interposed between alkylene groups, a divalent linking group in which —O— is interposed between alkylene groups, a divalent linking group in which —N(R)— is interposed between alkylene groups, and a divalent linking group in which —S— is interposed between alkylene groups.

In the linking group represented by L, two —C(=O)—O—, —C(=O)—N(R)—, —C(=O)—S—, —O—, or —S— groups may be interposed between alkylene groups.

Specific examples of the divalent linking group represented by L in Formula (IIa) include $*\text{-}(CH_2)_p\text{—}C(=O)\text{—}O\text{—}(CH_2)_q\text{—}$, $*\text{-}(CH_2)_p\text{—}O\text{—}C(=O)\text{—}(CH_2)_r\text{—}C(=O)\text{—}O\text{—}(CH_2)_q\text{—}$, $*\text{-}(CH_2)_p\text{—}C(=O)\text{—}N(R)\text{—}(CH_2)_q\text{—}$, $*\text{-}(CH_2)_p\text{—}C(=O)\text{—}S\text{—}(CH_2)_q\text{—}$, $*\text{-}(CH_2)_p\text{—}O\text{—}(CH_2)_q\text{—}$, $*\text{-}(CH_2)_p\text{—}N(R)\text{—}(CH_2)_q\text{—}$, $*\text{-}(CH_2)_p\text{—}S\text{—}(CH_2)_q\text{—}$, and $*\text{-}(CH_2)_p\text{—}O\text{—}(CH_2)_r\text{—}O\text{—}(CH_2)_q\text{—}$.

Here, in the divalent linking group represented by L, p represents an integer of 0, or from 1 to 10 (preferably from 1 to 6, more preferably from 1 to 5, and even more preferably from 1 to 4). q represents an integer of from 1 to 10 (preferably from 1 to 6, more preferably from 1 to 5, and even more preferably from 1 to 4). r represents an integer of from 1 to 10 (preferably from 1 to 6, more preferably from 1 to 5, and even more preferably from 1 to 4).

"*" in the divalent linking group represented by L represents a part linked to F.

In the case of n=2 or 3 in Formula (IIa), L represents a trivalent or tetravalent linking group. Examples of the trivalent or tetravalent linking group represented by L include a trivalent or tetravalent linking group in which —C(=O)—O— is interposed between alkylene groups linked to each other in a branched shape, a trivalent or tetravalent linking group in which —C(=O)—N(R)— is interposed between alkylene groups linked to each other in a branched shape, a trivalent or tetravalent linking group in which —C(=O)—S— is interposed between alkylene groups linked to each other in a branched shape, a trivalent or tetravalent linking group in which —O— is interposed between alkylene groups linked to each other in a branched shape, a trivalent or tetravalent linking group in which —N(R)— is interposed between alkylene groups linked to each other in a branched shape, and a trivalent or tetravalent linking group in which —S— is interposed between alkylene groups linked to each other in a branched shape.

In the trivalent or tetravalent linking group represented by L, two —C(=O)—O—, —C(=O)—N(R)—, —C(=O)—S—, —O—, or —S— groups may be interposed between alkylene groups linked to each other in a branched shape.

Specific examples of the trivalent or tetravalent linking group represented by L in Formula (IIa) include $*\text{-}(CH_2)_p\text{—}CH[C(=O)\text{—}O\text{—}(CH_2)_q\text{—}]_2$, $*\text{-}(CH_2)_p\text{—}CH{=}C[C(=O)\text{—}O\text{—}(CH_2)_q\text{—}]_2$, $*\text{-}(CH_2)_p\text{—}CH[C(=O)\text{—}N(R)\text{—}(CH_2)_q\text{—}]_2$, $*\text{-}(CH_2)_p\text{—}CH[C(=O)\text{—}S\text{—}(CH_2)_q\text{—}]_2$, $*\text{-}(CH_2)_p\text{—}CH[(CH_2)_r\text{—}O\text{—}(CH_2)_q\text{—}]_2$, $*\text{-}(CH_2)_p\text{—}CH{=}C[(CH_2)_r\text{—}O\text{—}(CH_2)_q\text{—}]_2$, $*\text{-}(CH_2)_p\text{—}CH[(CH_2)_r\text{—}N(R)\text{—}(CH_2)_q\text{—}]_2$, $*\text{-}(CH_2)_p\text{—}CH[(CH_2)_r\text{—}S\text{—}(CH_2)_q\text{—}]_2$,

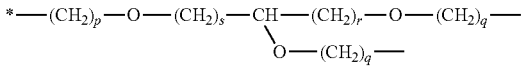

*-$(CH_2)_p$—O—C[$(CH_2)_r$—O—$(CH_2)_q$—]$_3$, and *-$(CH_2)_p$—C(═O)—O—C[$(CH_2)_r$—O—$(CH_2)_q$—]$_3$.

Here, in the trivalent or tetravalent linking group represented by L, p represents an integer of 0, or from 1 to 10 (preferably from 1 to 6, more preferably from 1 to 5, and even more preferably from 1 to 4). q represents an integer of from 1 to 10 (preferably from 1 to 6, more preferably from 1 to 5, and even more preferably from 1 to 4). r represents an integer of from 1 to 10 (preferably from 1 to 6, more preferably from 1 to 5, and even more preferably from 1 to 4). s represents an integer of from 1 to 10 (preferably from 1 to 6, more preferably from 1 to 5, and even more preferably from 1 to 4).

"*" in the trivalent or tetravalent linking group represented by L represents a part linked to F.

Examples of the alkyl group represented by R of "—N(R)—" in the (n+1)-valent linking group represented by L in Formula (IIa) include a linear or branched alkyl group having from 1 to 5 (preferably from 1 to 4) carbon atoms, and specific examples thereof include a methyl group, an ethyl group, a propyl group, and a butyl group.

Examples of the aryl group represented by R of "—N(R)—" include an aryl group having from 6 to 15 (preferably from 6 to 12) carbon atoms, and specific examples thereof include a phenyl group, a toluoyl group, a xylyl group, and a naphthyl group.

Examples of the aralkyl group include an aralkyl group having from 7 to 15 (preferably from 7 to 14) carbon atoms, and specific examples thereof include a benzyl group, a phenethyl group, and a biphenyl methylene group.

In Formula (IIa), the group, represented by Formula (IIb), represented by E is a group having a divinyl benzene skeleton having a structure in which two vinyl groups (—CH═$CH_2$) are directly bonded to a benzene ring. As the substitution positions of the two vinyl groups with respect to the benzene skeleton, there are three kinds of positions, e.g., ortho, meta, and para positions. Among the substitution positions, a meta or para position is preferable from the viewpoint of realizing efficient curing (curing by chain polymerization) of the reactive group-containing charge transporting material.

In addition, from the same viewpoint, a substituent (group represented by $R^0$) that substitutes the divinyl benzene skeleton may preferably be an alkyl group having from 1 to 3 carbon atoms and an alkoxy group having from 1 to 3 carbon atoms, and non-substitution is the most preferable. That is, it is most preferable that n0 represents 0 in Formula (IIb), and when n0 represents an integer of from 1 to 3, $R^0$ may preferably represent an alkyl group having from 1 to 3 carbon atoms or an alkoxy group having from 1 to 3 carbon atoms.

Next, preferable groups represented by Formula (IIa) will be described.

Preferable examples of the group represented by Formula (IIa) include a group represented by Formula (IIIa).

(IIIa)

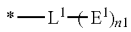

(IIIb)

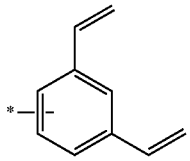

(IVb)

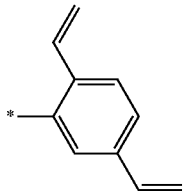

In Formula (IIIa), $L^1$ represents a (n1+1)-valent linking group including a group obtained by combining one selected from the group consisting of —O— and —C(═O)—O— with one or more selected from the group consisting of an alkylene group, an alkenylene group, and a trivalent or tetravalent group derived from alkane or alkene.

n1 represents an integer of from 1 to 3.

$E^1$ represents a group represented by Formula (IIIb) or (IVb).

"*" in Formula (IIIa) represents a single bond, and represents that a group represented by Formula (IIIa) is bonded to F in Formula (I) at the position of "*".

"*" in Formula (IIIb) and Formula (IVb) represents a single bond, and represents that a group represented by Formula (IVb) is bonded to $L^1$ in Formula (IIIa) at the position of "*".

Preferable examples of the (n1+1)-valent linking group represented by $L^1$ in Formula (IIIa) include a divalent, trivalent, or tetravalent linking group exemplified as the (n+1)-valent linking group represented by L in Formula (IIa).

n1 may represent an integer of 1 or 2.

The group represented by Formula (IIIa) may be a group selected from the groups represented by Formulae (IIIa-1) to (IIIa-6).

(IIIa-1)

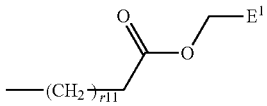

(IIIa-2)

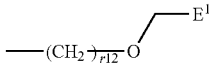

(IIIa-3)

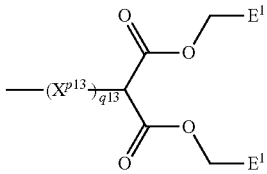

(IIIa-4)

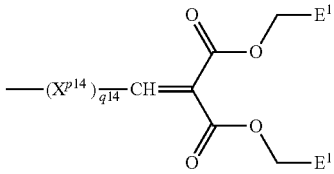

-continued (IIIa-5)

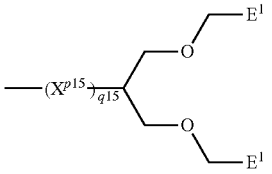

(IIIa-6)

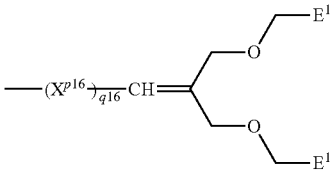

In Formulae (IIIa-1) to (IIIa-6), each of $X^{p13}$ to $X^{p16}$ independently represents a divalent linking group. $E^1$ represents a group represented by Formula (IIIb). Each of r11 and r12 independently represents an integer of from 0 to 4. Each of q13 to q16 independently represents an integer of 0 or 1.

Examples of the divalent linking group represented by $X^{p13}$ to $X^{p16}$ in Formulae (IIIa-1) to (IIIa-6) include divalent linking groups including two or more selected from the group consisting of an alkylene group, an alkenylene group, —C(═O)—, —N(R)—, —S—, and —O—. "—N(R)—" as the divalent linking group is synonymous with "—N(R)—" represented by L in Formula (IIa).

These divalent linking groups may be divalent linking groups including two or more selected from the group consisting of an alkylene group, —C(═O)—, and —O— from the viewpoint of solubility in the coating liquid, curability, and the like of the reactive group-containing charge transporting material. Specifically, the divalent linking group is preferably an alkylene group or an oxyalkylene group, and more preferably an alkylene group (—$(CH_2)_p$—: p represents an integer of from 1 to 6 (preferably from 1 to 5, and more preferably from 1 to 4)).

In Formulae (IIIa-1) to (IIIa-6), r11 and r12 preferably represent an integer of from 1 to 4, and more preferably from 2 to 4.

q13 to q16 preferably represent an integer of 1.

Next, preferable reactive compounds represented by Formula (I) will be described.

Reactive compounds represented by Formula (I) may be reactive compounds having a charge transporting skeleton (structure having a charge transporting property) as F derived from a triarylamine compound.

Specifically, reactive compounds represented by Formula (V) are preferable as the reactive compounds represented by Formula (I).

(V)

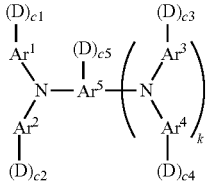

In Formula (V), each of $Ar^1$ to $Ar^4$ independently represents a substituted or unsubstituted aryl group. $Ar^5$ represents a substituted or unsubstituted aryl group, or a substituted or unsubstituted arylene group. D represents a group represented by Formula (IIa). Each of c1 to c5 independently represents an integer of from 0 to 2. k represents 0 or 1. The total number of D is from 1 to 8.

In Formula (V), the substituted or unsubstituted aryl groups represented by $Ar^1$ to $Ar^4$ may be the same as or different from each other.

Here, examples of the substituent in the substituted aryl group other than "D" include an alkyl group having from 1 to 4 carbon atoms, an alkoxy group having from 1 to 4 carbon atoms, a phenyl group substituted by an alkoxy group having from 1 to 4 carbon atoms, an unsubstituted phenyl group, an aralkyl group having from 7 to 10 carbon atoms, and a halogen atom.

In Formula (V), $Ar^1$ to $Ar^4$ are preferably any of the following Structural Formulae (1) to (7).

In the following Structural Formulae (1) to (7), "-$(D)_{c1}$" to "-$(D)_{c4}$" that may be connected to the $Ar^1$ to $Ar^4$, respectively, are collectively represented by "-$(D)_c$".

(1)

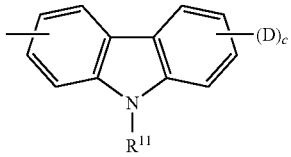

(2)

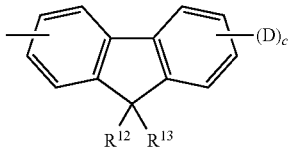

(3)

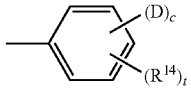

(4)

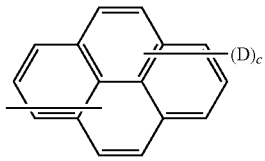

(5)

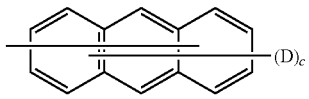

(6)

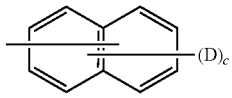

(7)

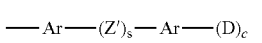

In Structural Formulae (1) to (7), $R^{11}$ represents one selected from the group consisting of a hydrogen atom, an alkyl group having from 1 to 4 carbon atoms, a phenyl group substituted by an alkyl group having from 1 to 4 carbon atoms or an alkoxy group having from 1 to 4 carbon atoms, an unsubstituted phenyl group, and an aralkyl group having from 7 to 10 carbon atoms. Each of $R^{12}$ and $R^{13}$ independently represents one selected from the group consisting of a hydrogen atom, an alkyl group having from 1 to 4 carbon atoms, an alkoxy group having from 1 to 4 carbon atoms, a phenyl group substituted by an alkoxy group having from 1 to 4 carbon atoms, an unsubstituted phenyl group, an aralkyl group having from 7 to 10 carbon atoms, and a halogen atom. $R^{14}$ independently represents one selected from the group consisting of an alkyl group having from 1 to 4 carbon atoms, an alkoxy group having from 1 to 4 carbon atoms, a phenyl group substituted by an alkoxy group having from 1 to 4 carbon atoms, an unsubstituted phenyl group, an aralkyl group having from 7 to 10 carbon atoms, and a halogen atom. Ar represents a substituted or unsubstituted arylene group. s represents 0 or 1. t represents an integer of from 0 to 3. Z' represents a divalent organic linking group.

Here, in Formula (7), Ar is preferably represented by the following Structural Formula (8) or (9).

(8)

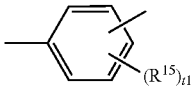

(9)

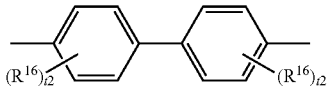

In Structural Formulae (8) and (9), each of $R^{15}$ and $R^{16}$ independently represents one selected from the group consisting of an alkyl group having from 1 to 4 carbon atoms, an alkoxy group having from 1 to 4 carbon atoms, a phenyl group substituted by an alkoxy group having from 1 to 4 carbon atoms, an unsubstituted phenyl group, an aralkyl group having from 7 to 10 carbon atoms, and a halogen atom. Each of t1 and t2 represents an integer of from 0 to 3.

In Formula (7), Z' is preferably represented by any of the following Structural Formulae (10) to (17).

(10)

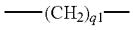

(11)

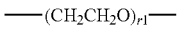

(12)

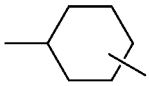

(13)

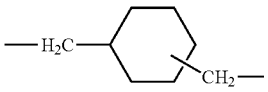

(14)

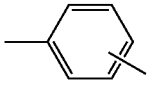

(15)

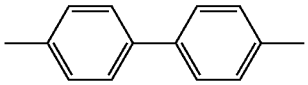

(16)

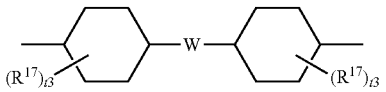

-continued (17)

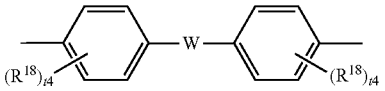

In Structural Formulae (10) to (17), each of $R^{17}$ and $R^{18}$ independently represents one selected from the group consisting of an alkyl group having from 1 to 4 carbon atoms, an alkoxy group having from 1 to 4 carbon atoms, a phenyl group substituted by an alkoxy group having from 1 to 4 carbon atoms, an unsubstituted phenyl group, an aralkyl group having from 7 to 10 carbon atoms, and a halogen atom. W represents a divalent group. Each of q1 and r1 independently represents an integer of from 1 to 10. Each of t3 and t4 represents an integer of from 0 to 3.

In Structural Formulae (16) and (17), W is preferably any of divalent groups represented by the following Structural Formulae (18) to (26). In Formula (25), u represents an integer of from 0 to 3.

(18)

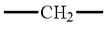

(19)

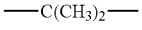

(20)

(21)

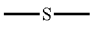

(22)

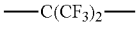

(23)

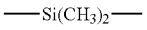

(24)

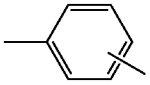

(25)

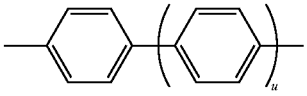

(26)

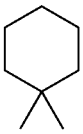

In Formula (V), $Ar^5$ represents a substituted or unsubstituted aryl group when k is 0, and this substituted or unsubstituted aryl group is the same as the substituted or unsubstituted aryl groups represented by $Ar^1$ to $Ar^4$.

$Ar^5$ represents a substituted or unsubstituted arylene group when k is 1, and examples of the substituted or unsubstituted arylene group include arylene groups in which one hydrogen atom at a target position is removed from the substituted or unsubstituted aryl groups represented by $Ar^1$ to $Ar^4$.

Examples of the substituent in the substituted arylene group are the same as those in the description of $Ar^1$ to $Ar^4$ other than "D" in the substituted aryl group.

Hereinafter, specific examples of the specific reactive group-containing charge transporting material (compound represented by Formula (I)) will be shown. The compound represented by Formula (I) is not limited thereto.

First, "(1)-1" to "(1)-25" will be shown as specific examples of the charge transporting skeleton F when the total number of D in Formula (I) is 1, but the charge transporting skeleton F is not limited thereto. In each structure, * represents connection to D in Formula (I).
(1)-1
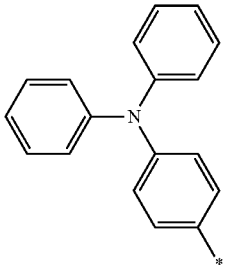
(1)-2
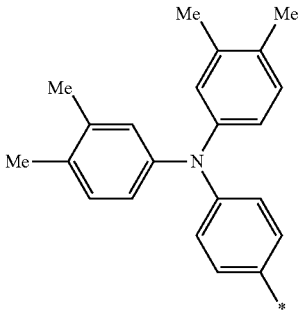
(1)-3
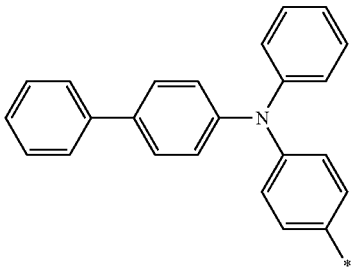
(1)-4
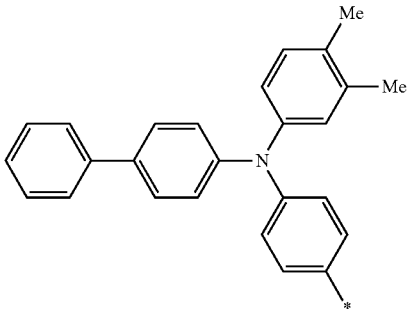
(1)-5
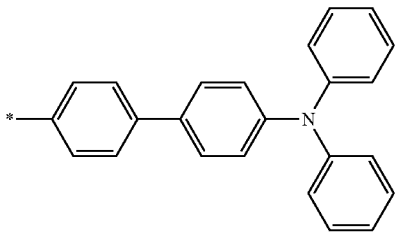
-continued
(1)-6
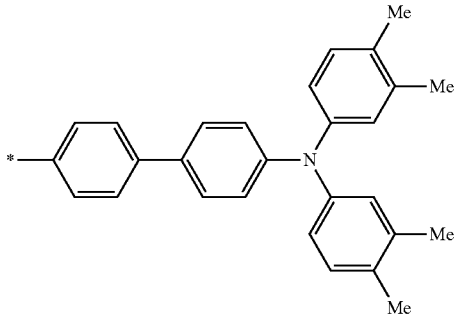
(1)-7
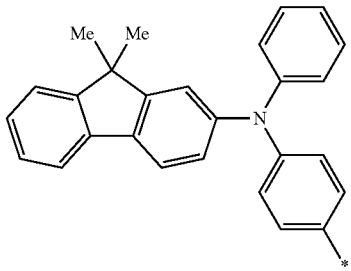
(1)-8
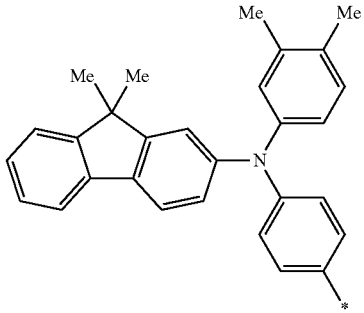
(1)-9
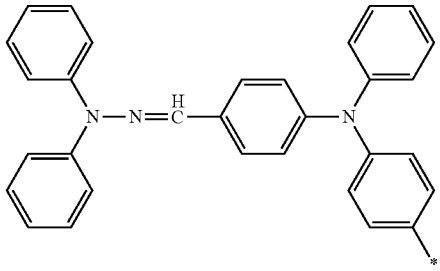
(1)-10
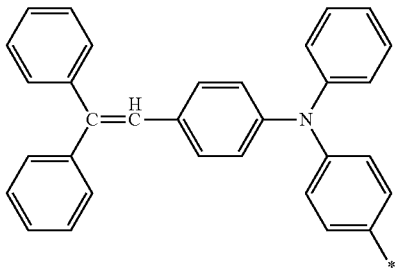

-continued
(1)-11
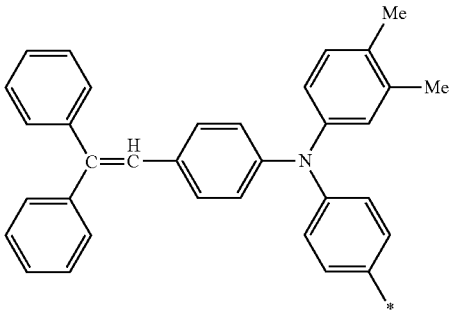
(1)-12
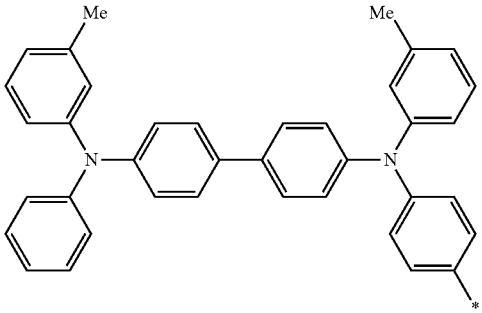
(1)-13
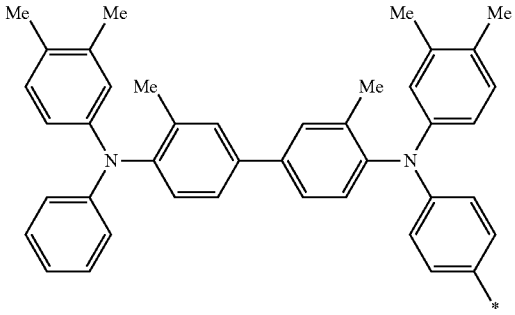
(1)-14
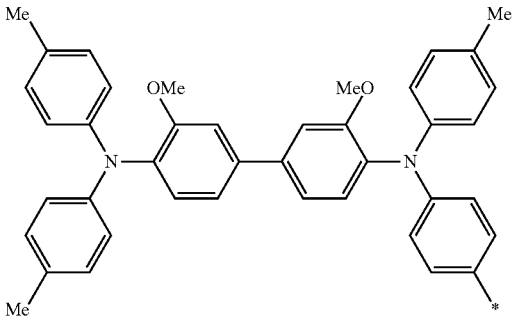
-continued
(1)-15
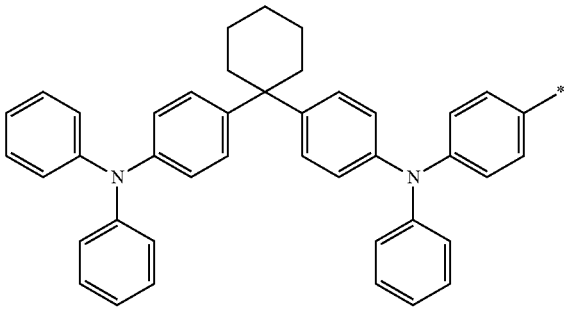
(1)-16
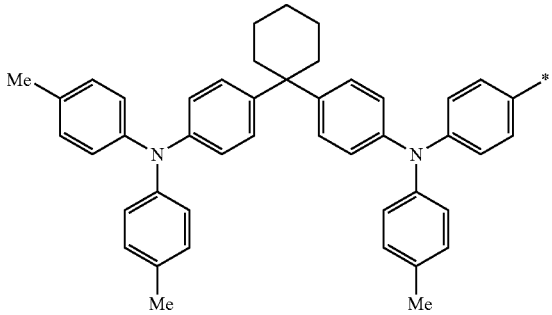
(1)-17
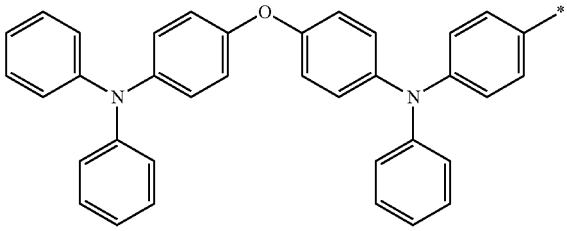
(1)-18
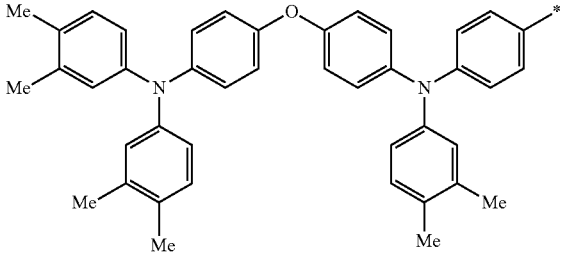
(1)-19
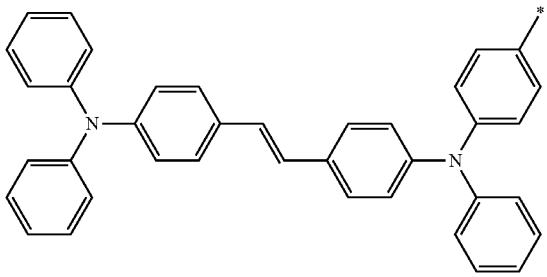

-continued
(1)-20
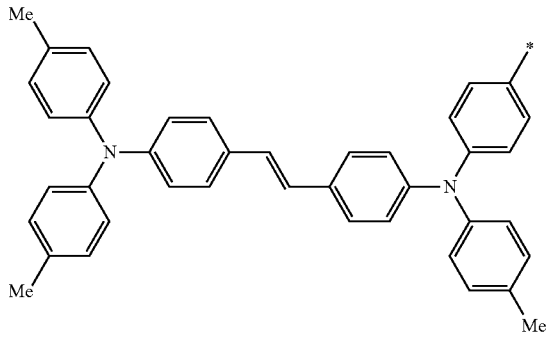
(1)-21
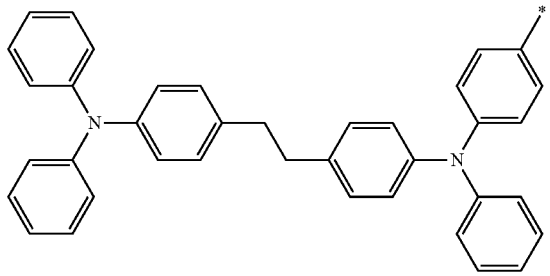
(1)-22
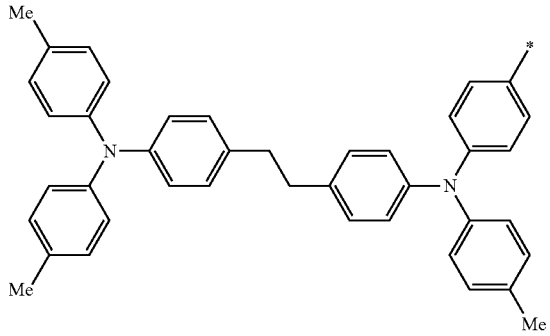
(1)-23
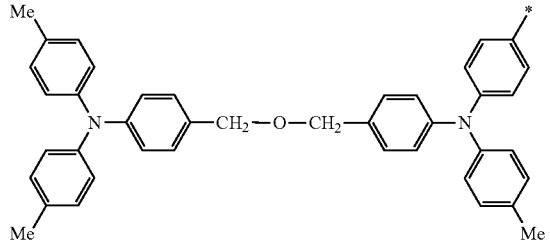
(1)-24
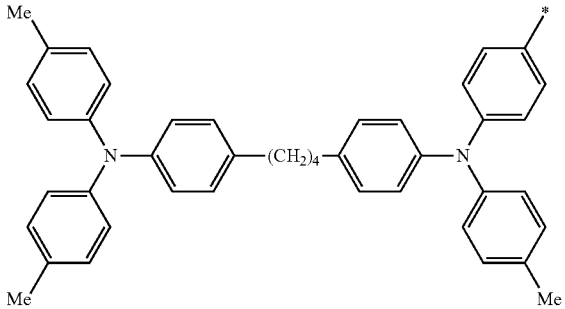
-continued
(1)-25
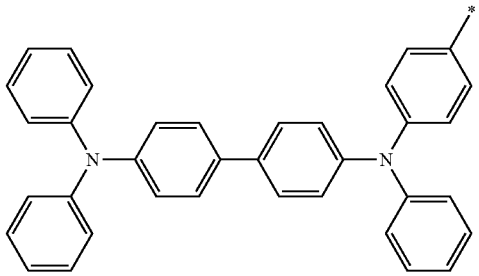
Next, "(2)-1" to "(2)-29" will be shown as specific examples of the charge transporting skeleton F when the total number of D in Formula (I) is 2, but the charge transporting skeleton F is not limited thereto.
In each structure, * represents connection to D in Formula (I).
(2)-1
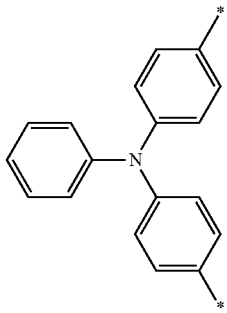
(2)-2
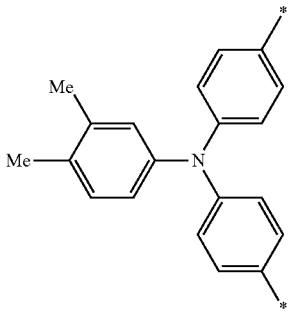
(2)-3
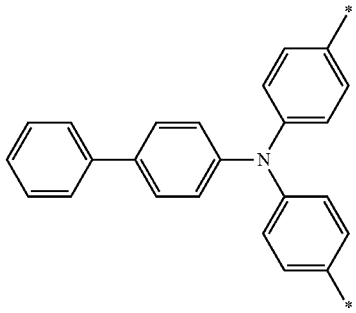

-continued
(2)-4
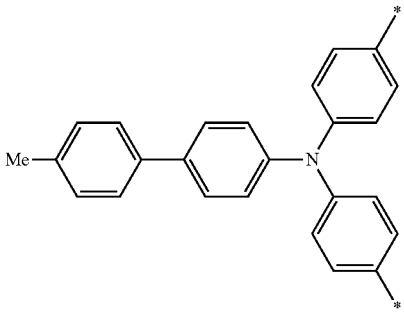
(2)-5
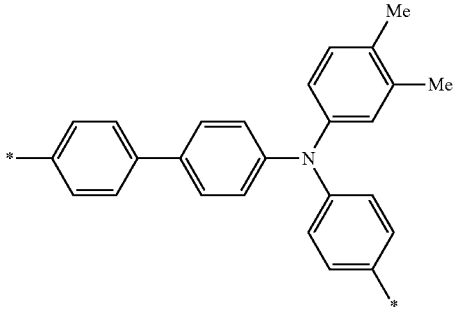
(2)-6
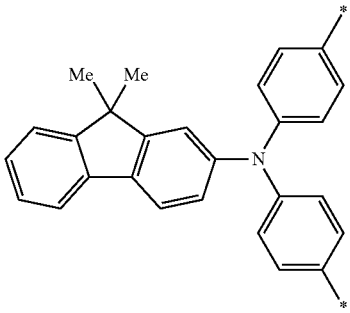
(2)-7
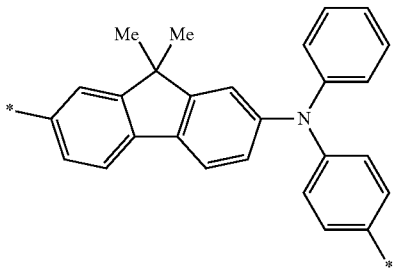
(2)-8
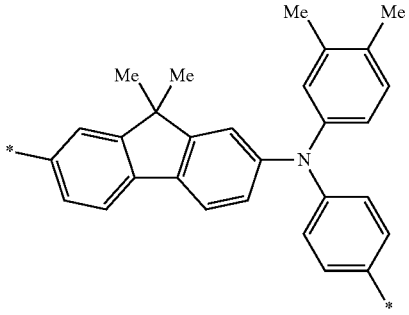
-continued
(2)-9
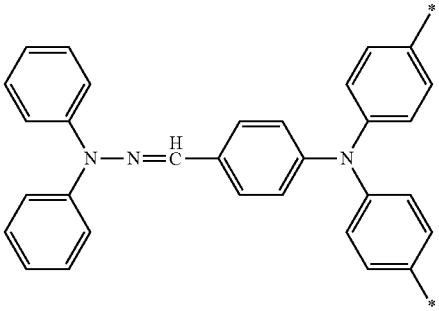
(2)-10
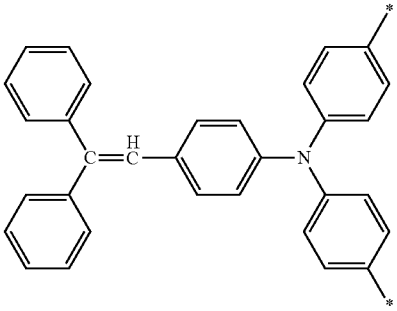
(2)-11
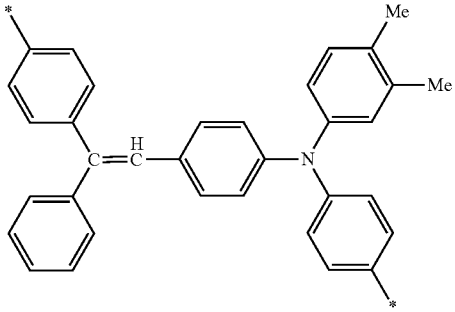
(2)-12
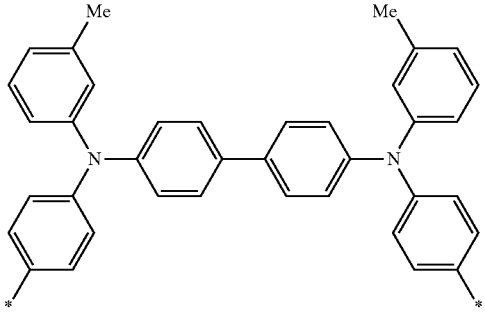
(2)-13
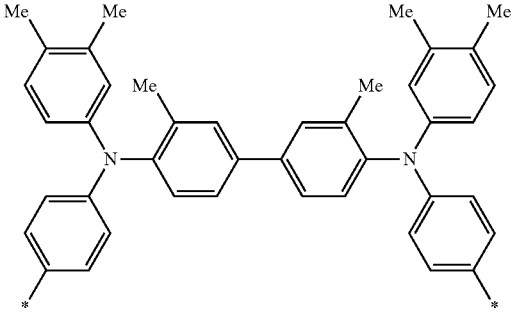

-continued
(2)-14
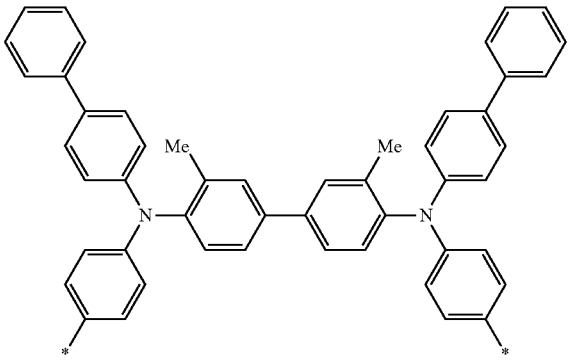
(2)-15
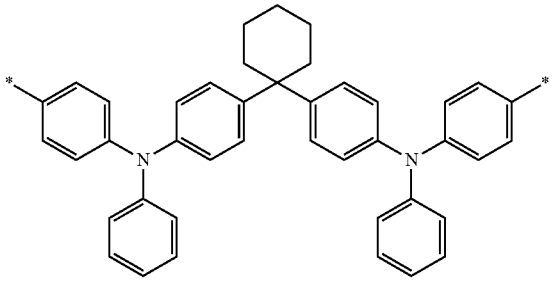
(2)-16
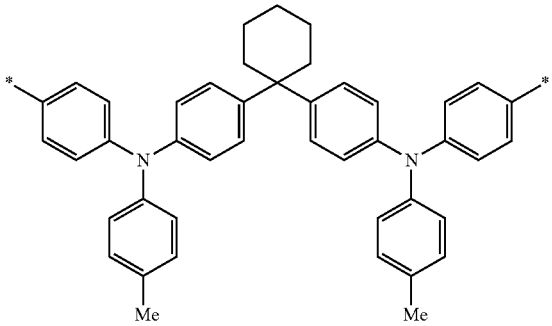
(2)-17
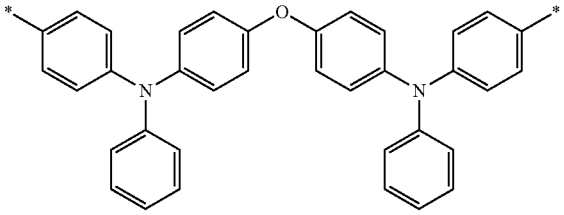
(2)-18
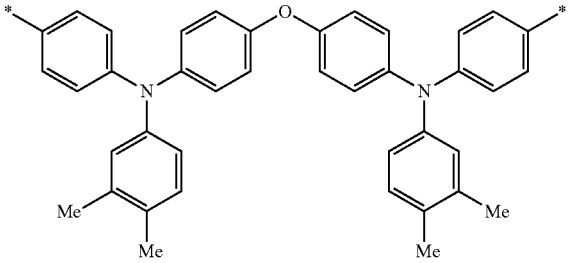
-continued
(2)-19
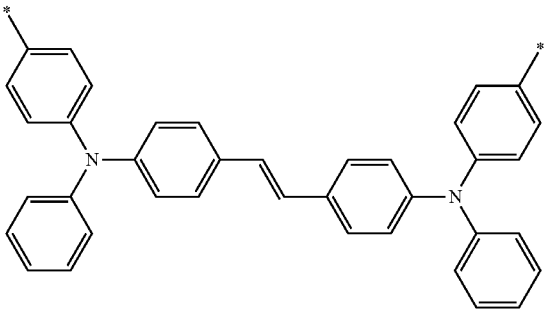
(2)-20
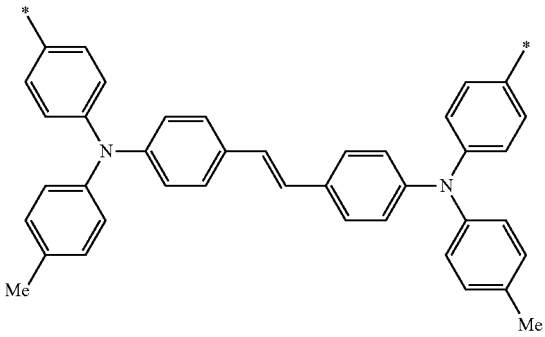
(2)-21
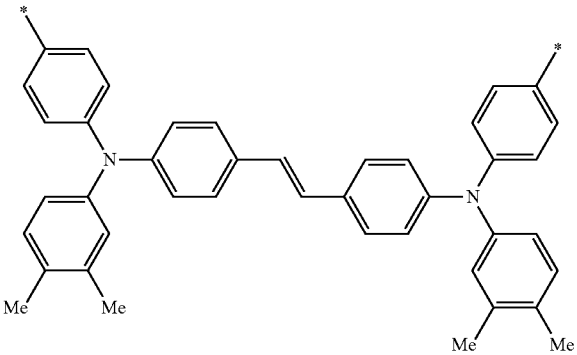
(2)-22
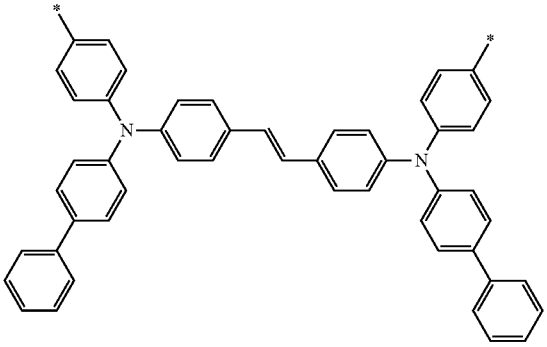

-continued
(2)-23
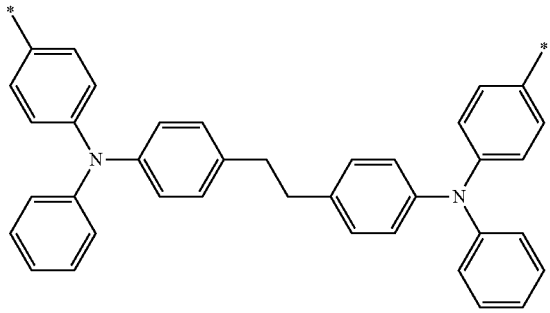
(2)-24
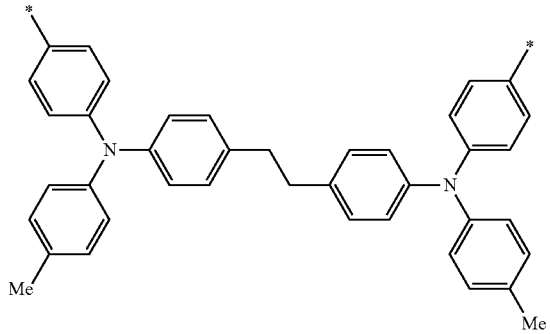
(2)-25
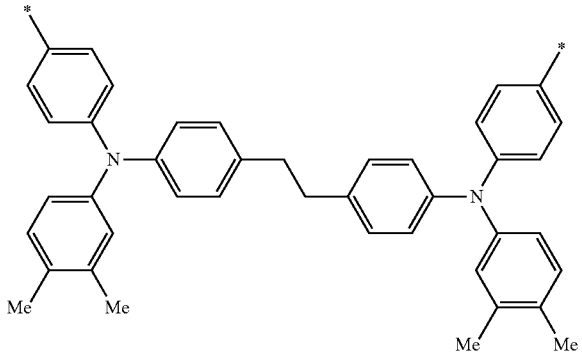
(2)-26
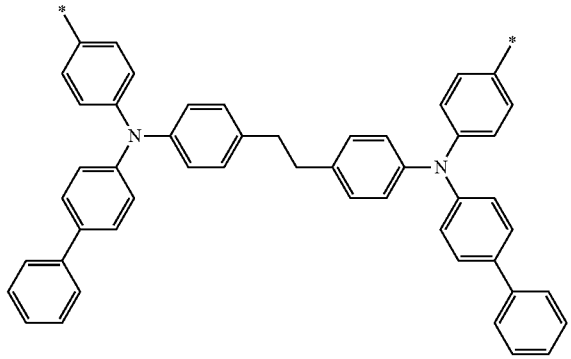
-continued
(2)-27
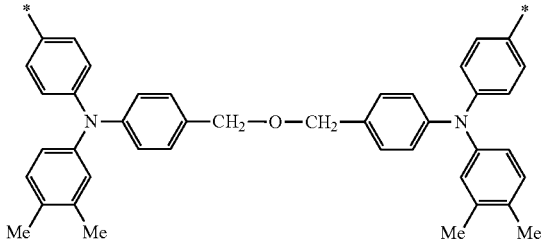
(2)-28
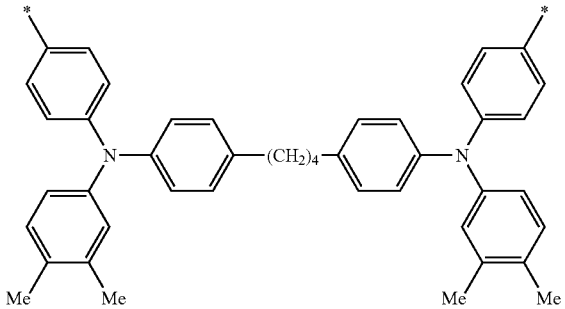
(2)-29
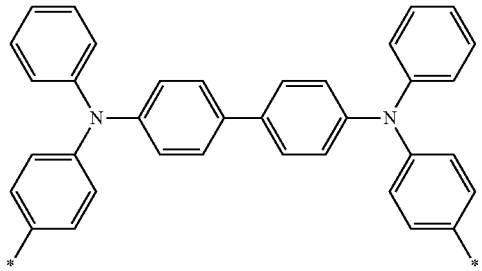
Next, "(3)-1" to "(3)-29" will be shown as specific examples of the charge transporting skeleton F when the total number of D in Formula (I) is 3, but the charge transporting skeleton F is not limited thereto.
In each structure, represents connection to D in Formula (I).
(3)-1
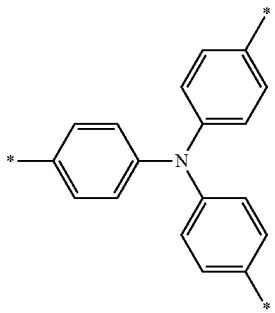

-continued
(3)-2
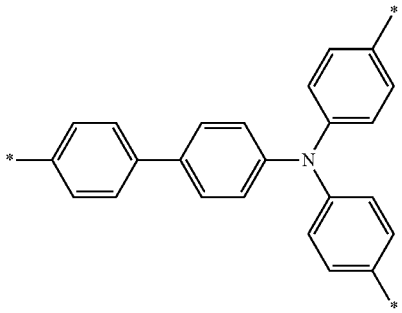
(3)-3
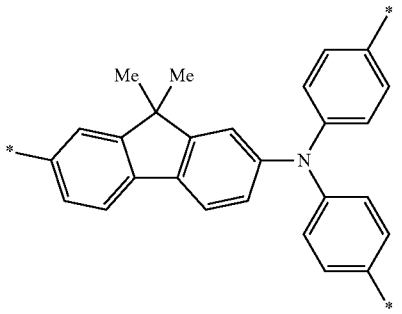
(3)-4
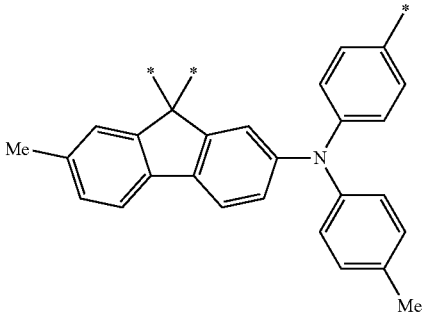
(3)-5
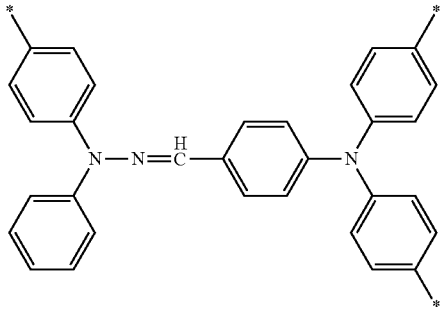
(3)-6
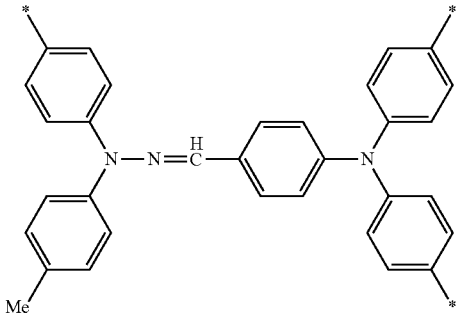
-continued
(3)-7
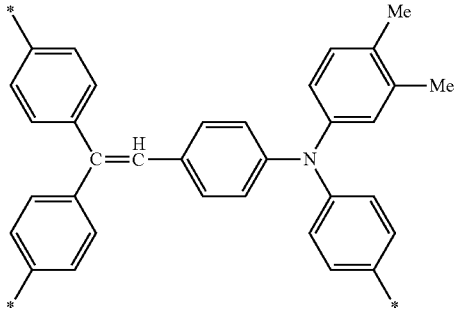
(3)-8
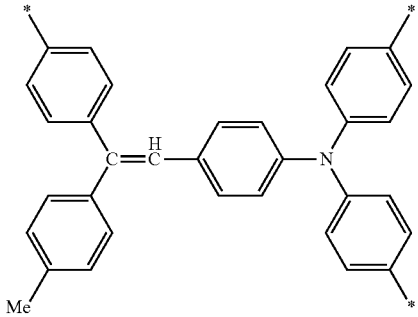
(3)-9
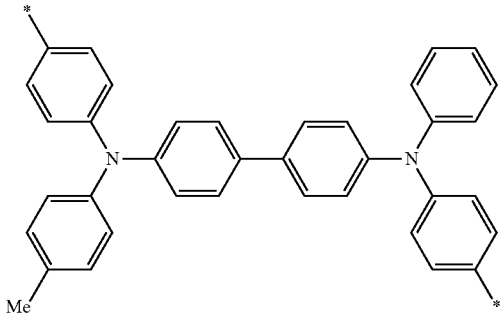
(3)-10
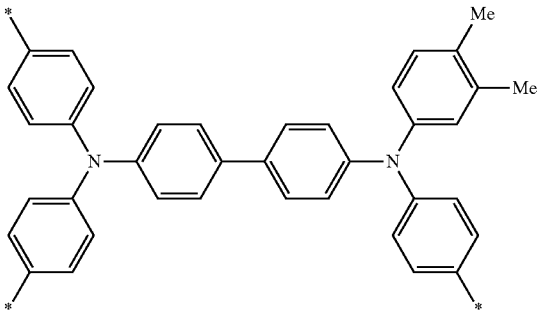
(3)-11
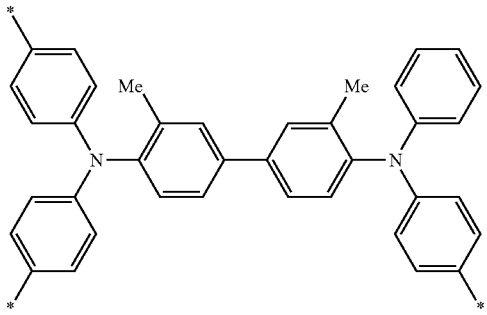

-continued
(3)-12
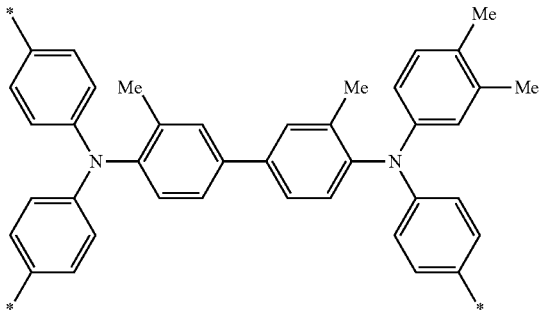
(3)-13
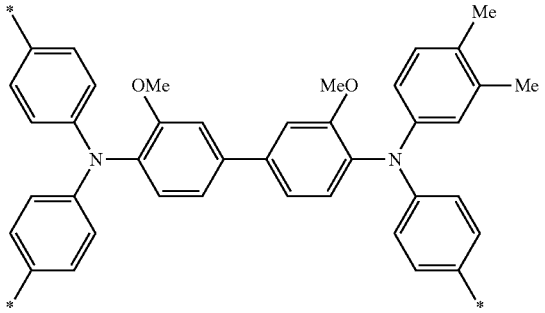
(3)-14
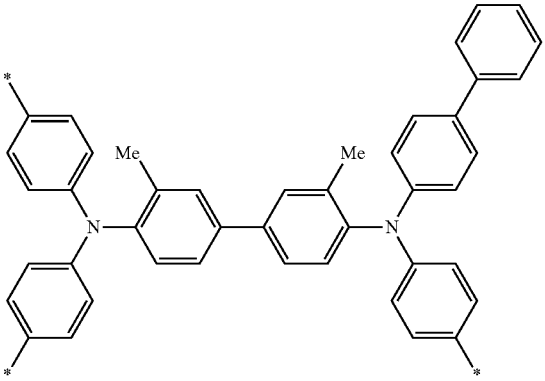
(3)-15
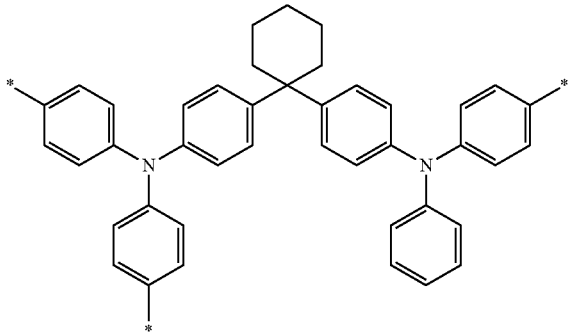
-continued
(3)-16
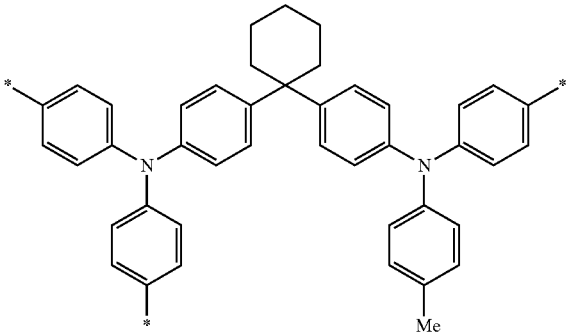
(3)-17
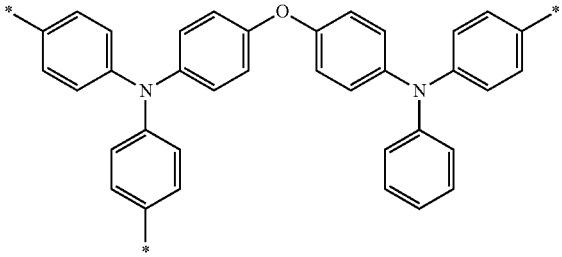
(3)-18
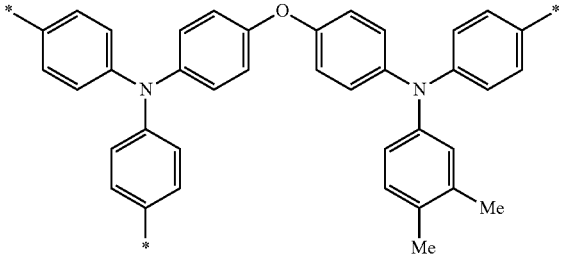
(3)-19
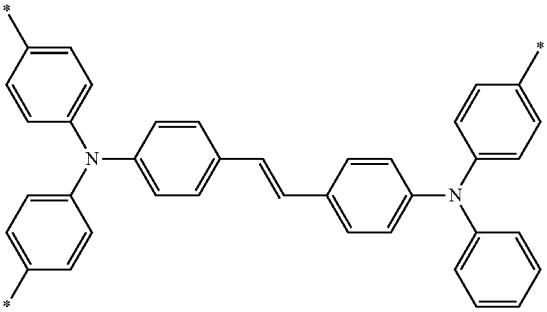
(3)-20
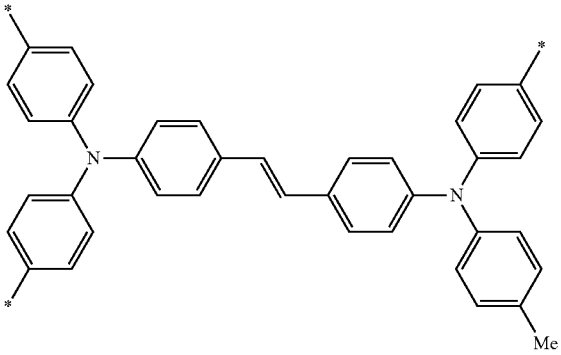

-continued
(3)-21
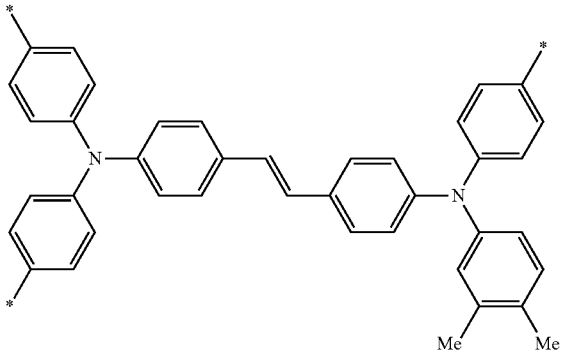
(3)-22
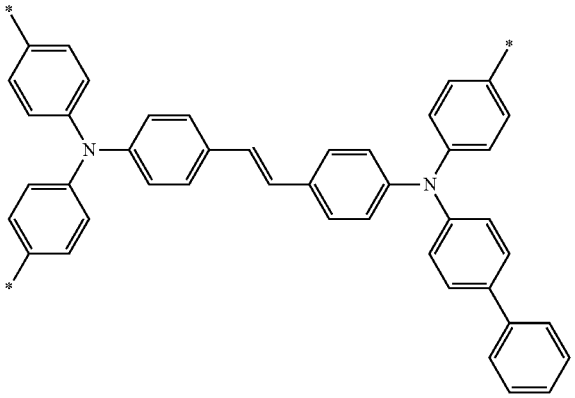
(3)-23
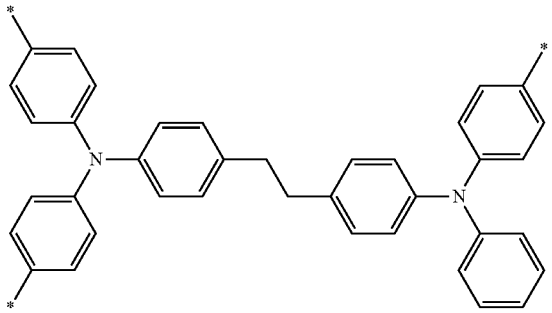
(3)-24
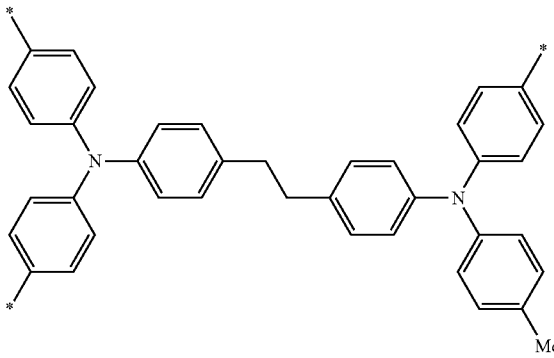
-continued
(3)-25
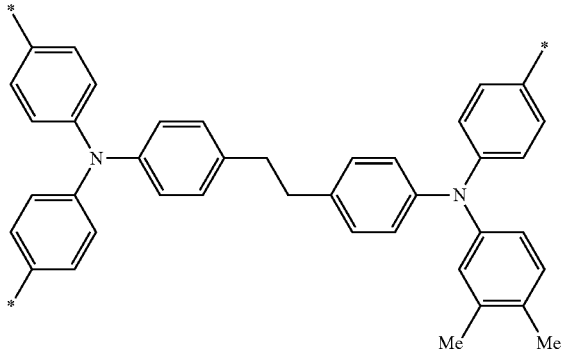
(3)-26
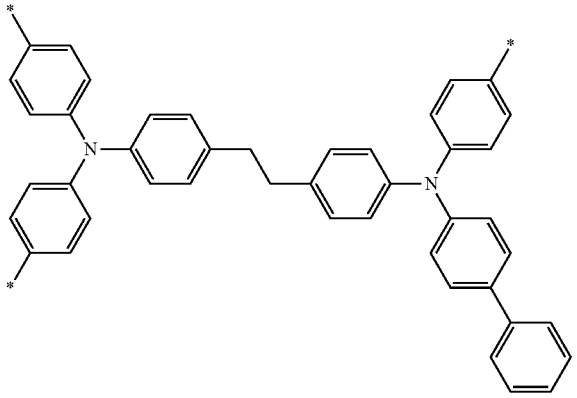
(3)-27
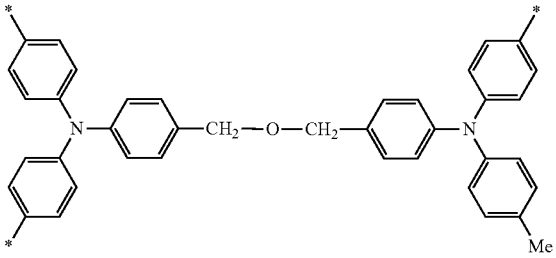
(3)-28
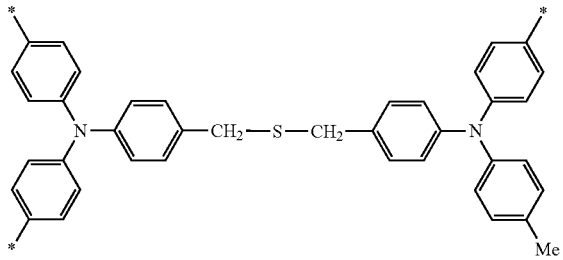

-continued
(3)-29
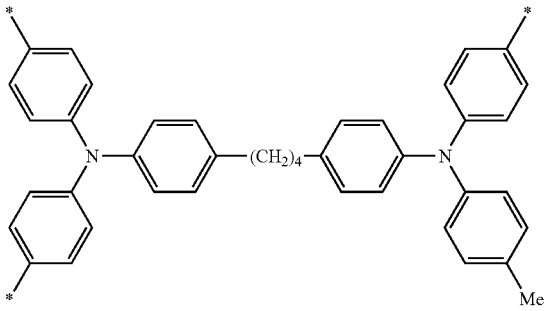
Next, "(4)-1" to "(4)-31" will be shown as specific examples of the charge transporting skeleton F when the total number of D in Formula (I) is 4 or more, but the charge transporting skeleton F is not limited thereto. In each structure, * represents connection to D in Formula (I).
(4)-1
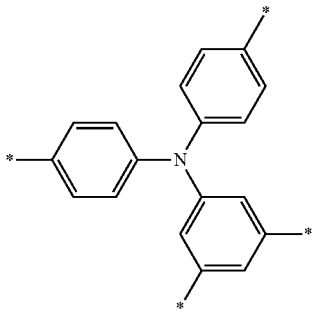
(4)-2
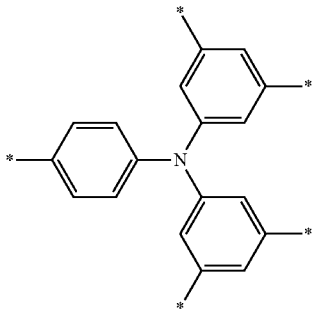
(4)-3
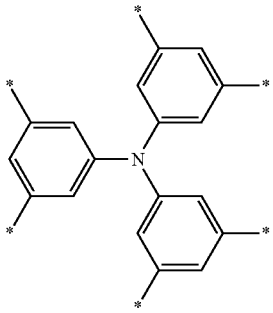
-continued
(4)-4
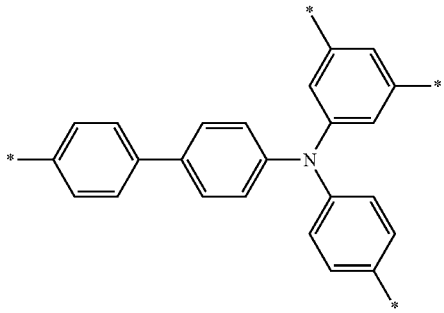
(4)-5
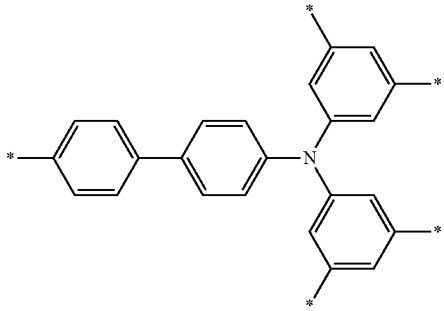
(4)-6
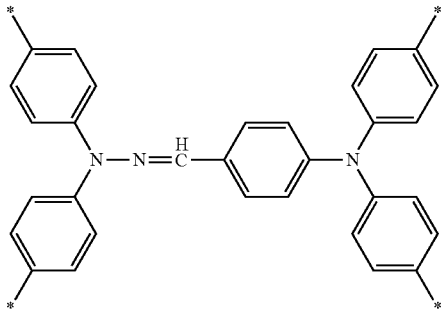
(4)-7
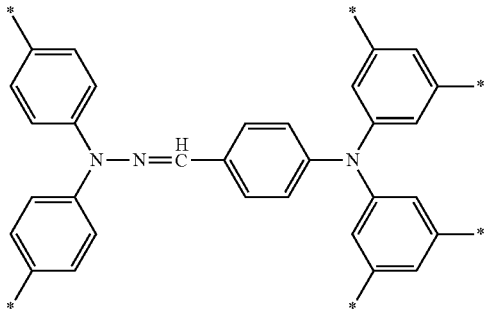
(4)-8
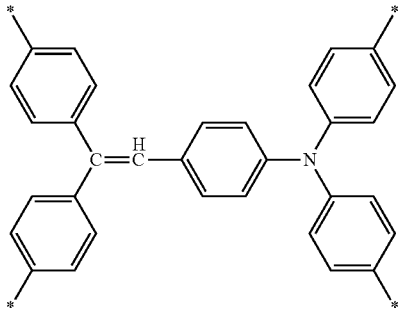

-continued
(4)-9
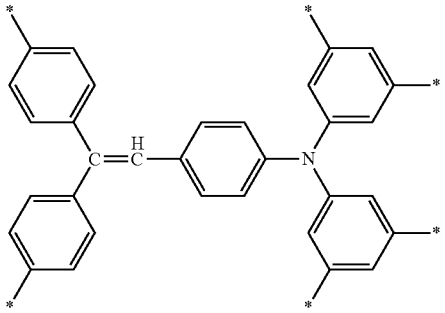
(4)-10
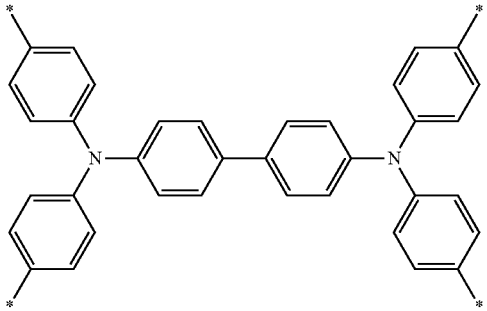
(4)-11
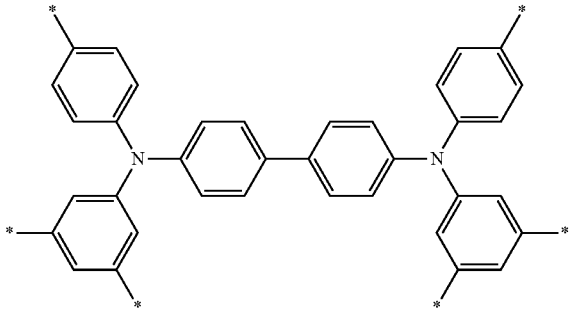
(4)-12
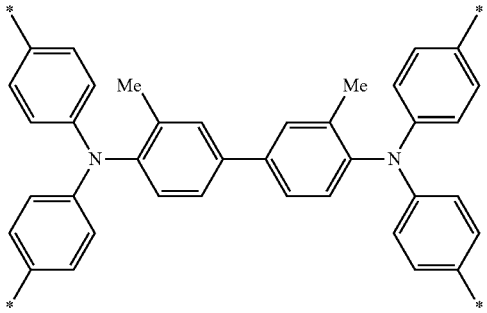
-continued
(4)-13
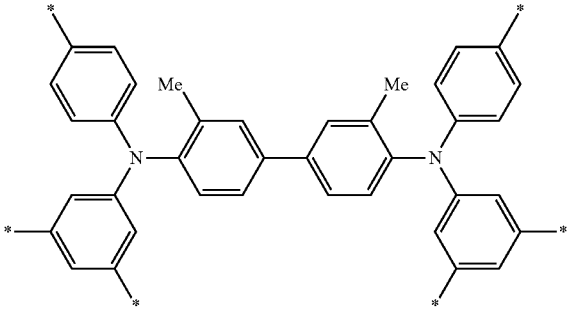
(4)-14
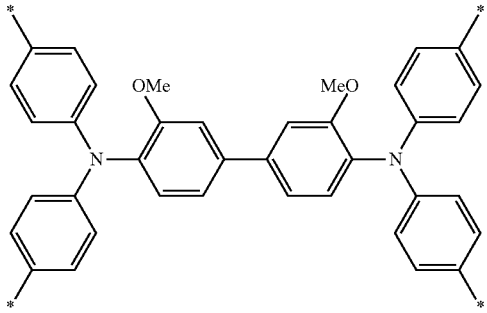
(4)-15
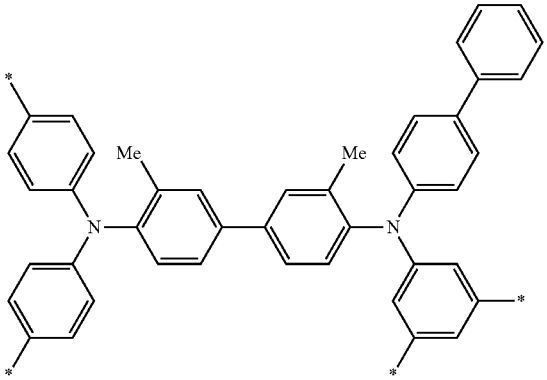
(4)-16
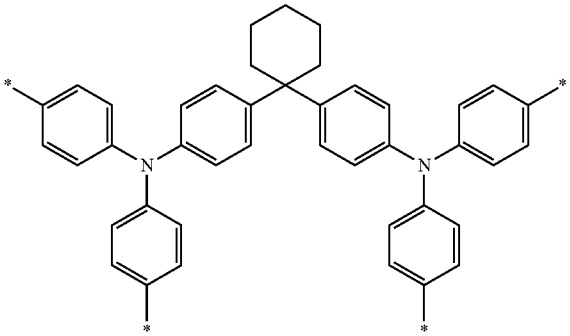

-continued
(4)-17
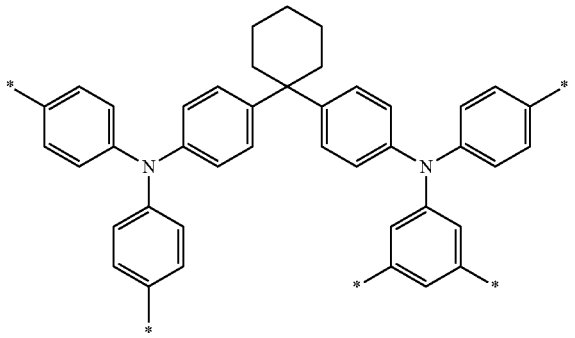
(4)-18
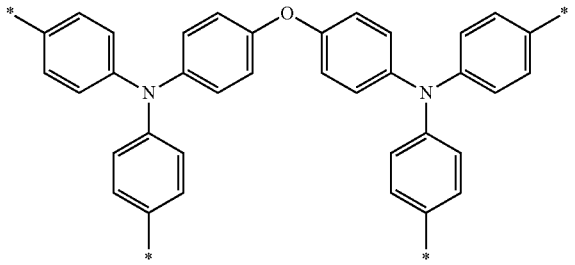
(4)-19
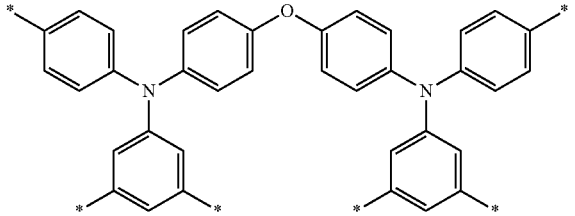
(4)-20
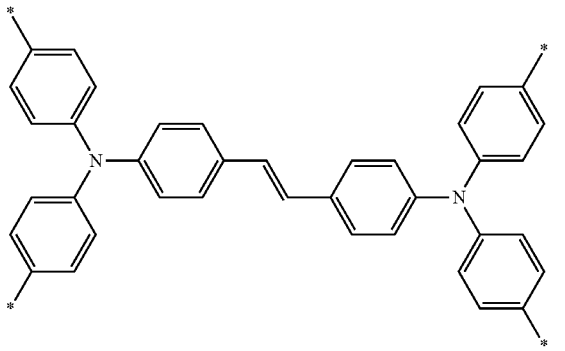
(4)-21
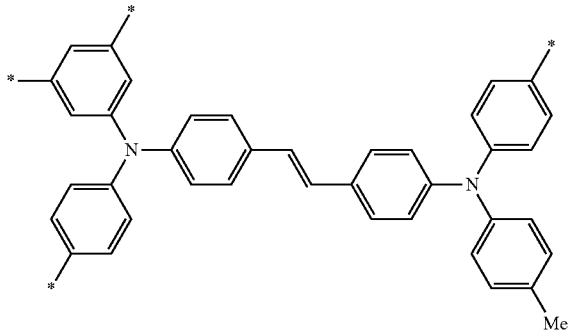
-continued
(4)-22
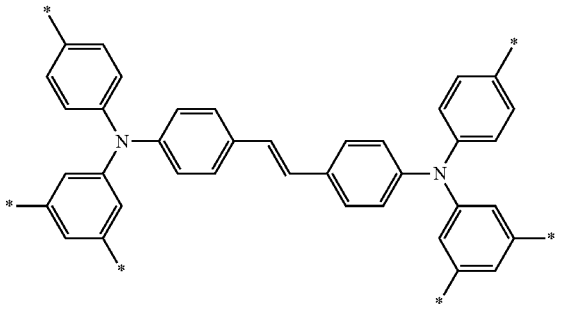
(4)-23
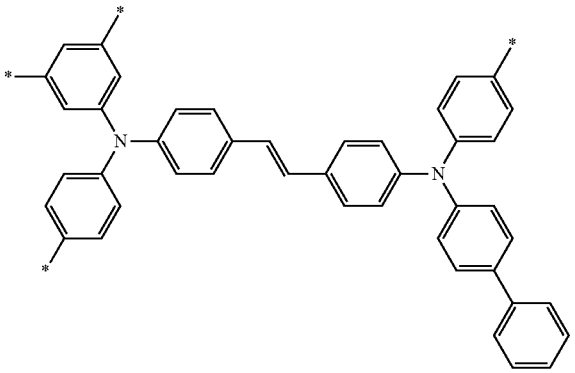
(4)-24
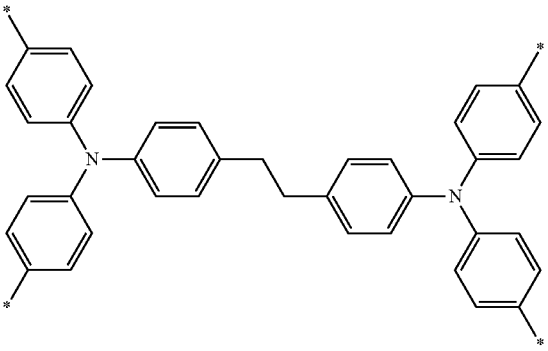
(4)-25
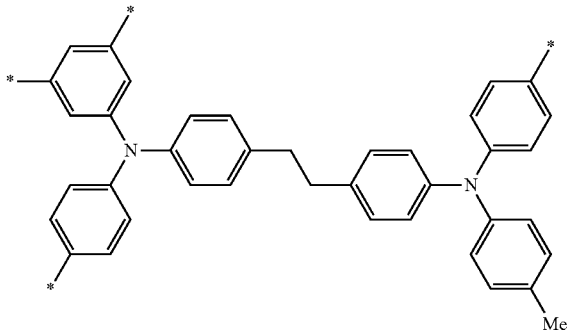

-continued
(4)-26
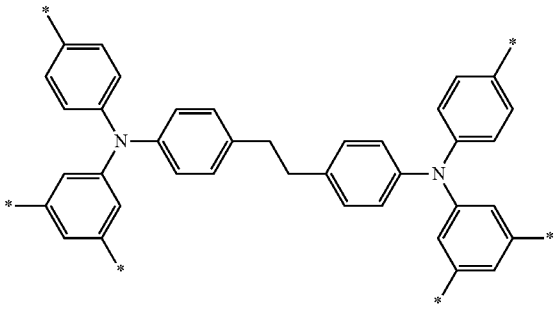
(4)-27
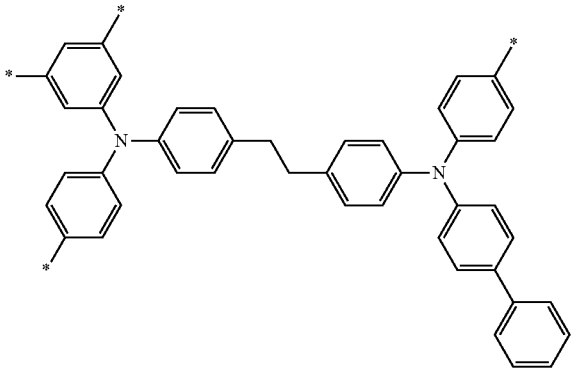
(4)-28
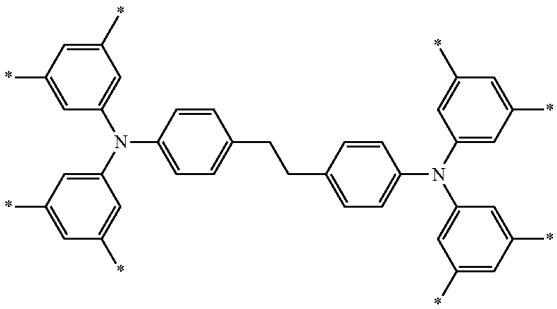
(4)-29
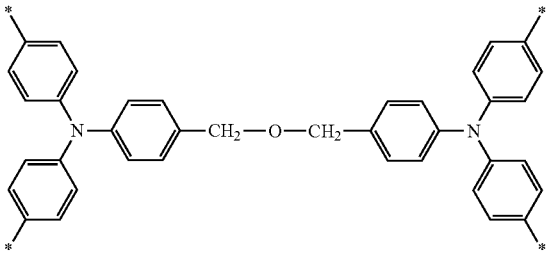
(4)-30
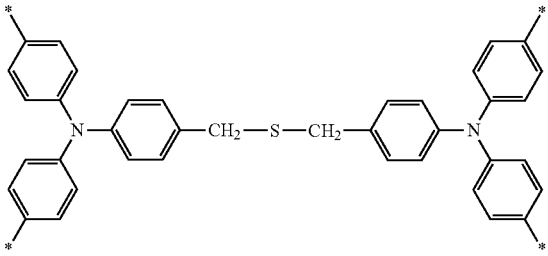
-continued
(4)-31
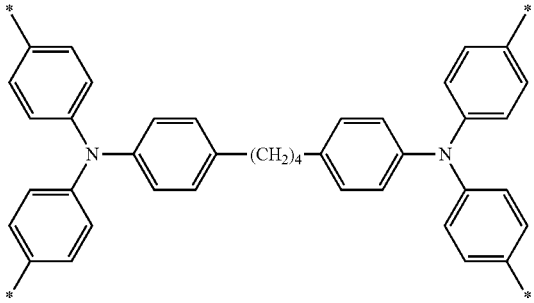
Next, "D1-1" to "D1-88" and "D2-1" to "D2-69" will be shown as specific examples of D in Formula (I) or Formula (V), i.e., the group represented by Formula (IIa). In each structure, * represents connection to the charge transporting skeleton F in Formula (I), or $Ar^1$ to $Ar^5$ in Formula (V).
D1-1
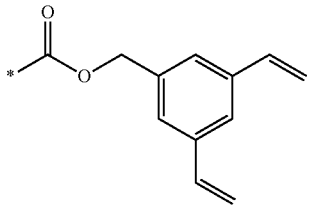
D1-2
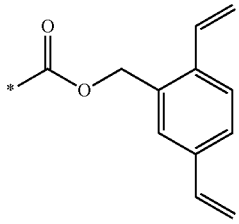
D1-3
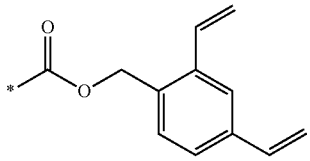
D1-4
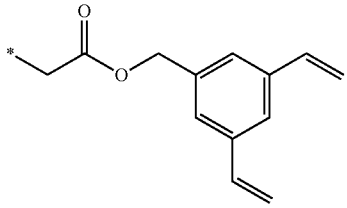
D1-5
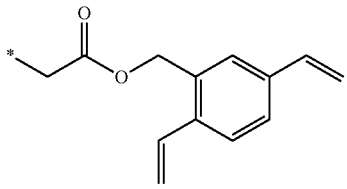

-continued
D1-6
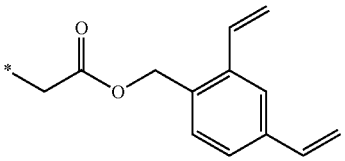
D1-7
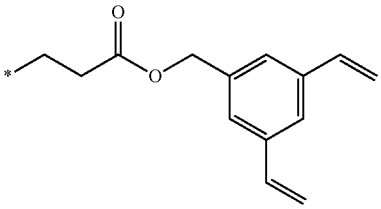
D1-8
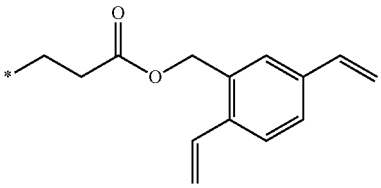
D1-9
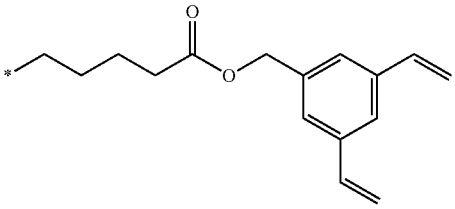
D1-10
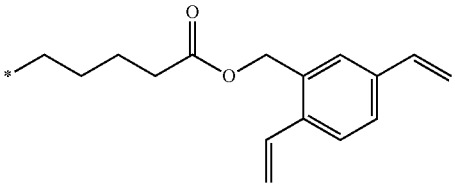
D1-11
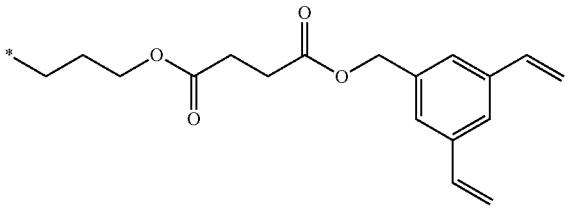
D1-12
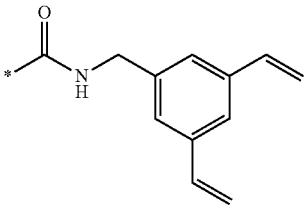
-continued
D1-13
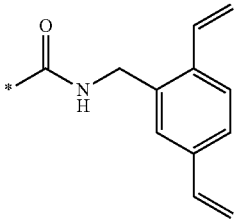
D1-14
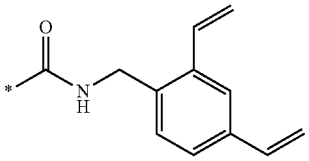
D1-15
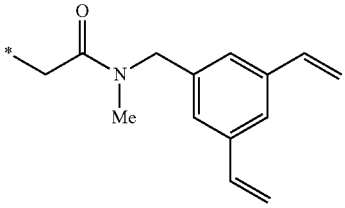
D1-16
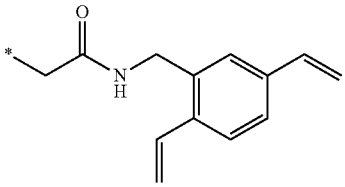
D1-17
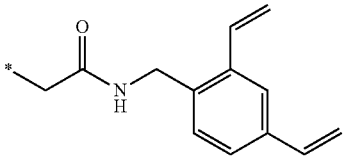
D1-18
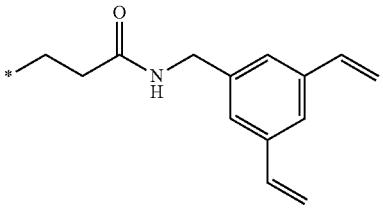
D1-19
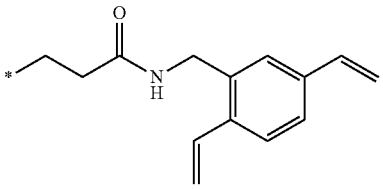
D1-20
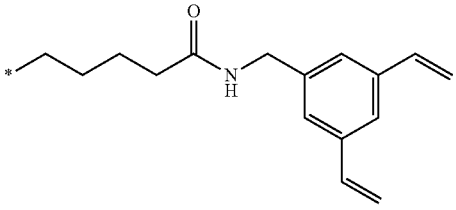

-continued
D1-21
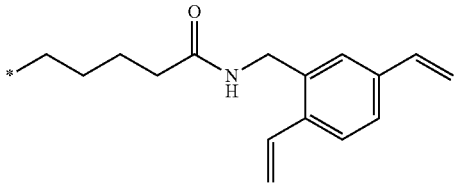
D1-22
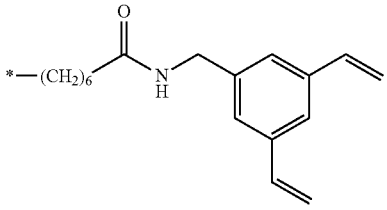
D1-23
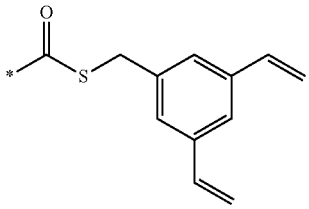
D1-24
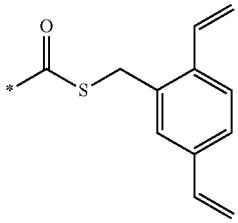
D1-25
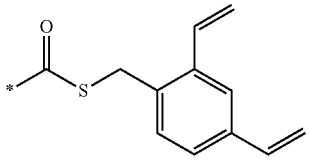
D1-26
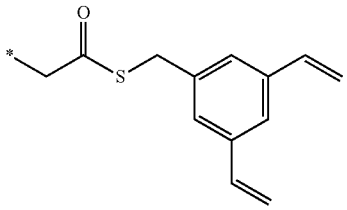
D1-27
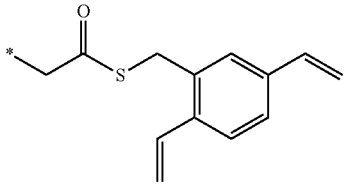
D1-28
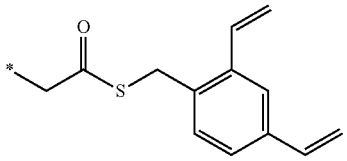
-continued
D1-29
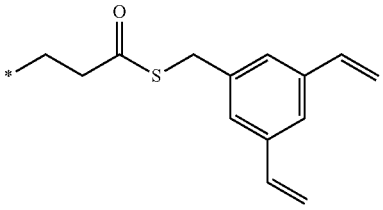
D1-30
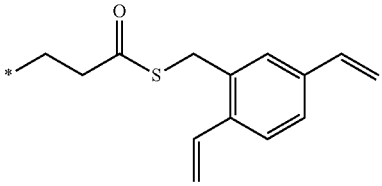
D1-31
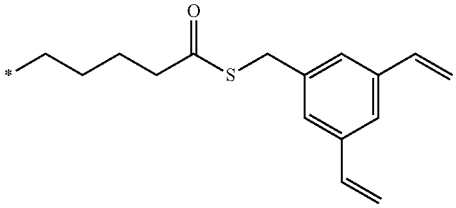
D1-32
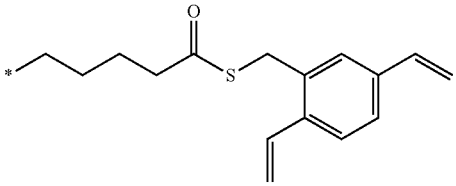
D1-33
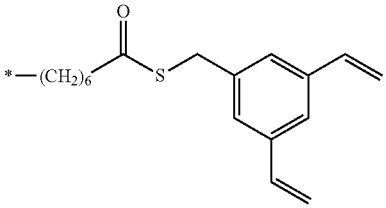
D1-34
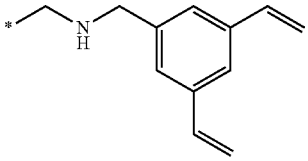
D1-35
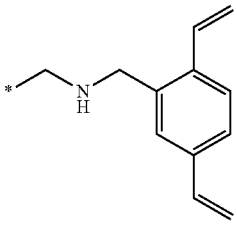
D1-36
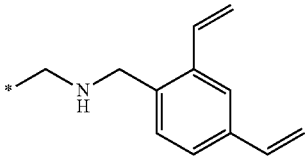

-continued
D1-37
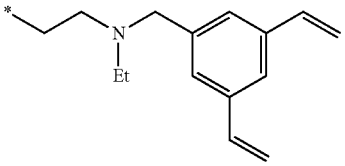
D1-38
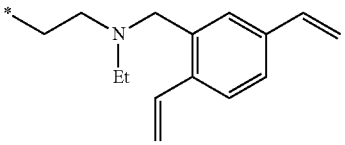
D1-39
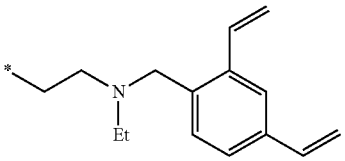
D1-40
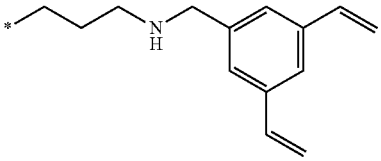
D1-41
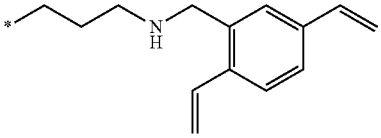
D1-42
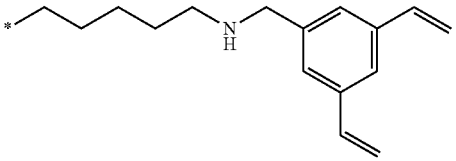
D1-43
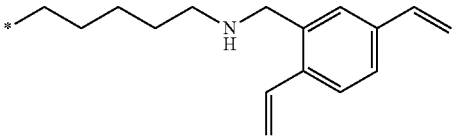
D1-44
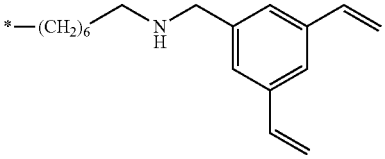
D1-45
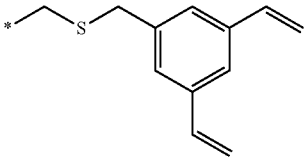
-continued
D1-46
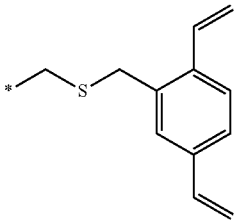
D1-47
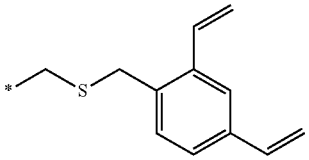
D1-48
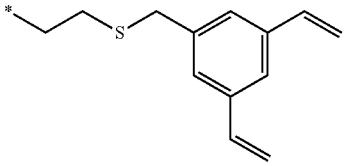
D1-49
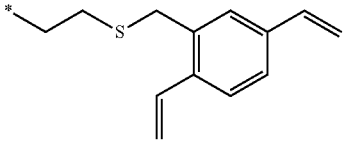
D1-50
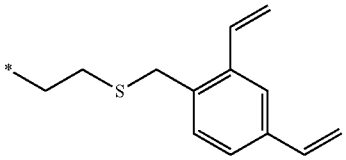
D1-51
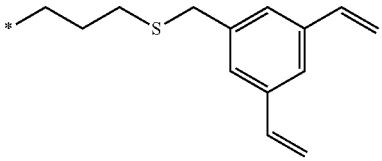
D1-52
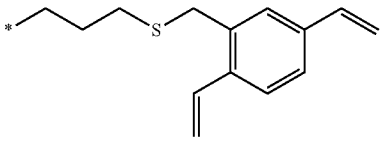
D1-53
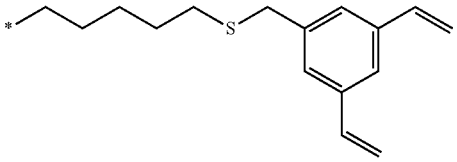
D1-54
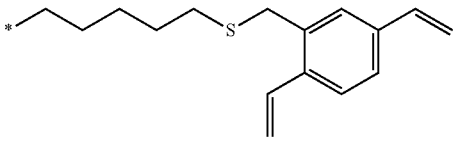

-continued
D1-55
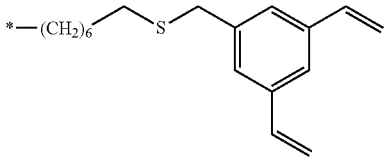
D1-56
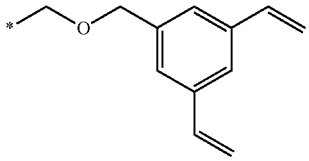
D1-57
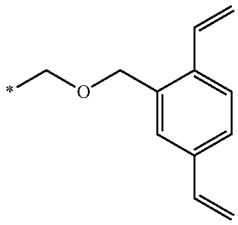
D1-58
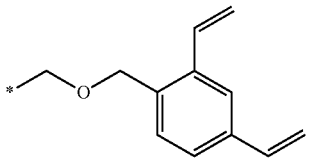
D1-59
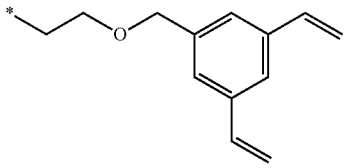
D1-60
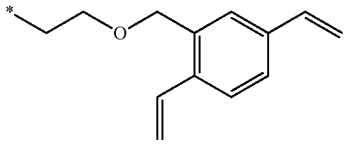
D1-61
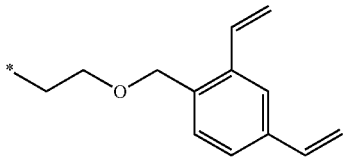
D1-62
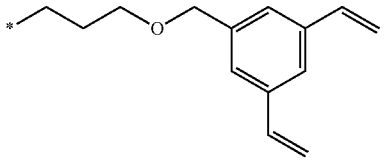
D1-63
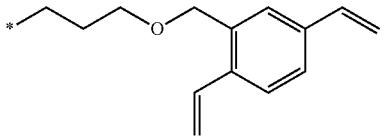
-continued
D1-64
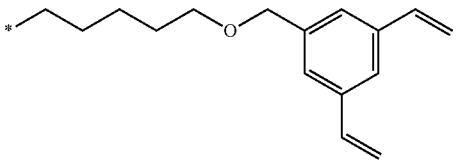
D1-65
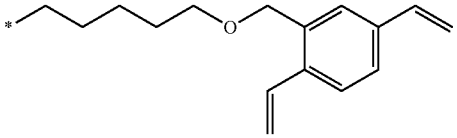
D1-66
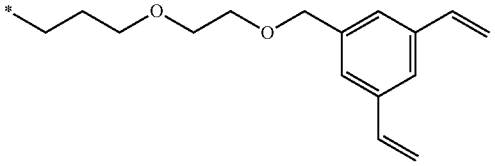
D1-67
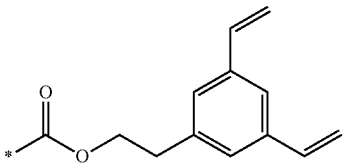
D1-68
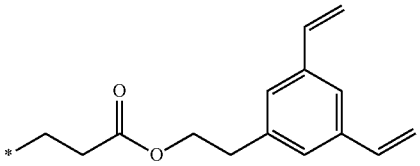
D1-69
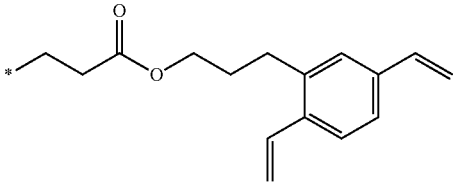
D1-70
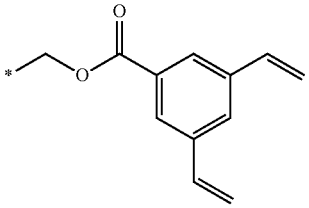
D1-71
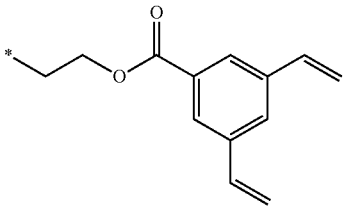

-continued
D1-72
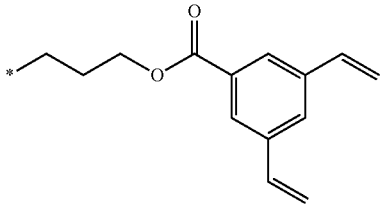
D1-73
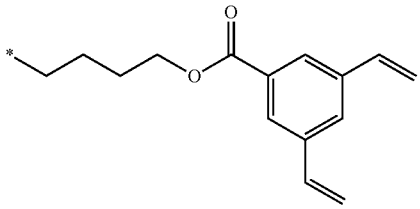
D1-74
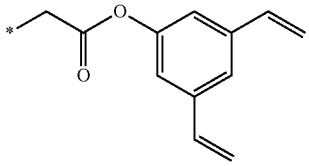
D1-75
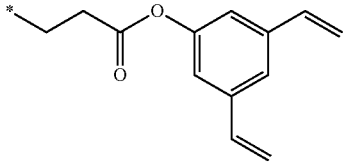
D1-76
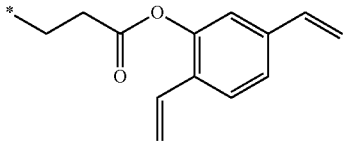
D1-77
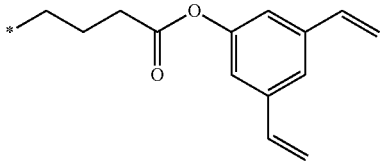
D1-78
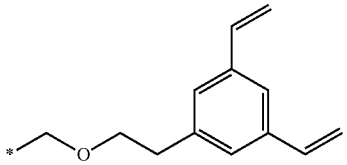
D1-79
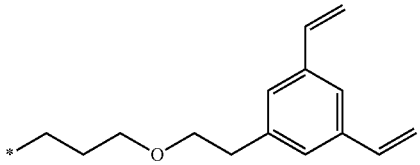
D1-80
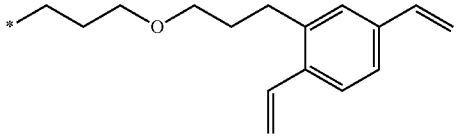
-continued
D1-81
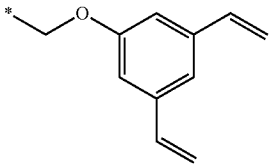
D1-82
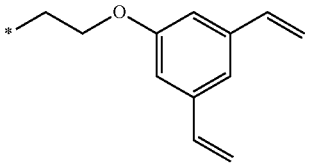
D1-83
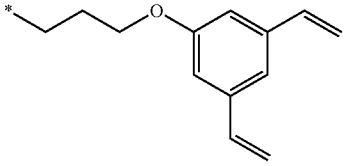
D1-84
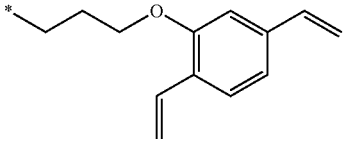
D1-85
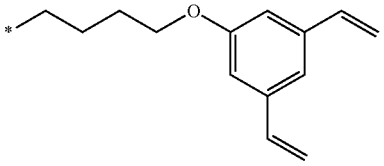
D1-86
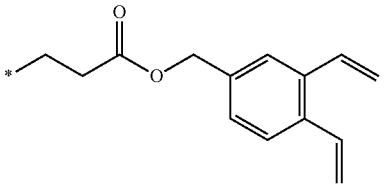
D1-87
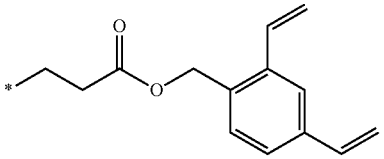
D1-88
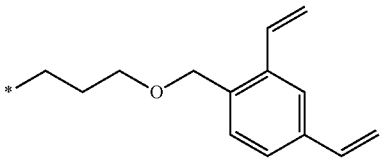

-continued
D2-1
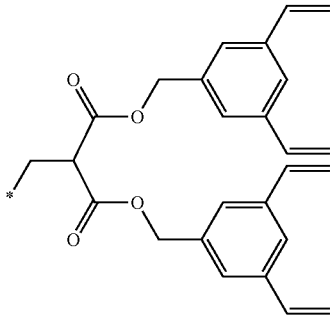
D2-2
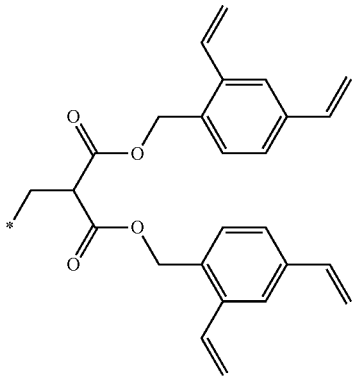
D2-3
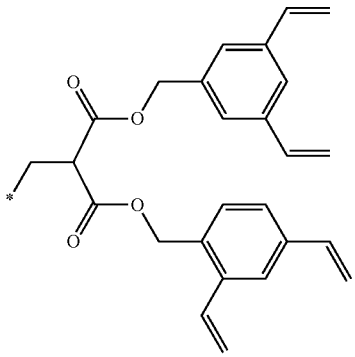
D2-4
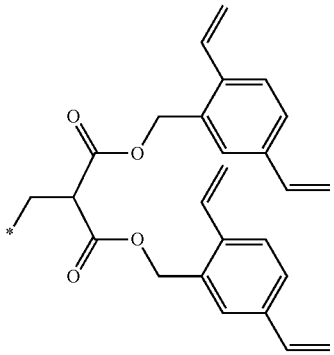
-continued
D2-5
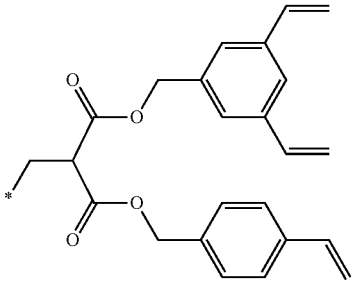
D2-6
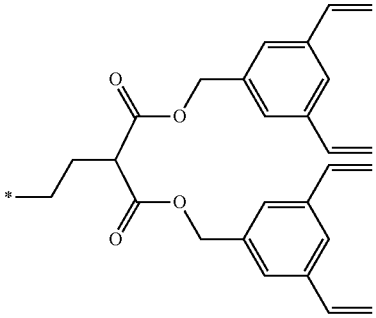
D2-7
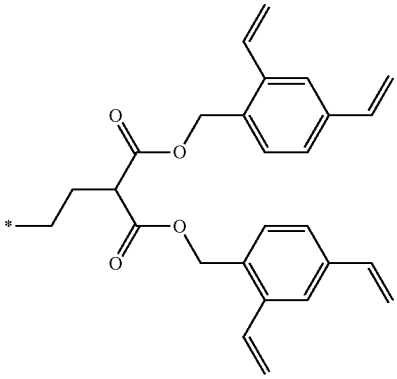
D2-8
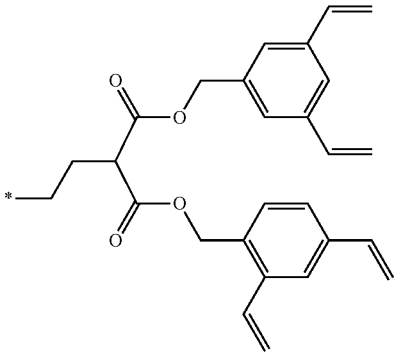
D2-9
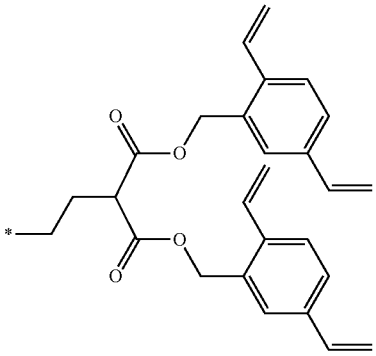

-continued
D2-10
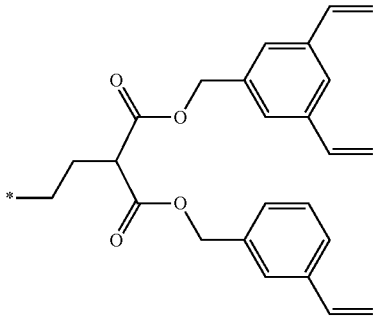
D2-11
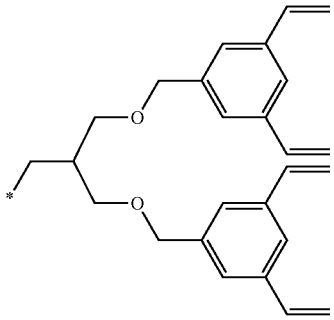
D2-12
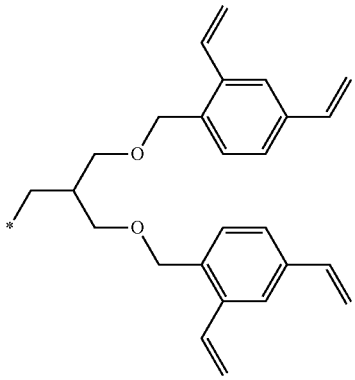
D2-13
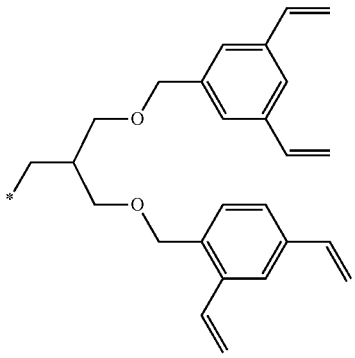
-continued
D2-14
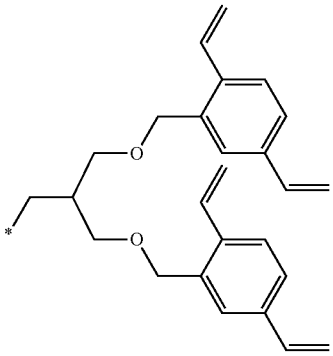
D2-15
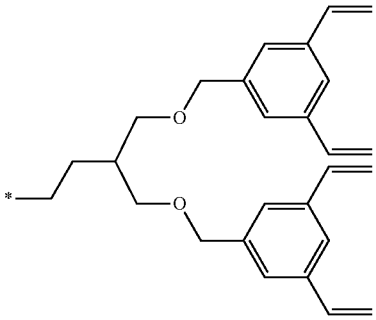
D2-16
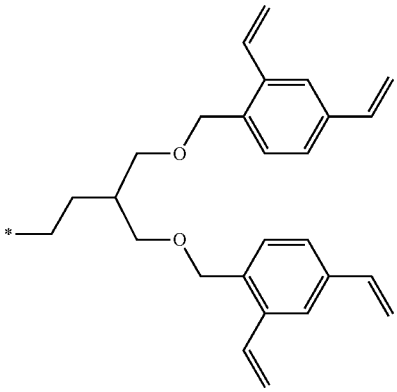
D2-17
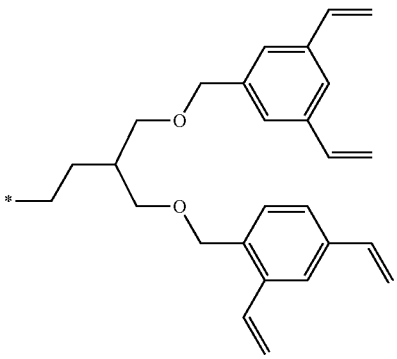

-continued
D2-18
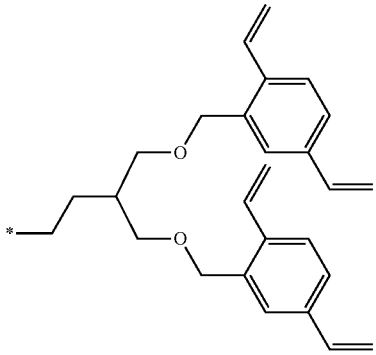
D2-19
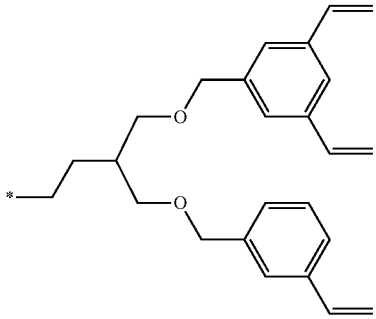
D2-20
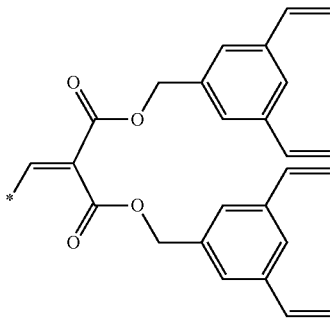
D2-21
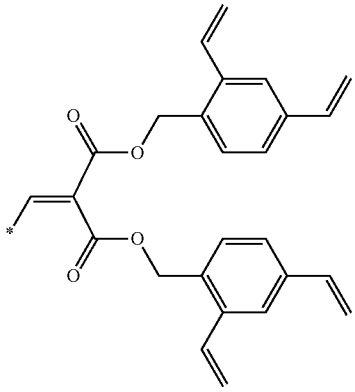
-continued
D2-22
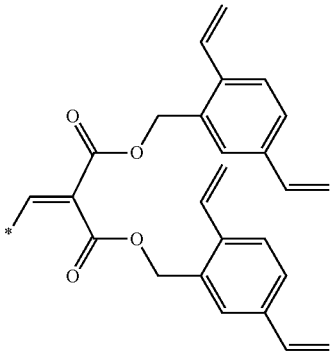
D2-23
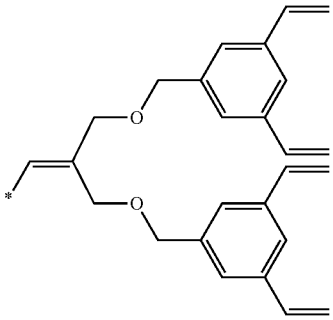
D2-24
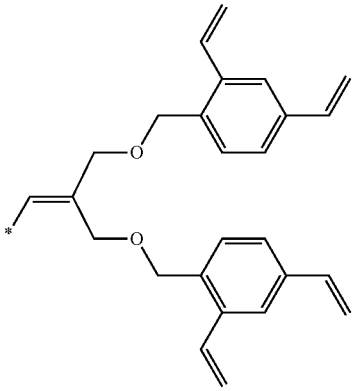
D2-25
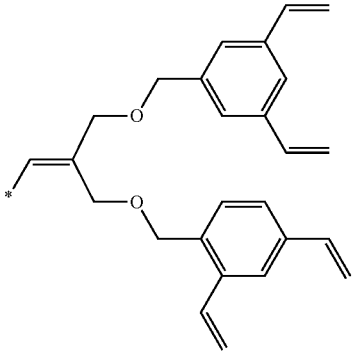

-continued
D2-26
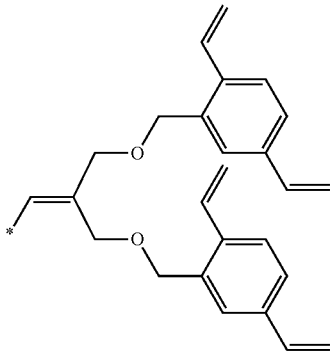
D2-27
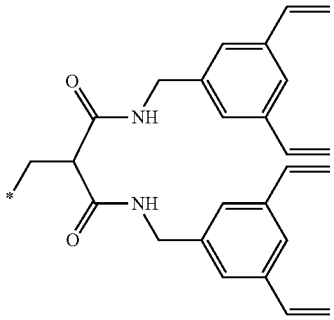
D2-28
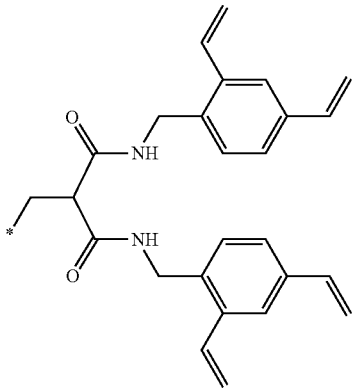
D2-29
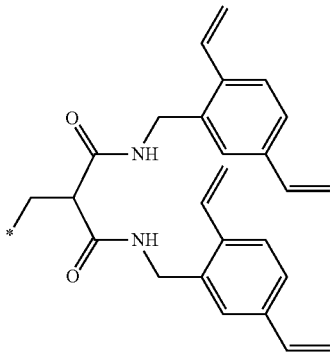
-continued
D2-30
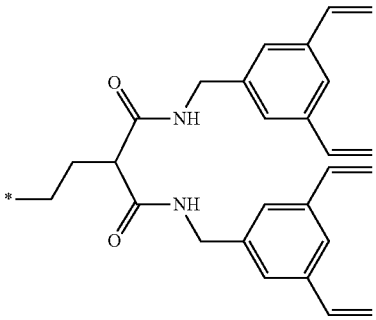
D2-31
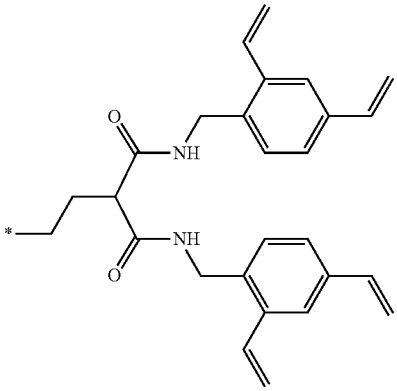
D2-32
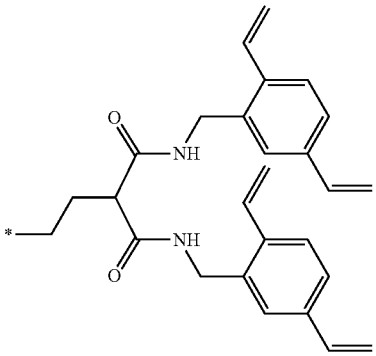
D2-33
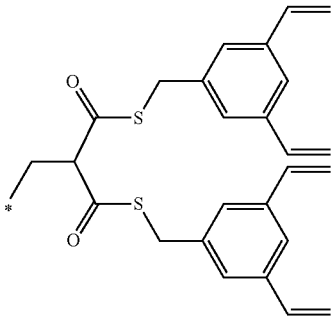

-continued
D2-34
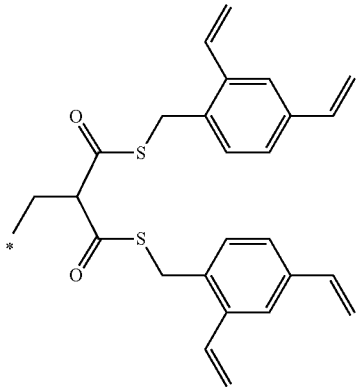
D2-35
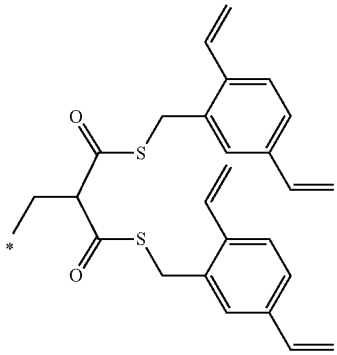
D2-36
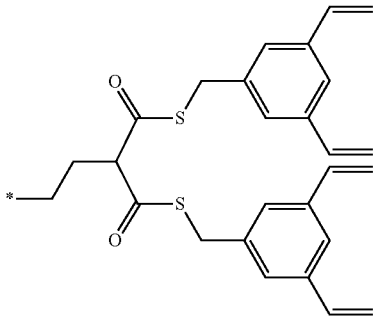
D2-37
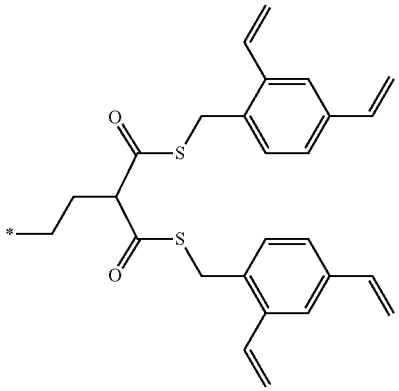
-continued
D2-38
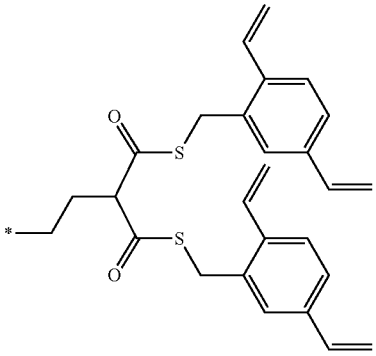
D2-39
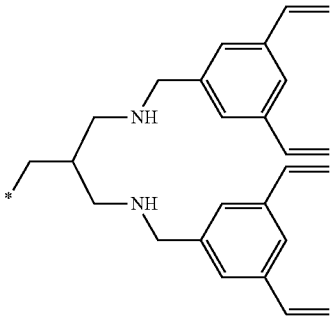
D2-40
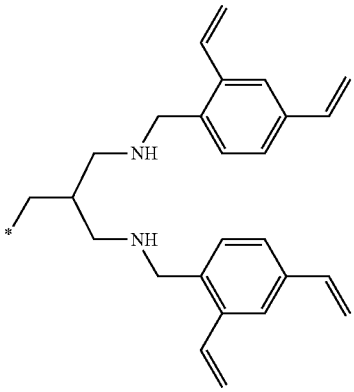
D2-41
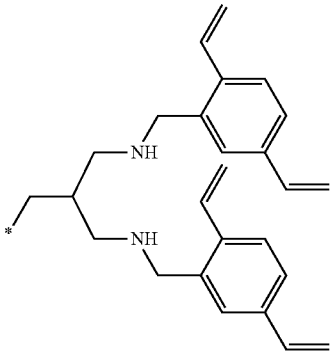

-continued
D2-42
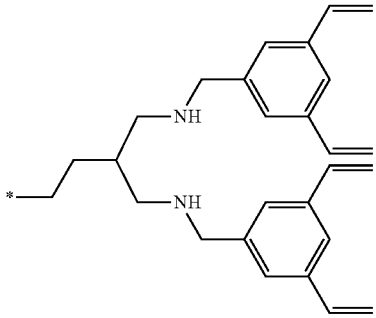
D2-43
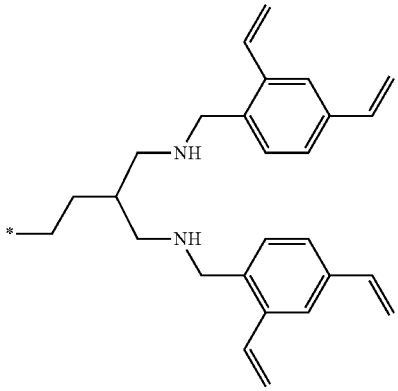
D2-44
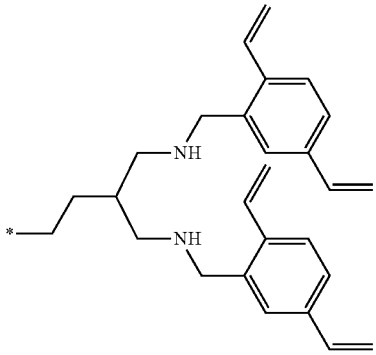
D2-45
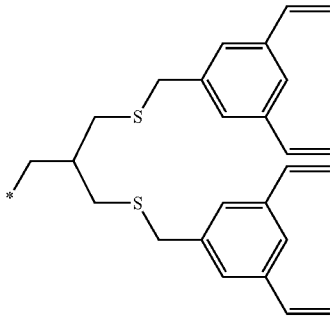
-continued
D2-46
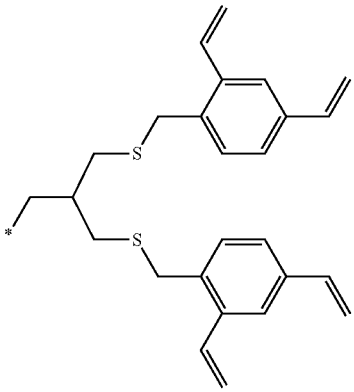
D2-47
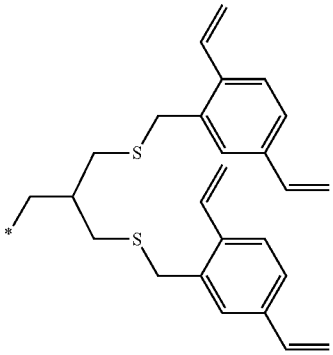
D2-48
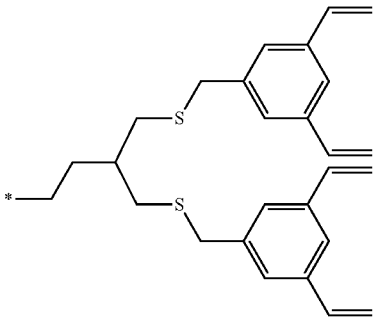
D2-49
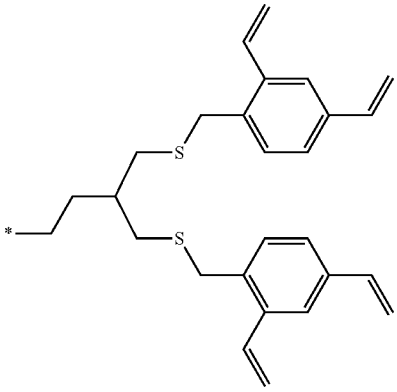

-continued
D2-50
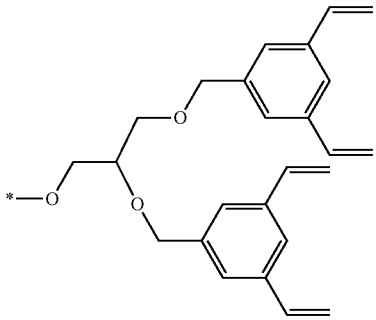
D2-51
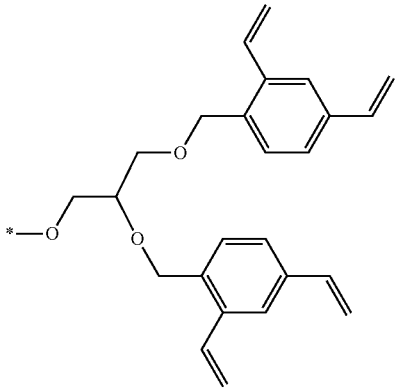
D2-52
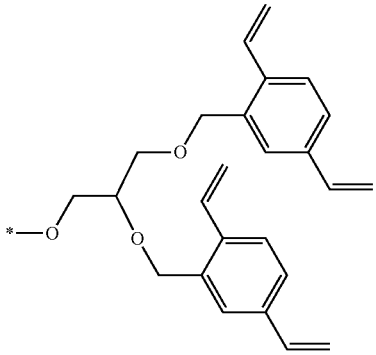
D2-53
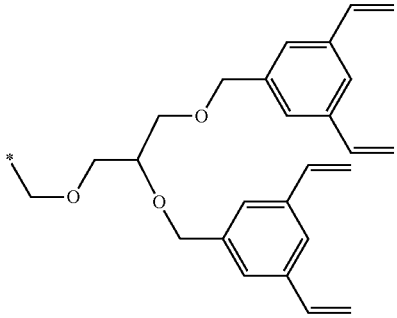
-continued
D2-54
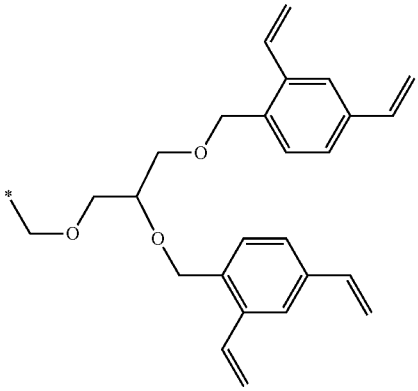
D2-55
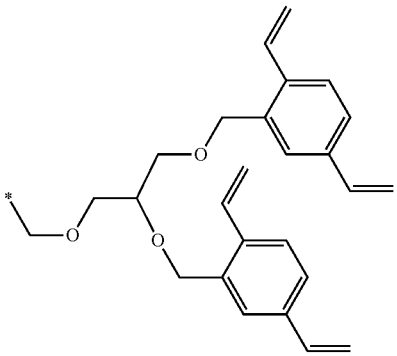
D2-56
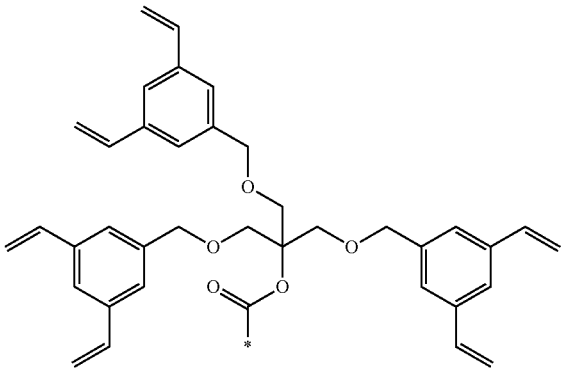
D2-57
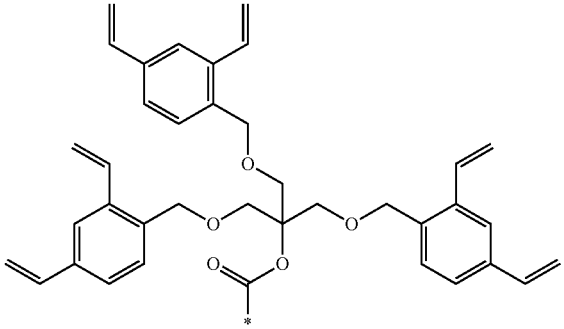

-continued
D2-58
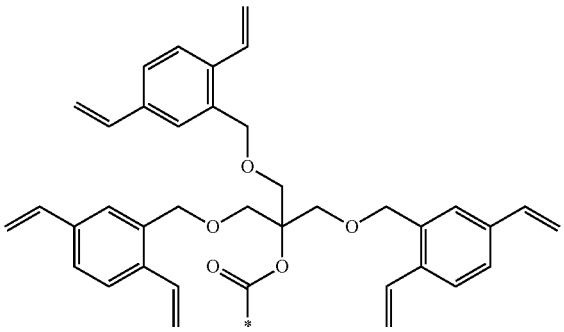
D2-59
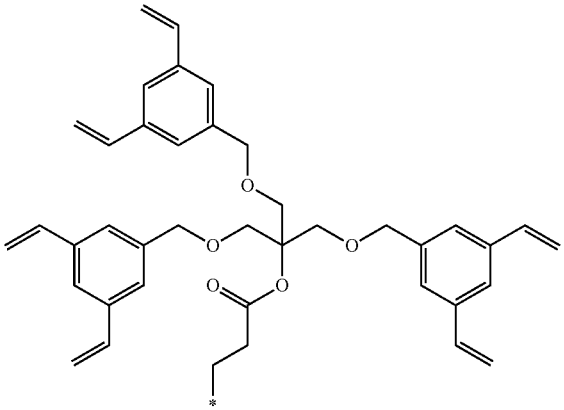
D2-60
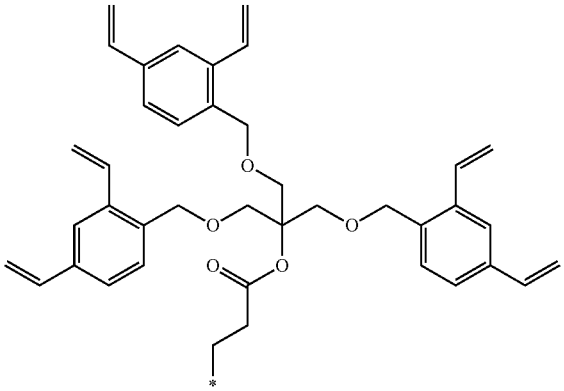
D2-61
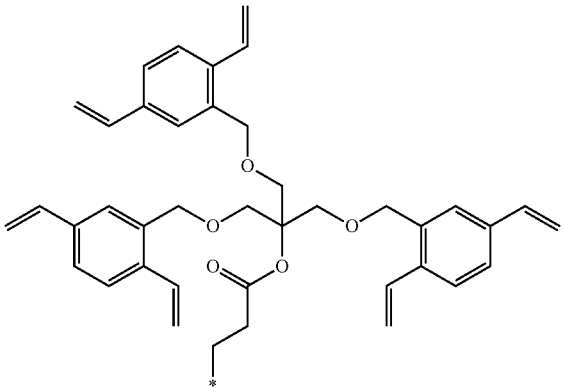
-continued
D2-62
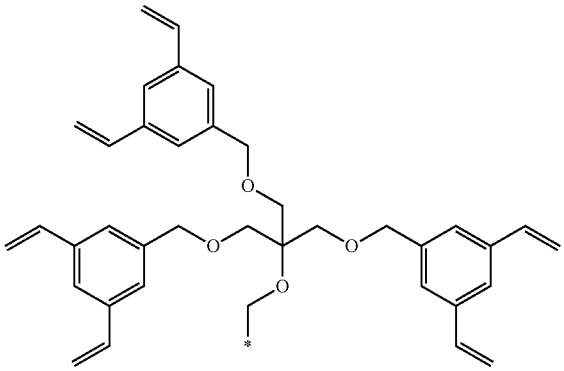
D2-63
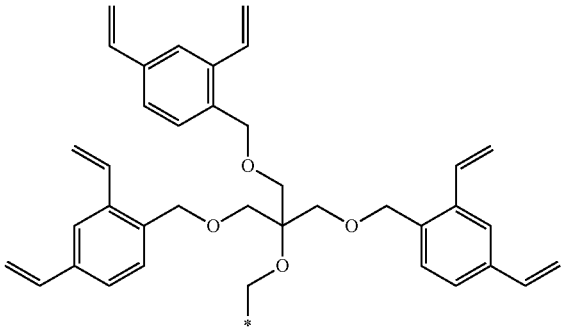
D2-64
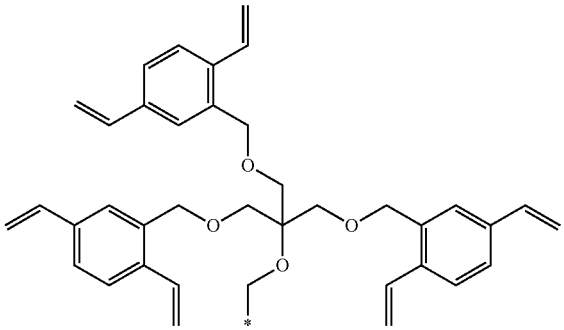
D2-65
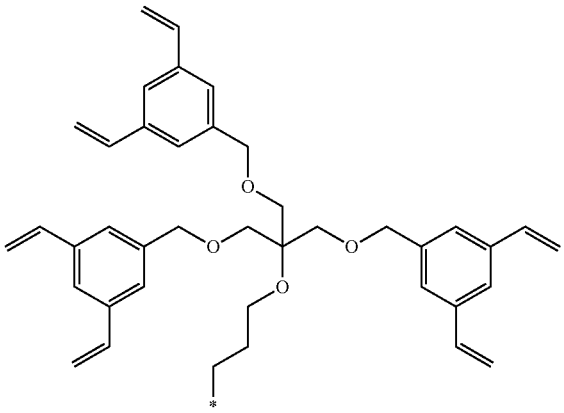

-continued

D2-66

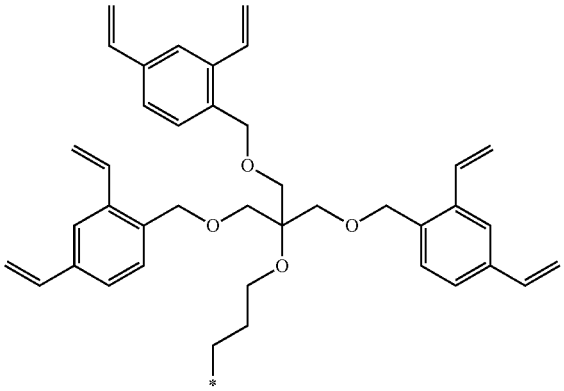

D2-67

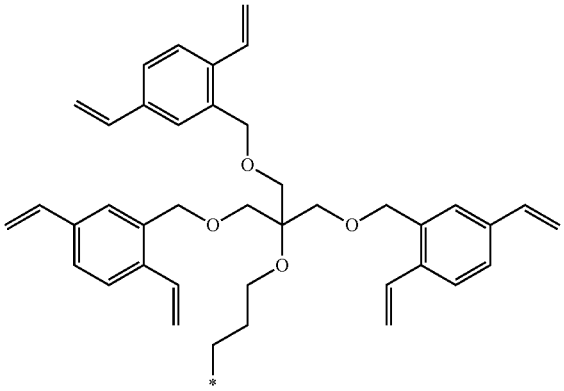

D2-68

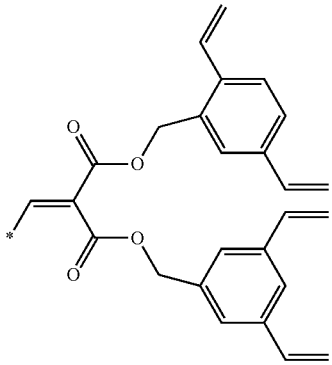

D2-69

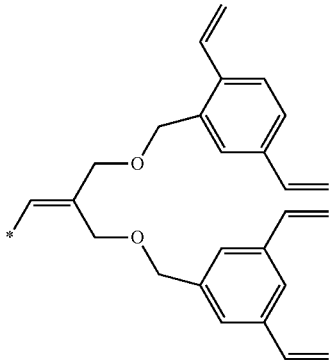

Next, specific examples of the specific reactive group-containing charge transporting material (reactive compound represented by Formula (I)) will be shown, but this exemplary embodiment is not limited thereto.

In the following list, "CTM skeleton structure" corresponds to the charge transporting skeleton F in Formula (I).

| Exemplary Compound | CTM Skeleton Structure | Structure of D |
|---|---|---|
| (Ia)-1 | (1)-1 | D1-1 |
| (Ia)-2 | (1)-1 | D1-62 |
| (Ia)-3 | (1)-1 | D1-4 |
| (Ia)-4 | (1)-2 | D1-5 |
| (Ia)-5 | (1)-2 | D1-7 |
| (Ia)-6 | (1)-4 | D1-7 |
| (Ia)-7 | (1)-4 | D1-62 |
| (Ia)-8 | (1)-7 | D1-7 |
| (Ia)-9 | (1)-11 | D1-62 |
| (Ia)-10 | (1)-15 | D1-62 |
| (Ia)-11 | (1)-25 | D1-8 |
| (Ia)-12 | (1)-22 | D1-56 |
| (Ia)-13 | (2)-2 | D1-9 |
| (Ia)-14 | (2)-2 | D1-62 |
| (Ia)-15 | (2)-2 | D1-7 |
| (Ia)-16 | (2)-3 | D1-7 |
| (Ia)-17 | (2)-3 | D1-62 |
| (Ia)-18 | (2)-5 | D1-4 |
| (Ia)-19 | (2)-10 | D1-7 |
| (Ia)-20 | (2)-10 | D1-66 |
| (Ia)-21 | (2)-13 | D1-7 |
| (Ia)-22 | (2)-13 | D1-62 |
| (Ia)-23 | (2)-13 | D1-11 |
| (Ia)-24 | (2)-16 | D1-62 |
| (Ia)-25 | (2)-23 | D1-7 |
| (Ia)-26 | (2)-23 | D1-62 |
| (Ia)-27 | (2)-25 | D1-66 |
| (Ia)-28 | (2)-25 | D1-62 |
| (Ia)-29 | (2)-26 | D1-56 |
| (Ia)-30 | (2)-26 | D1-7 |
| (Ia)-31 | (3)-1 | D1-7 |
| (Ia)-32 | (3)-1 | D1-62 |
| (Ia)-33 | (3)-5 | D1-62 |
| (Ia)-34 | (3)-7 | D1-9 |
| (Ia)-35 | (3)-7 | D1-62 |
| (Ia)-36 | (3)-19 | D1-62 |
| (Ia)-37 | (3)-26 | D1-7 |
| (Ia)-38 | (3)-26 | D1-62 |
| (Ia)-39 | (4)-3 | D1-7 |
| (Ia)-40 | (4)-3 | D1-62 |
| (Ia)-41 | (4)-8 | D1-4 |
| (Ia)-42 | (4)-8 | D1-66 |
| (Ia)-43 | (4)-12 | D1-7 |
| (Ia)-44 | (4)-12 | D1-75 |
| (Ia)-45 | (4)-12 | D1-4 |
| (Ia)-46 | (4)-12 | D1-1 |
| (Ia)-47 | (4)-12 | D1-86 |
| (Ia)-48 | (4)-12 | D1-62 |
| (Ia)-49 | (4)-20 | D1-7 |
| (Ia)-50 | (4)-20 | D1-59 |
| (Ia)-51 | (4)-20 | D1-62 |
| (Ia)-52 | (4)-24 | D1-8 |
| (Ia)-53 | (4)-24 | D1-7 |
| (Ia)-54 | (4)-24 | D1-62 |
| (Ia)-55 | (4)-24 | D1-88 |
| (Ia)-56 | (4)-24 | D1-63 |
| (Ia)-57 | (4)-26 | D1-62 |
| (Ia)-58 | (4)-28 | D1-7 |
| (Ia)-59 | (4)-28 | D1-7 |
| (Ia)-60 | (4)-28 | D1-62 |
| (Ia)-61 | (1)-1 | D1-18 |
| (Ia)-62 | (1)-1 | D1-40 |
| (Ia)-63 | (1)-1 | D1-45 |
| (Ia)-64 | (1)-2 | D1-29 |
| (Ia)-65 | (1)-2 | D1-51 |
| (Ia)-66 | (1)-4 | D1-18 |
| (Ia)-67 | (1)-4 | D1-45 |
| (Ia)-68 | (1)-7 | D1-51 |
| (Ia)-69 | (1)-11 | D1-72 |
| (Ia)-70 | (1)-15 | D1-40 |
| (Ia)-71 | (1)-25 | D1-45 |
| (Ia)-72 | (1)-22 | D1-51 |
| (Ia)-73 | (2)-2 | D1-18 |

-continued

| Exemplary Compound | CTM Skeleton Structure | Structure of D |
|---|---|---|
| (Ia)-74 | (2)-2 | D1-45 |
| (Ia)-75 | (2)-2 | D1-51 |
| (Ia)-76 | (2)-3 | D1-29 |
| (Ia)-77 | (2)-3 | D1-40 |
| (Ia)-78 | (2)-5 | D1-45 |
| (Ia)-79 | (2)-10 | D1-83 |
| (Ia)-80 | (2)-10 | D1-45 |
| (Ia)-81 | (2)-13 | D1-18 |
| (Ia)-82 | (2)-13 | D1-40 |
| (Ia)-83 | (2)-13 | D1-45 |
| (Ia)-84 | (2)-16 | D1-83 |
| (Ia)-85 | (2)-23 | D1-51 |
| (Ia)-86 | (2)-23 | D1-18 |
| (Ia)-87 | (2)-25 | D1-83 |
| (Ia)-88 | (2)-25 | D1-29 |
| (Ia)-89 | (2)-26 | D1-45 |
| (Ia)-90 | (2)-26 | D1-18 |
| (Ia)-91 | (3)-1 | D1-18 |
| (Ia)-92 | (3)-1 | D1-72 |
| (Ia)-93 | (3)-5 | D1-45 |
| (Ia)-94 | (3)-7 | D1-40 |
| (Ia)-95 | (3)-7 | D1-72 |
| (Ia)-96 | (3)-19 | D1-18 |
| (Ia)-97 | (3)-26 | D1-18 |
| (Ia)-98 | (3)-26 | D1-40 |
| (Ia)-99 | (4)-3 | D1-40 |
| (Ia)-100 | (4)-3 | D1-18 |
| (Ia)-101 | (4)-8 | D1-45 |
| (Ia)-102 | (4)-8 | D1-40 |
| (Ia)-103 | (4)-12 | D1-18 |
| (Ia)-104 | (4)-12 | D1-29 |
| (Ia)-105 | (4)-12 | D1-40 |
| (Ia)-106 | (4)-12 | D1-51 |
| (Ia)-107 | (4)-12 | D1-18 |
| (Ia)-108 | (4)-12 | D1-40 |
| (Ia)-109 | (4)-20 | D1-29 |
| (Ia)-110 | (4)-20 | D1-51 |
| (Ia)-111 | (4)-20 | D1-72 |
| (Ia)-112 | (4)-24 | D1-18 |
| (Ia)-113 | (4)-24 | D1-40 |
| (Ia)-114 | (4)-24 | D1-45 |
| (Ia)-115 | (4)-24 | D1-72 |
| (Ia)-116 | (4)-24 | D1-51 |
| (Ia)-117 | (4)-26 | D1-45 |
| (Ia)-118 | (4)-28 | D1-45 |
| (Ia)-119 | (4)-28 | D1-51 |
| (Ia)-120 | (4)-28 | D1-18 |
| (Ib)-1 | (1)-1 | D2-1 |
| (Ib)-2 | (1)-1 | D2-11 |
| (Ib)-3 | (1)-1 | D2-2 |
| (Ib)-4 | (1)-2 | D2-1 |
| (Ib)-5 | (1)-2 | D2-11 |
| (Ib)-6 | (1)-4 | D2-11 |
| (Ib)-7 | (1)-4 | D2-1 |
| (Ib)-8 | (1)-7 | D2-11 |
| (Ib)-9 | (1)-11 | D2-2 |
| (Ib)-10 | (1)-15 | D2-11 |
| (Ib)-11 | (1)-25 | D2-4 |
| (Ib)-12 | (1)-22 | D2-11 |
| (Ib)-13 | (2)-2 | D2-1 |
| (Ib)-14 | (2)-2 | D2-11 |
| (Ib)-15 | (2)-2 | D2-4 |
| (Ib)-16 | (2)-3 | D2-1 |
| (Ib)-17 | (2)-3 | D2-11 |
| (Ib)-18 | (2)-5 | D2-14 |
| (Ib)-19 | (2)-10 | D2-1 |
| (Ib)-20 | (2)-10 | D2-11 |
| (Ib)-21 | (2)-13 | D2-1 |
| (Ib)-22 | (2)-13 | D2-2 |
| (Ib)-23 | (2)-13 | D2-11 |
| (Ib)-24 | (2)-16 | D2-11 |
| (Ib)-25 | (2)-23 | D2-1 |
| (Ib)-26 | (2)-23 | D2-11 |
| (Ib)-27 | (2)-25 | D2-2 |
| (Ib)-28 | (2)-25 | D2-11 |
| (Ib)-29 | (2)-26 | D2-1 |
| (Ib)-30 | (2)-29 | D2-11 |

-continued

| Exemplary Compound | CTM Skeleton Structure | Structure of D |
|---|---|---|
| (Ib)-31 | (3)-1 | D2-1 |
| (Ib)-32 | (3)-1 | D2-11 |
| (Ib)-33 | (3)-5 | D2-11 |
| (Ib)-34 | (3)-7 | D2-1 |
| (Ib)-35 | (3)-7 | D2-14 |
| (Ib)-36 | (3)-19 | D2-11 |
| (Ib)-37 | (3)-26 | D2-1 |
| (Ib)-38 | (3)-26 | D2-11 |
| (Ib)-39 | (4)-3 | D2-1 |
| (Ib)-40 | (4)-3 | D2-23 |
| (Ib)-41 | (4)-8 | D2-1 |
| (Ib)-42 | (4)-8 | D2-14 |
| (Ib)-43 | (4)-12 | D2-1 |
| (Ib)-44 | (4)-12 | D2-11 |
| (Ib)-45 | (4)-12 | D2-2 |
| (Ib)-46 | (4)-12 | D2-4 |
| (Ib)-47 | (4)-12 | D2-23 |
| (Ib)-48 | (4)-12 | D2-6 |
| (Ib)-49 | (4)-20 | D2-1 |
| (Ib)-50 | (4)-20 | D2-11 |
| (Ib)-51 | (4)-20 | D2-23 |
| (Ib)-52 | (4)-24 | D2-1 |
| (Ib)-53 | (4)-24 | D2-11 |
| (Ib)-54 | (4)-24 | D2-2 |
| (Ib)-55 | (4)-24 | D2-4 |
| (Ib)-56 | (4)-24 | D2-23 |
| (Ib)-57 | (4)-26 | D2-11 |
| (Ib)-58 | (4)-28 | D2-1 |
| (Ib)-59 | (4)-28 | D2-11 |
| (Ib)-60 | (4)-28 | D2-4 |
| (Ib)-61 | (1)-1 | D2-27 |
| (Ib)-62 | (1)-1 | D2-33 |
| (Ib)-63 | (1)-2 | D2-39 |
| (Ib)-64 | (1)-2 | D2-45 |
| (Ib)-65 | (1)-4 | D2-27 |
| (Ib)-66 | (1)-4 | D2-33 |
| (Ib)-67 | (1)-7 | D2-27 |
| (Ib)-68 | (1)-11 | D2-45 |
| (Ib)-69 | (1)-15 | D2-45 |
| (Ib)-70 | (1)-25 | D2-62 |
| (Ib)-71 | (1)-22 | D2-45 |
| (Ib)-72 | (2)-2 | D2-27 |
| (Ib)-73 | (2)-2 | D2-39 |
| (Ib)-74 | (2)-3 | D2-33 |
| (Ib)-75 | (2)-3 | D2-39 |
| (Ib)-76 | (2)-5 | D2-45 |
| (Ib)-77 | (2)-10 | D2-27 |
| (Ib)-78 | (2)-10 | D2-39 |
| (Ib)-79 | (2)-13 | D2-45 |
| (Ib)-80 | (2)-13 | D2-27 |
| (Ib)-81 | (2)-16 | D2-62 |
| (Ib)-82 | (2)-23 | D2-27 |
| (Ib)-83 | (2)-23 | D2-39 |
| (Ib)-84 | (2)-25 | D2-45 |
| (Ib)-85 | (2)-25 | D2-62 |
| (Ib)-86 | (2)-26 | D2-27 |
| (Ib)-87 | (2)-29 | D2-62 |
| (Ib)-88 | (3)-1 | D2-39 |
| (Ib)-89 | (3)-1 | D2-45 |
| (Ib)-90 | (3)-5 | D2-45 |
| (Ib)-91 | (3)-7 | D2-27 |
| (Ib)-92 | (3)-7 | D2-45 |
| (Ib)-93 | (3)-19 | D2-45 |
| (Ib)-94 | (3)-26 | D2-39 |
| (Ib)-95 | (3)-26 | D2-62 |
| (Ib)-96 | (4)-3 | D2-27 |
| (Ib)-97 | (4)-3 | D2-45 |
| (Ib)-98 | (4)-8 | D2-27 |
| (Ib)-99 | (4)-8 | D2-62 |
| (Ib)-100 | (4)-12 | D2-27 |
| (Ib)-101 | (4)-12 | D2-39 |
| (Ib)-102 | (4)-12 | D2-45 |
| (Ib)-103 | (4)-20 | D2-45 |
| (Ib)-104 | (4)-20 | D2-27 |
| (Ib)-105 | (4)-24 | D2-27 |
| (Ib)-106 | (4)-24 | D2-39 |
| (Ib)-107 | (4)-26 | D2-62 |

-continued

| Exemplary Compound | CTM Skeleton Structure | Structure of D |
|---|---|---|
| (Ib)-108 | (4)-28 | D2-39 |
| (Ib)-109 | (4)-28 | D2-45 |
| (Ib)-110 | (1)-2 | D2-20 |
| (Ib)-111 | (1)-2 | D2-23 |
| (Ib)-112 | (2)-25 | D2-20 |
| (Ib)-113 | (2)-25 | D2-23 |
| (Ib)-114 | (3)-1 | D2-20 |
| (Ib)-115 | (3)-1 | D2-23 |
| (Ib)-116 | (4)-12 | D2-20 |

The synthesis of the specific reactive group-containing charge transporting material (reactive compound represented by Formula (I)) is performed using a general synthesis reaction. For example, the synthesis is performed by a nucleophilic substitution reaction of triarylamine having active hydrogen such as a carboxylic acid, alcohol, primary or secondary amine, and thiol and divinyl benzene having an elimination group such as halogen and p-toluenesulfonate, or a nucleophilic substitution reaction of triarylamine having an elimination group such as halogen and p-toluenesulfonate and divinyl benzene having active hydrogen such as a carboxylic acid, alcohol, primary or secondary amine, and thiol. In addition, the synthesis may be performed by an addition reaction of triarylamine having a nucleophilic addition property such as a carboxylic acid, carboxylic acid ester, and carboxylic halide and divinyl benzene having active hydrogen such as alcohol, primary or secondary amine, and thiol, accompanied by elimination of water, alcohol, or acid, or an addition reaction of triarylamine having active hydrogen such as alcohol, primary or secondary amine, and thiol and divinyl benzene having a nucleophilic addition property such as a carboxylic acid, carboxylic acid ester, and carboxylic halide, accompanied by elimination of water, alcohol, or acid.

Examples of the method of synthesizing triarylamine having a reactive group include a synthesis method in which in a state in which the reactive group is protected as necessary, corresponding primary or secondary aromatic amine and halogenated aromatic are used and coupled with each other using a metal catalyst such as copper or palladium, and then deprotection is performed as necessary for returning to the reactive group, thereby obtaining the reactive group.

For synthesizing divinyl benzene having a reactive group, a vinyl group is introduced from a benzene derivative in which the reactive group is protected as necessary, and then the deprotection is performed as necessary for returning to the reactive group, thereby obtaining the reactive group. Examples of the method of introducing the vinyl group include an introducing method which includes performing formylation such as the Vilsmeier reaction of the above-described benzene derivative and performing the Wittig reaction, an introducing method which includes coupling a benzene derivative directly bonded to an elimination group such as halogen with vinyl metal species or vinyl halide using a transition metal catalyst, and a method which includes allowing a base to act on a benzene derivative having an ethyl group having an elimination group such as halogen and p-toluenesulfonate to convert the benzene derivative into a vinyl group by an elimination reaction.

The specific reactive group-containing charge transporting materials (reactive compounds represented by Formula (I)) may be used in combination of two or more kinds thereof. For example, when a reactive compound in which the total number of divinyl benzene skeletons in one molecule is 4 or more and a reactive compound in which the total number of divinyl benzene skeletons in one molecule is from 1 to 3 are used in combination among the specific reactive group-containing charge transporting materials, a reduction in the charge transporting property is suppressed and the strength of the cured film is easily adjusted. In that case, the compound in which the total number of divinyl benzene skeletons in one molecule is 4 or more among the specific reactive group-containing charge transporting material is preferably 5% by weight or greater, and more preferably 20% by weight or greater with respect to the total content of the charge transporting material.

The content of the specific reactive group-containing charge transporting material may be, for example, from 40% by weight to 95% by weight, is preferably from 50% by weight to 95% by weight, and more preferably from 60% by weight to 95% by weight with respect to the total solid content in the composition for layer formation.

Compound Having Unsaturated Bond

In the film constituting the protective layer (outermost layer), a compound having an unsaturated bond may be used in combination.

The compound having an unsaturated bond may be any of a monomer, an oligomer, and a polymer, and may have a charge transporting skeleton.

Examples of the compound having an unsaturated bond without a charge transporting skeleton are as follows.

Examples of the monofunctional monomer include isobutyl acrylate, t-butylacrylate, isooctyl acrylate, lauryl acrylate, stearyl acrylate, isobornyl acrylate, cyclohexyl acrylate, 2-methoxyethyl acrylate, methoxytriethylene glycol acrylate, 2-ethoxyethyl acrylate, tetrahydrofurfuryl acrylate, benzyl acrylate, ethylcarbitol acrylate, phenoxyethyl acrylate, 2-hydroxyacrylate, 2-hydroxypropyl acrylate, 4-hydroxybutyl acrylate, methoxy polyethylene glycol acrylate, methoxy polyethylene glycol methacrylate, phenoxy polyethylene glycol acrylate, phenoxy polyethylene glycol methacrylate, hydroxyethyl o-phenyl phenol acrylate, o-phenyl phenol glycidyl ether acrylate, and styrene.

Examples of the bifunctional monomer include diethylene glycol di(meth)acrylate, polyethylene glycol di(meth)acrylate, polypropylene glycol di(meth)acrylate, neopentyl glycol di(meth)acrylate, 1,6-hexanediol di(meth)acrylate, divinyl benzene, and diallyl phthalate.

Examples of the trifunctional monomer include trimethylolpropane tri(meth)acrylate, pentaerythritol tri(meth)acrylate, aliphatic tri(meth)acrylate, and trivinyl cyclohexane.

Examples of the tetrafunctional monomer include pentaerythritol tetra(meth)acrylate, ditrimethylolpropane tetra (meth)acrylate, and aliphatic tetra(meth)acrylate.

Examples of the penta- or higher functional monomer include dipentaerythritol penta(meth)acrylate, dipentaerythritol hexa(meth)acrylate, and (meth)acrylates having a polyester skeleton, a urethane skeleton, or a phosphazene skeleton.

In addition, examples of the reactive polymer include those disclosed in JP-A-5-216249, JP-A-5-323630, JP-A-11-52603, JP-A-2000-264961, and JP-A-2005-2291.

When the compounds having an unsaturated bond without a charge transporting component are used, these are used singly, or as a mixture of two or more kinds thereof.

The content of the compound having an unsaturated bond without a charge transporting component is, for example, preferably 60% by weight or less, more preferably 55% by weight or less, and even more preferably 50% by weight or less with respect to the total solid content in the composition which is used when forming the protective layer (outermost layer).

Examples of the compound having an unsaturated bond and a charge transporting skeleton are as follows.

Compound Having Chain Polymerizable Functional Group (Chain Polymerizable Functional Group Excluding Styryl Group) and Charge Transporting Skeleton in Same Molecule In the compound having a chain polymerizable functional group and a charge transporting skeleton in the same molecule, the chain polymerizable functional group is not particularly limited if it is a radical polymerizable functional group, and is, for example, a functional group having a group containing at least a carbon double bond. Specific examples thereof include a vinyl group, a vinyl ether group, a vinyl thioether group, a styryl group, an acryloyl group, a methacryloyl group, and a group containing at least one selected from among derivatives thereof. Among them, a vinyl group, a styryl group, an acryloyl group, a methacryloyl group, and a group containing at least one selected from among derivatives thereof are preferable as the chain polymerizable functional group.

In addition, in the compound having a chain polymerizable functional group and a charge transporting skeleton in the same molecule, the charge transporting skeleton is not particularly limited if it is a known structure in the electrophotographic photoreceptor, and is, for example, a skeleton derived from a nitrogen-containing hole transporting compound such as triarylamine compounds, benzidine compounds, and hydrazone compounds, and a structure coupled to a nitrogen atom. Among them, a triarylamine skeleton is preferable.

Specific examples of the compound having a chain polymerizable functional group and a charge transporting skeleton in the same molecule include the compound described in the paragraphs from [0060] to [0099] in JP-A-2000-206715 and the compound described in the paragraphs from [0066] to [0080] in JP-A-2011-70023.

The content of the charge transporting material other than the compound having an unsaturated bond and a charge transporting skeleton is, for example, preferably from 40% by weight or less, more preferably 30% by weight or less, and even more preferably 20% by weight or less with respect to the total solid content in the composition which is used when forming the protective layer (outermost layer).

Non-Reactive Charge Transporting Material

In the film constituting the protective layer (outermost layer), a non-reactive charge transporting material may be used in combination. The non-reactive charge transporting material has no reactive group, which does not assume the transport of charge. Accordingly, when the non-reactive charge transporting material is used in the protective layer (outermost layer), the concentration of the charge transporting component increases, whereby using the non-reactive charge transporting material is effective in further improvement of the electric characteristics. In addition, the non-reactive charge transporting material may be added to reduce a cross-link density to thereby adjust the strength.

Known charge transporting materials may be used as the non-reactive charge transporting material, and specific examples thereof include triarylamine compounds, benzidine compounds, arylalkane compounds, aryl-substituted ethylene compounds, stilbene compounds, anthracene compounds, and hydrazone compounds.

Among them, non-reactive charge transporting materials having a triphenylamine skeleton are preferable from the viewpoint of charge mobility, compatibility, and the like.

The non-reactive charge transporting material is preferably used in an amount of from 0% by weight to 30% by weight, more preferably from 1% by weight to 25% by weight, and even more preferably from 5% by weight to 25% by weight with respect to the total solid content in the coating liquid for layer formation.

Other Additives

In the film constituting the protective layer (outermost layer), other coupling agents, particularly, a fluorine-containing coupling agent may also be mixed and used in order to adjust film formability, flexibility, lubricity, and adhesiveness. As these compounds, various silane coupling agents and commercially available silicone hard coating agents are used. In addition, a radical polymerizable group-containing silicone compound or a fluorine-containing compound may also be used.

Examples of the silane coupling agent include vinyltrichlorosilane, vinyltrimethoxysilane, vinyltriethoxysilane, 3-glycidoxypropylmethyldiethoxysilane, 3-glycidoxypropyltriethoxysilane, 3-glycidoxypropyltrimethoxysilane, 3-aminopropyltriethoxysilane, 3-aminopropyltrimethoxysilane, 3-aminopropylmethyldimethoxysilane, N-2(aminoethyl) 3-aminopropyltriethoxysilane, tetramethoxysilane, methyltrimethoxysilane, and dimethyldimethoxysilane.

Examples of the commercially available hard coating agent include KP-85, X-40-9740, and X-8239 (all manufactured by Shin-Etsu Chemical Co., Ltd.), and AY42-440, AY42-441, and AY49-208 (all manufactured by Dow Corning Toray Co., Ltd.).

In addition, in order to provide water-repellency or the like, a fluorine-containing compound may be added, examples of which include (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane, and 1H, 1H,2H,2H-perfluorooctyltriethoxysilane.

The silane coupling agent is used in an arbitrary amount, but the amount of the fluorine-containing compound is preferably 0.25 times or less that of the compounds containing no fluorine in terms of weight from the viewpoint of film formability of the cross-linked film. Furthermore, the reactive fluorine compound disclosed in JP-A-2001-166510 and the like may be mixed therewith.

Examples of the radical polymerizable group-containing silicon compound and the fluorine-containing compound include the compound described in JP-A-2007-11005.

A deterioration inhibitor is preferably added to the film constituting the protective layer (outermost surface layer). As the deterioration inhibitor, hindered phenols and hindered amines are preferable, and known antioxidants such as organic sulfur antioxidants, phosphite antioxidants, dithiocarbamate antioxidants, thiourea antioxidants, and benzimidazole antioxidants may be used.

The amount of the deterioration inhibitor to be added is preferably 20% by weight or less, and more preferably 10% by weight or less.

Examples of the hindered phenol antioxidants include IRGANOX 1076, IRGANOX 1010, IRGANOX 1098, IRGANOX 245, IRGANOX 1330, IRGANOX 3114, and IRGANOX 1076 (all manufactured by Ciba Specialty Chemicals Inc.), and 3,5-di-tert-butyl-4-hydroxybiphenyl.

Examples of the hindered amine antioxidants include SANOL LS-2626, SANOL LS-765, SANOL LS-770, and SANOL LS-744 (all manufactured by Ciba Specialty Chemicals Inc.), TINUVIN 144 and TINUVIN 622LD (all manufactured by Ciba Specialty Chemicals Inc.), and MARK LA-57, MARK LA-67, MARK LA-62, MARK LA-68, and MARK LA-63 (all manufactured by Adeka Corporation).

Examples of the thioether antioxidants include SUMILIZER TPS and SUMILIZER TP-D (all manufactured by Sumitomo Chemical Co., Ltd.). Examples of the phosphite antioxidants include MARK 2112, MARK PEP-8, MARK PEP-24G, MARK PEP-36, MARK 329K, and MARK HP-10 (all manufactured by Adeka Corporation).

The film constituting the protective layer (outermost surface layer) may include conductive particles, or organic or inorganic particles added thereto.

Examples of the particles include silicon-containing particles. The silicon-containing particles are particles that include silicon as a constituent element, and specific examples thereof include colloidal silica and silicone particles. The colloidal silica which is used as the silicon-containing particles is selected from silica having an average particle size of preferably from 1 nm to 100 nm, and more preferably from 10 nm to 30 nm, and being dispersed in an acidic or alkaline aqueous dispersion liquid or in an organic solvent such as an alcohol, ketone, or ester. The particles may be a commercially available product.

The solid content of the colloidal silica in the protective layer is not particularly limited, but is in the range of preferably from 0.1% by weight to 50% by weight, and more preferably from 0.1% by weight to 30% by weight with respect to the total solid content in the protective layer.

The silicone particles which are used as the silicon-containing particles are selected from silicone resin particles, silicone rubber particles, and silica particles having a surface treated with silicone, and commercially available silicone particles may be used.

These silicone particles are spherical, and its average particle size is preferably from 1 nm to 500 nm, and more preferably from 10 nm to 100 nm.

The content of the silicone particles in the surface layer is preferably from 0.1% by weight to 30% by weight, and more preferably from 0.5% by weight to 10% by weight with respect to the total solid content in the protective layer.

Other examples of the particles include fluorine particles such as ethylene tetrafluoride, ethylene trifluoride, propylene hexafluoride, vinyl fluoride, and vinylidene fluoride, particles of a resin obtained by copolymerizing a fluorine resin and a monomer having a hydroxyl group, and particles of semiconductive metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO, and MgO. Furthermore, various known dispersants may be used in order to disperse the particles.

The film constituting the protective layer (outermost layer) may include oils such as a silicone oil added thereto.

Examples of the silicone oil include silicone oils such as dimethylpolysiloxane, diphenylpolysiloxane, and phenylmethylsiloxane; reactive silicone oils such as amino-modified polysiloxane, epoxy-modified polysiloxane, carboxy-modified polysiloxane, carbinol-modified polysiloxane, methacryl-modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as 3-(3,3,3-trifluoropropyl)methylcyclotrisiloxane; hydrosilyl group-containing cyclosiloxanes such as a methylhydrosiloxane mixture, pentamethylcyclopentasiloxane, and phenylhydrocyclosiloxane; and vinyl group-containing cyclosiloxanes such as pentavinylpentamethylcyclopentasiloxane.

The film constituting the protective layer (outermost layer) may include a silicone-containing oligomer, a fluorine-containing acrylic polymer, a silicone-containing polymer, and the like added thereto in order to improve wettability of the coating film.

The film constituting the protective layer (outermost layer) may include a metal, a metal oxide, carbon black, and the like added thereto. Examples of the metal include aluminum, zinc, copper, chromium, nickel, silver, stainless steel, and resin particles having a surface with the metals deposited thereon. Examples of the metal oxide include zinc oxide, titanium oxide, tin oxide, antimony oxide, indium oxide, bismuth oxide, tin-doped indium oxide, antimony- or tantalum-doped tin oxide, and antimony-doped zirconium oxide.

These may be used singly, or in combination of two or more kinds thereof. When two or more kinds thereof are used in combination, these may be simply mixed or made into a solid solution or a fused product. The average particle size of the conductive particles is preferably 0.3 μm or less, and particularly preferably 0.1 μm or less.

Composition

The composition which is used to form the protective layer is preferably prepared as a protective layer-forming coating liquid which is obtained by dissolving or dispersing components in a solvent.

The protective layer-forming coating liquid may be free of a solvent, or if necessary, may be prepared using a single solvent such as aromatic hydrocarbons, e.g., toluene, xylene, and chlorobenzene; alcohols, e.g., methanol, ethanol, propanol, butanol, cyclopentanol, and cyclohexanol; ketones, e.g., aceton, methyl ethyl ketone, and methyl isobutyl ketone; ethers, e.g., tetrahydrofuran, diethyl ether, diisopropyl ether, and dioxane; and esters, e.g., ethyl acetate, n-propyl acetate, n-butyl acetate, and ethyl lactate, or a mixed solvent thereof.

In addition, when the protective layer-forming coating liquid is obtained by reacting the above-described components, the components may be merely mixed and dissolved, but preferably heated at a temperature of preferably from room temperature (20° C.) to 100° C., and more preferably from 30° C. to 80° C. for preferably from 10 minutes to 100 hours, and more preferably from 1 hour to 50 hours. At this time, ultrasonic irradiation is preferably performed.

Formation of Protective Layer

The protective layer-forming coating liquid is applied to a surface to be coated (charge transporting layer) through a general method such as a blade coating method, a wire bar coating method, a spray coating method, a dipping coating method, a bead coating method, an air knife coating method, a curtain coating method, or an inkjet coating method.

Thereafter, radical polymerization is carried out by applying light, electron beams, or heat to the obtained coating film to cure the coating film.

Heat, light, radiation, and the like are used in the curing method. When the coating film is cured by heat and light, a polymerization initiator is not necessarily needed, but a photocuring catalyst or a thermal polymerization initiator may be used. As the photocuring catalyst and the thermal polymerization initiator, known photocuring catalysts and thermal polymerization initiators are used. Electron beams are preferable as the radiation.

Electron Beam Curing

When using electron beams, the acceleration voltage is preferably 300 KV or less, and optimally 150 KV or less. In addition, the radiation dose is in the range of preferably from 1 Mrad to 100 Mrad, and more preferably from 3 Mrad to 50 Mrad. When the acceleration voltage is set to 300 KV or less, the damage of the electron beam irradiation on the photoreceptor characteristics is suppressed. When the radiation dose is set to 1 Mrad or greater, the cross-linking is sufficiently carried out, whereas when the radiation dose is set to 100 Mrad or less, the deterioration of the photoreceptor is suppressed.

The irradiation is performed under an inert gas atmosphere of nitrogen, argon, or the like at an oxygen concentration of 1000 ppm or less, and preferably 500 ppm or less, and heating may be performed at from 50° C. to 150° C. during or after irradiation.

Photocuring

As a light source, a high-pressure mercury lamp, a low-pressure mercury lamp, a metal halide lamp, or the like is used, and a filter such as a band pass filter may be used to select a preferable wavelength. The irradiation time and the light intensity are freely selected, but, for example, the illumination (365 nm) is preferably from 300 mW/cm$^2$ to 1000 mW/cm$^2$, and for example, in the case of irradiation with UV light at 600 mW/cm$^2$, irradiation may be performed for from 5 seconds to 360 seconds.

The irradiation is performed under an inert gas atmosphere of nitrogen, argon, or the like at an oxygen concentration of preferably 1000 ppm or less, and more preferably 500 ppm or less, and heating may be performed at from 50° C. to 150° C. during or after irradiation.

Examples of the photocuring catalyst of intramolecular cleavage type include benzyl ketal photocuring catalysts, alkylphenone photocuring catalysts, aminoalkylphenone photocuring catalysts, phosphine oxide photocuring catalysts, titanocene photocuring catalysts, and oxime photocuring catalysts.

Specifically, examples of the benzyl ketal photocuring catalysts include 2,2-dimethoxy-1,2-diphenylethan-1-one.

Examples of the alkylphenone photocuring catalysts include 1-hydroxy-cyclohexyl-phenyl-ketone, 2-hydroxy-2-methyl-1-phenyl-propan-1-one, 1-[4-(2-hydroxyethoxy)-phenyl]-2-hydroxy-2-methyl-1-propan-1-one, 2-hydroxy-1-{4-[4-(2-hydroxy-2-methyl-propionyl)-benzyl]phenyl}-2-methyl-propan-1-one, acetophenone, and 2-phenyl-2-(p-toluenesulfonyloxy)acetophenone.

Examples of the aminoalkylphenone photocuring catalysts include p-dimethylaminoacetophenone, p-dimethylamino-propiophenone, 2-methyl-1-(4-methylthiophenyl)-2-morpholinopropan-1-one, and 2-benzyl-2-dimethylamino-1-(4-morpholinophenyl)-butanone-1,2-(dimethylamino)-2-[(4-methylphenyl)methyl]-1-[4-(4-morpholinyl)phenyl]-1-butanone.

Examples of the phosphine oxide photocuring catalysts include 2,4,6-trimethylbenzoyl-diphenyl-phosphine oxide and bis(2,4,6-trimethylbenzoyl)-phenyl phosphine oxide.

Examples of the titanocene photocuring catalysts include bis(η5-2,4-cyclopentadien-1-yl)-bis(2,6-difluoro-3-(1H-pyrrol-1-yl)-phenyl)titanium.

Examples of the oxime photocuring catalysts include 1,2-octanedione,1-[4-(phenylthio)-,2-(O-benzoyloxime)] and ethanone, 1-[9-ethyl-6-(2-methylbenzoyl)-9H-carbazol-3-yl]-,1-(O-acetyloxime).

Examples of the hydrogen abstraction photocuring catalyst include benzophenone photocuring catalysts, thioxanthone photocuring catalysts, benzyl photocuring catalysts, and Michler's ketone photocuring catalysts.

Specifically, examples of the benzophenone photocuring catalysts include 2-benzoyl benzoic acid, 2-chlorobenzophenone, 4,4'-dichlorobenzophenone, 4-benzoyl-4'-methyl-diphenylsulfide, and p,p'-bisdiethylaminobenzophenone.

Examples of the thioxanthone photocuring catalysts include 2,4-diethylthioxanthen-9-one, 2-chlorothioxanthone, and 2-isopropylthioxanthone.

Examples of the benzyl photocuring catalysts include benzyl, (±)-camphorquinone, and p-anisyl.

These photocuring catalysts are used singly, or in combination of two or more kinds thereof.

Thermal Curing

Examples of the thermal polymerization initiator include thermal radical generating agents or derivatives thereof, and specific examples thereof include azo initiators such as V-30, V-40, V-59, V-601, V-65, V-70, VF-096, VE-073, Vam-110, and Vam-111 (manufactured by Wako Pure Chemical Industries, Ltd.), and OTazo-15, OTazo-30, AIBN, AMBN, ADVN, and ACVA (manufactured by Otsuka Chemical Co., Ltd.); and PERTETRA A, PERHEXA HC, PERHEXA C, PERHEXA V, PERHEXA 22, PERHEXA MC, PERBUTYL H, PERCUMYL H, PERCUMYL P, PERMENTA H, PEROCTA H, PERBUTYL C, PERBUTYL D, PERHEXYL D, PEROYL IB, PEROYL 355, PEROYL L, PEROYL SA, NYPER BW, NYPER BMT-K40/M, PEROYL IPP, PEROYL NPP, PEROYL TCP, PEROYL OPP, PEROYL SBP, PERCUMYL ND, PEROCTA ND, PERHEXYL ND, PERBUTYL ND, PERBUTYL NHP, PERHEXYL PV, PERBUTYL PV, PERHEXA 250, PEROCTA O, PERHEXYL O, PERBUTYL O, PERBUTYL L, PERBUTYL 355, PERHEXYL I, PERBUTYL I, PERBUTYL E, PERHEXA 25Z, PERBUTYL A, PERHEXYL Z, PERBUTYL ZT, and PERBUTYL Z (manufactured by NOF Corporation), KAYAKETAL AM-C55, TRIGONOX 36-C75, LAUROX, PERCADOX L-W75, PERCADOX CH-50L, TRIGONOX TMBH, KAYACUMENE H, KAYABUTYL H-70, PERCADOX BC-FF, KAYAHEXA AD, PERCADOX 14, KAYABUTYL C, KAYABUTYL D, KAYAHEXA YD-E85, PERCADOX 12-XL25, PERCADOX 12-EB20, TRIGONOX 22-N70, TRIGONOX 22-70E, TRIGONOX D-T50, TRIGONOX 423-C70, KAYAESTER CND-C70, KAYAESTER CND-W50, TRIGONOX 23-C70, TRIGONOX 23-W50N, TRIGONOX 257-C70, KAYAESTER P-70, KAYAESTER TMPO-70, TRIGONOX 121, KAYAESTER O, KAYAESTER HTP-65W, KAYAESTER AN, TRIGONOX 42, TRIGONOXF-C50, KAYABUTYL B, KAYACARBON EH-C70, KAYACARBON EH-W60, KAYACARBON I-20, KAYACARBON BIC-75, TRIGONOX 117, and KAYALENE 6-70 (manufactured by Kayaku Akzo Co., Ltd.), and LUPEROX 610, LUPEROX 188, LUPEROX 844, LUPEROX 259, LUPEROX 10, LUPEROX 701, LUPEROX 11, LUPEROX 26, LUPEROX 80, LUPEROX 7, LUPEROX 270, LUPEROX P, LUPEROX 546, LUPEROX 554, LUPEROX 575, LUPEROX TANPO, LUPEROX 555, LUPEROX 570, LUPEROX TAP, LUPEROX TBIC, LUPEROX TBEC, LUPEROX JW, LUPEROX TAIC, LUPEROX TAEC, LUPEROX DC, LUPEROX 101, LUPEROX F, LUPEROX DI, LUPEROX 130, LUPEROX 220, LUPEROX 230, LUPEROX 233, and LUPEROX 531 (manufactured by Arkema Yoshitomi, Ltd.).

Among them, when an azo polymerization initiator having a molecular weight of 250 or greater is used, the reaction proceeds without unevenness at a low temperature, and thus a high-strength film in which unevenness is suppressed is formed. The molecular weight of the azo polymerization initiator is preferably 250 or greater, and more preferably 300 or greater.

The heating is performed under an inert gas atmosphere of nitrogen, argon, or the like at an oxygen concentration of preferably 1000 ppm or less, and more preferably 500 ppm or less and a temperature of preferably from 50° C. to 170° C., and more preferably from 70° C. to 150° C. for preferably from 10 minutes to 120 minutes, and more preferably from 15 minutes to 100 minutes.

The total content of the photocuring catalyst or the thermal polymerization initiator is preferably from 0.1% by weight to 10% by weight, more preferably from 0.1% by weight to 8% by weight, and particularly preferably from 0.1% by weight to 5% by weight with respect to the total solid content in the solution for layer formation.

In this exemplary embodiment, a thermal curing method in which radicals are relatively slowly generated is employed due to the reason that when the reaction excessively rapidly proceeds, structural relaxation of the coating film is difficult to occur due to the cross-linking, and thus unevenness and wrinkles easily occur in the film.

Particularly, when the specific reactive group-containing charge transporting material and thermal curing are combined with each other, structural relaxation of the coating film is promoted, whereby a protective layer (outermost layer) having excellent surface properties is easily obtained.

The thickness of the protective layer is set in the range of, for example, preferably from 3 μm to 40 μm, and more preferably from 5 μm to 35 μm.

Although the configurations of the respective layers in the function separating-type photosensitive layer have been described with reference to the electrophotographic photoreceptor shown in FIG. 1, the respective layers in the function separating-type electrophotographic photoreceptor shown in FIG. 2 may also employ the configurations. In addition, in the case of the single layer-type photosensitive layer of the electrophotographic photoreceptor shown in FIG. 3, the following aspects are preferable.

That is, the single layer-type photosensitive layer (charge generating/charge transporting layer) may be configured to contain a charge generating material, a charge transporting material, and if necessary, a binder resin, with other known additives. These materials are the same as those described in the descriptions of the charge generating material and the charge transporting layer.

The content of the charge generating material in the single layer-type photosensitive layer may be from 10% by weight to 85% by weight, and is preferably from 20% by weight to 50% by weight with respect to the total solid content. The content of the charge transporting material in the single layer-type photosensitive layer may be from 5% by weight to 50% by weight with respect to the total solid content.

The method of forming the single layer-type photosensitive layer is the same as the method of forming the charge generating layer or the charge transporting layer.

The thickness of the single layer-type photosensitive layer may be, for example, from 5 μm to 50 μm, and is preferably from 10 μm to 40 μm.

In the electrophotographic photoreceptor according to this exemplary embodiment, the form has been described in which the outermost layer is a protective layer. However, a layer configuration with no protective layer may also be employed.

In the case of the layer configuration with no protective layer, in the electrophotographic photoreceptor shown in FIG. 1, the charge transporting layer which is positioned on the outermost surface of the layer configuration becomes the outermost layer. In addition, the charge transporting layer as the outermost layer is configured by a cured film of the above-described specific composition.

In addition, in the case of the layer configuration with no protective layer, in the electrophotographic photoreceptor shown in FIG. 3, the single layer-type photosensitive layer which is positioned on the outermost surface of the layer configuration becomes the outermost layer. In addition, the single layer-type photosensitive layer as the outermost layer is configured by a cured film of the above-described specific composition. The composition contains a charge generating material blended therein.

The thicknesses of the charge transporting layer as the outermost layer and the single layer-type photosensitive layer may be, for example, from 7 μm to 70 μm, and is preferably from 10 μm to 60 μm.

Image Forming Apparatus (and Process Cartridge)

Hereinafter, an image forming apparatus (and process cartridge) according to this exemplary embodiment will be described in detail.

Figure 4:
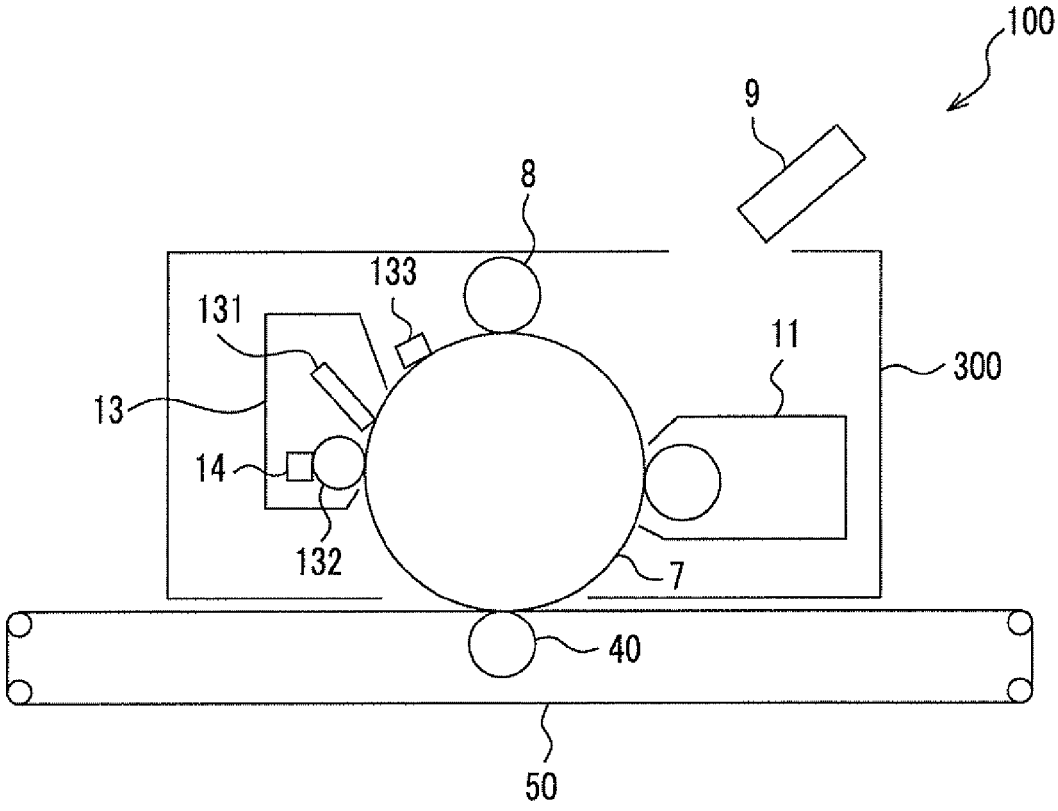
FIG. 4 is a schematic diagram showing an example of a configuration of an image forming apparatus according to the exemplary embodiment.

FIG. 4 is a diagram schematically showing the configuration of the image forming apparatus according to the first exemplary embodiment. As shown in FIG. 4, the image forming apparatus 100 is provided with a process cartridge 300 provided with an electrophotographic photoreceptor 7, an exposure device 9, a transfer device 40, and an intermediate transfer member 50. In the image forming apparatus 100, the exposure device 9 is disposed so that it is possible to expose the electrophotographic photoreceptor 7 through an opening portion of the process cartridge 300, the transfer device 40 is disposed at a position that is opposed to the electrophotographic photoreceptor 7 with the intermediate transfer member 50 interposed therebetween, and the intermediate transfer member 50 is disposed so as to be partially brought into contact with the electrophotographic photoreceptor 7. Also the image forming apparatus has a secondary transfer device which is not shown in the figure and transfers the toner images from the intermediate transfer member 50 to recording medium.

The process cartridge 300 in FIG. 4 integrally supports the electrophotographic photoreceptor 7, a charging device 8, a developing device 11 and a cleaning device 13 in a housing. The cleaning device 13 has a cleaning blade (cleaning member). The cleaning blade 131 is disposed so as to be brought into contact with the surface of the electrophotographic photoreceptor 7.

Although using a fibrous member 132 (roll shape) which supplies an antifriction 14 to the surface of the electrophotographic photoreceptor 7 and a fibrous member 133 (flat brush shape) which assists cleaning are exemplified, these may or may not be used.

Hereinafter, elements of the image forming apparatus according to this exemplary embodiment will be described in detail.

Charging Device

As the charging device 8, a contact charging device that uses, for example, a conductive or semiconductive charging roller, charging brush, charging film, charging rubber blade or charging tube is used. A known charging device such as a non-contact roller charging device, Scorotron corona charger or Corotron corona charger that makes use of corona discharge may be used as well.

Though not shown in the drawing, a photoreceptor heating member for elevating a temperature of the electrophotographic photoreceptor 7 to reduce a relative temperature may be disposed around the electrophotographic photoreceptor 7 to enhance stability of an image.

Exposure Device

As the exposing device 9, an optical device for desirably image-wise exposing light of semiconductor laser beam, LED light or liquid crystal shutter light on a surface of the photoreceptor 7 is exemplified. A wavelength of a light source, which is in a spectral sensitivity range of a photoreceptor, is used. As a wavelength of a semiconductor laser, near-infrared having an oscillation wavelength in the proximity of 780 nm is mainly used. However, without restricting to the wavelength, a laser having an oscillation wavelength of 600 something nm or a laser having an oscillation wavelength in the vicinity of from 400 nm to 450 nm as a blue laser may be used. Furthermore, when a color image is formed, a surface-emitting laser light source capable of outputting multi-beams as well is effective.

Developing Device

As the developing device 11, a general developing device where, for example, a magnetic or nonmagnetic single component developer or two-component developer is used in contact or without contact to develop may be used. The developing device is selected in accordance with the object as long as the foregoing functions are possessed. For example, a known developing device where the single component or two-component developer is attached to a photoreceptor 7 by use of a brush or a roller is cited. Among these, a developing roller retaining a developer on a surface thereof is preferably used.

The developer is used in the developing device 11 may be a single component developer composed of a toner, or two-component developer including a toner and a carrier. A known developer may be used.

Cleaning Device

A device with a cleaning blade system which is provided with the cleaning blade 131 is used as the cleaning device 13.

Other than the cleaning blade system, a fur brush cleaning system or a system in which cleaning is carried out simultaneously with development may be employed.

Transfer Device

As the transfer device 40, a known charging device such as a contact transfer charging device that uses, for example, a belt, a roller, a film or a rubber blade; or a Scorotron corona charger or Corotron corona charger using corona discharge may be used as well.

Intermediate Transfer Member

As the intermediate transfer member 50, a belt (intermediate transfer belt) made of semiconductive polyimide, polyamideimide, polycarbonate, polyarylate, polyester, rubber or the like may be used. As a form of the intermediate transfer member 50, a drum may be used in addition to a belt.

The above-described image forming apparatus 100 may be provided with, for example, known devices, other than the above-described devices.

Figure 5:
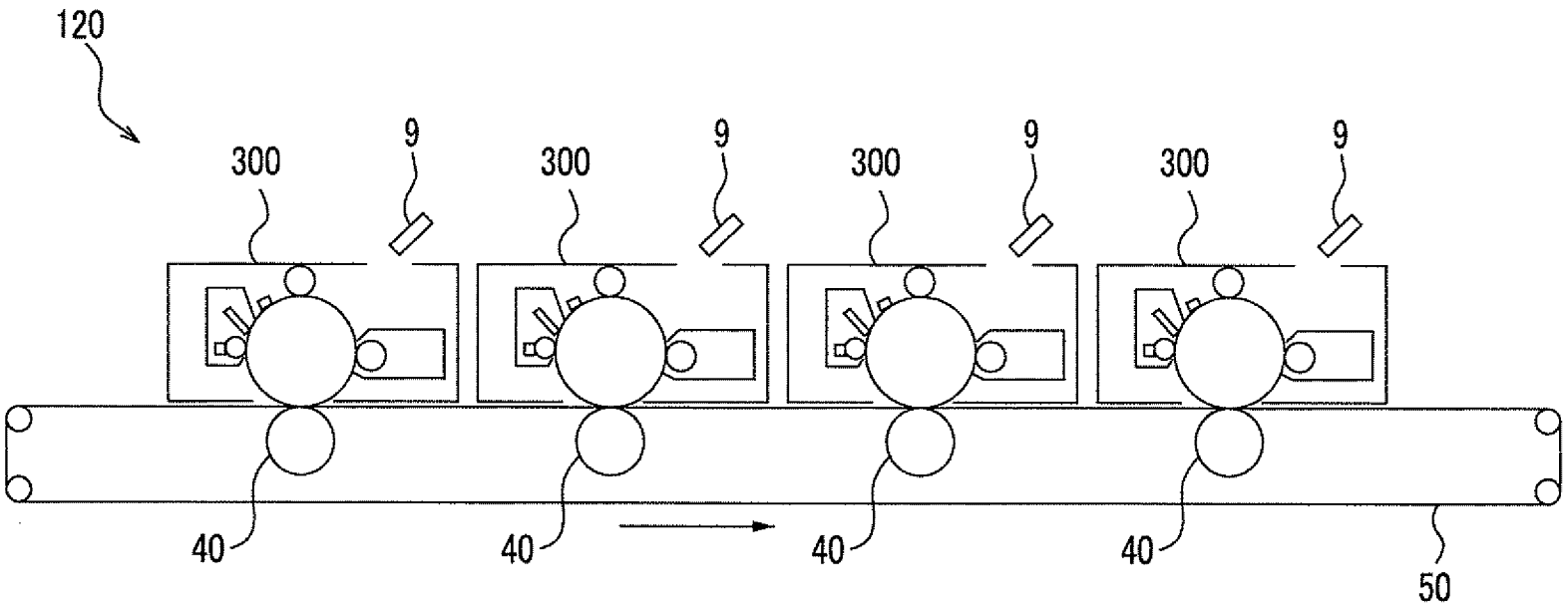
FIG. 5 is a schematic diagram showing another example of the configuration of the image forming apparatus according to the exemplary embodiment.

FIG. 5 is a schematic diagram showing another example of the configuration of the image forming apparatus according to this exemplary embodiment.

An image forming apparatus 120 shown in FIG. 5 is a tandem multicolor image forming apparatus having four process cartridges 300 installed therein. In the image forming apparatus 120, the four process cartridges 300 are arranged in parallel on an intermediate transfer member 50, and a configuration is employed in which one electrophotographic photoreceptor is used per color. The image forming apparatus 120 has the same configuration as the image forming apparatus 100, except that the image forming apparatus 120 has a tandem system.

The process cartridge according to this exemplary embodiment may be any process cartridge as long as it is provided with an electrophotographic photoreceptor and is detachable from the image forming apparatus.

As for the above-described image forming apparatus (process cartridge) according to this exemplary embodiment, the image forming apparatus to which a dry developer is applied has been described. However, an image forming apparatus (process cartridge) to which a liquid developer is applied may be used. Particularly, in the image forming apparatus (process cartridge) to which a liquid developer is applied, an outermost layer of an electrophotographic photoreceptor swells due to liquid components of the liquid developer, and thus cracks or cleaning scratches due to the cleaning are easily generated. However, when the electrophotographic photoreceptor according to this exemplary embodiment is applied, these are improved, and as a result, stable images are obtained over a long period of time.

Figure 6:
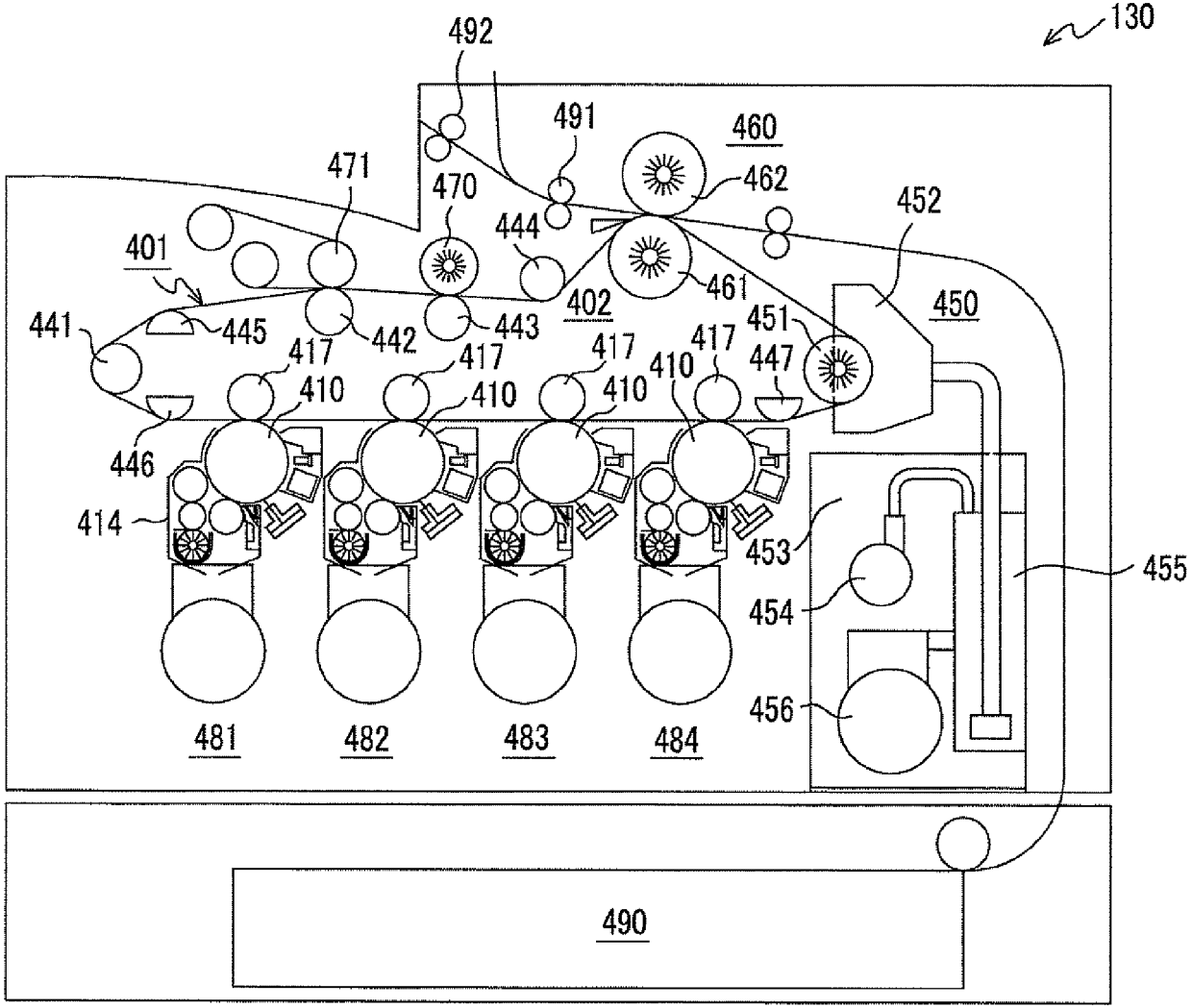
FIG. 6 is a schematic diagram showing a further example of the configuration of the image forming apparatus according to the exemplary embodiment.
Figure 7:
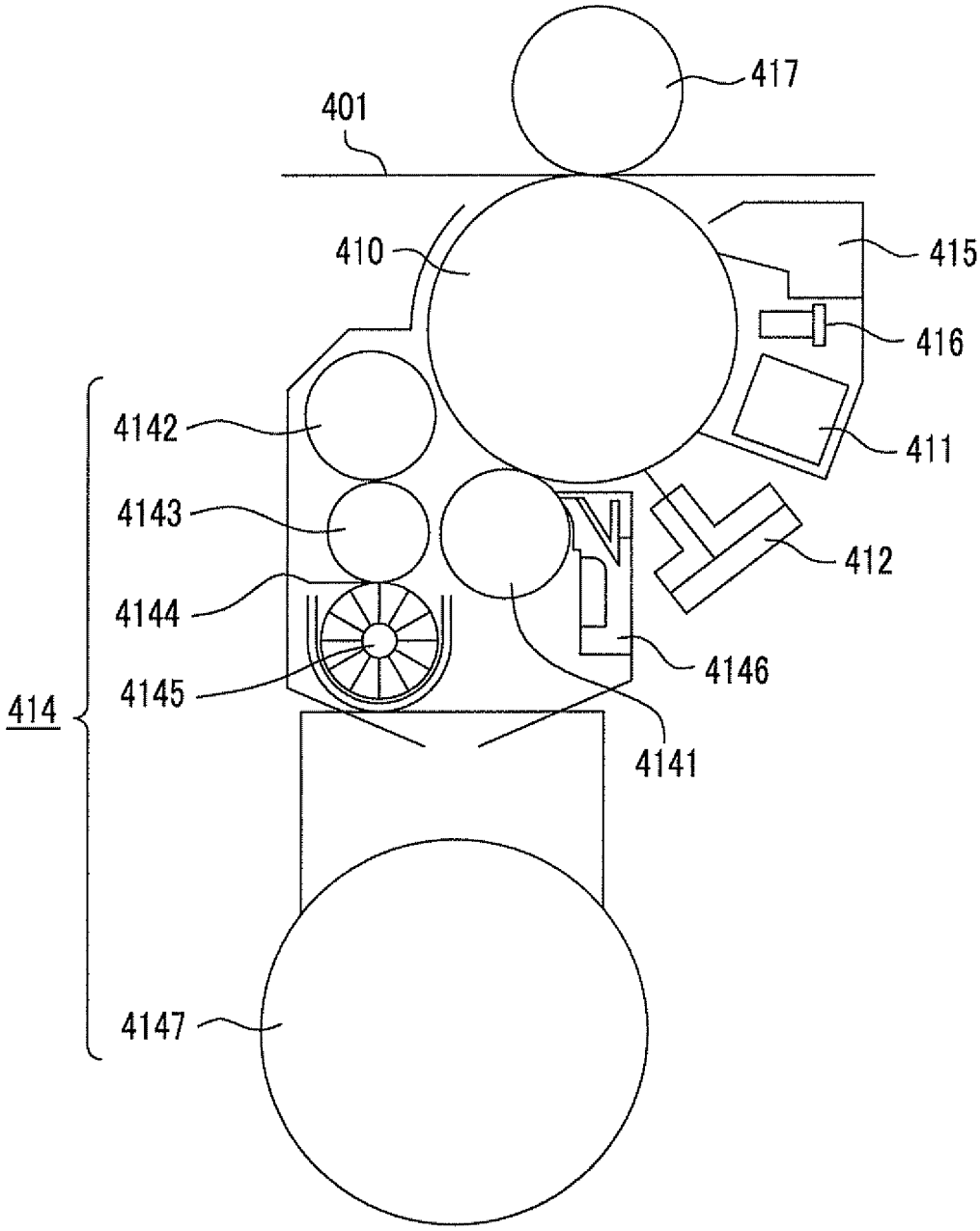
FIG. 7 is a schematic diagram showing a configuration of a developing device in the image forming apparatus shown in FIG. 6.

FIG. 6 is a schematic diagram showing a further example of the configuration of the image forming apparatus according to this exemplary embodiment. FIG. 7 is a schematic diagram showing a configuration of an image forming unit in the image forming apparatus shown in FIG. 6.

An image forming apparatus 130 shown in FIG. 6 is mainly configured by a belt-shaped intermediate transfer member 401, color image forming units 481, 482, 483, and 484, a heating part 450 (an example of a layer forming unit), and a transfer fixing part 460.

As shown in FIG. 7, the image forming unit 481 is configured by an electrophotographic photoreceptor 410, a charging device 411 which charges the electrophotographic photoreceptor 410, a LED array head 412 (an example of an electrostatic latent image forming unit) which performs an image exposure in order to form an electrostatic latent image on a surface of the charged electrophotographic photoreceptor 410 in accordance with image information, a developing device 414 which develops the electrostatic latent image which is formed on the electrophotographic photoreceptor 410 using a liquid developer, a cleaner 415 which cleans the surface of the photoreceptor, an erasing device 416, and a transfer roll 417 (an example of a primary transfer unit) which is disposed to be opposed to the electrophotographic photoreceptor 410 with the belt-shaped intermediate transfer member 401 interposed therebetween, and to which a transfer bias is applied to transfer, onto the belt-shaped intermediate transfer member 401, the image which is formed on the electrophotographic photoreceptor 410 and developed with the liquid developer.

As shown in FIG. 7, the developing device 414 has a developing roll 4141, a liquid drain-off roll 4142, a developer cleaning roll 4143, a developer cleaning blade 4144, a developer cleaning brush 4145, a circulation pump (not shown), a liquid developer supply path 4146, and a developer cartridge 4147 provided therein.

As the liquid developer which is used herein, a liquid developer in which particles including a heating fusing fixing-type resin such as polyester or polystyrene as a main component are dispersed, or a liquid developer which is formed into a layer (hereinafter, referred to as forming into a film) by increasing the ratio of the solid content in the liquid developer by removing a surplus dispersion medium (carrier liquid) is used. The detailed description of the material which is formed into a film is shown in U.S. Pat. No. 5,650,253 (from Column 10, Line 8 to Column 13, Line 14) and U.S. Pat. No. 5,698,616.

The developer which is formed into a film is a liquid developer in which a substance having a fine particle diameter (such as a toner having a fine particle diameter) having a glass transition temperature lower than room temperature (for example, 25° C.) is dispersed in a carrier liquid. Usually, particles of the substance do not come into contact and aggregate with each other. However, when the carrier liquid is removed, only the substance is present, and thus when the substance is adhered in the form of a film, the particles are bonded to each other at room temperature (for example, 25° C.) and a film is formed. This substance is obtained by blending ethyl acrylate with methyl methacrylate, and the glass transition temperature is set in accordance with the blending ratio.

Other image forming units 482, 483, and 484 also have the same configuration. Liquid developers having different colors (yellow, magenta, cyan, and black) are charged in the developing devices of the respective image forming units. In addition, the electrophotographic photoreceptor, the developing device, or the like is made into a cartridge in the respective image forming units 481, 482, 483, and 484.

In the above configuration, examples of the material of the belt-shaped intermediate transfer member 401 include a PET film (polyethylene telephthalate film) coated with silicone rubber or a fluorine resin, and a polyimide film.

The electrophotographic photoreceptor 410 contacts the belt-shaped intermediate transfer member 401 on an upper surface thereof, and moves with the belt-shaped intermediate transfer member 401 at the same rate.

For example, a corona charger is used as the charging device 411. As the electrophotographic photoreceptors 410 in the image forming units 481, 482, 483, and 484, electrophotographic photoreceptors 410 having the same peripheral length are used, and an interval between the transfer rolls 417 is the same as the peripheral length of the electrophotographic photoreceptor 410, or the integral multiple of the peripheral length.

The heating part 450 is configured by a heating roll 451 which is provided to contact and rotate with an inner surface of the belt-shaped intermediate transfer member 401, a reservoir tank 452 which is provided to be opposed to the heating roll 451 and surround an outer surface of the belt-shaped intermediate transfer member 401, and a carrier liquid recovering part 453 which recovers a carrier liquid vapor and a carrier liquid from the reservoir tank 452. A suction blade 454 which sucks the carrier liquid vapor in the reservoir tank 452, a condensing part 455 which coverts the carrier liquid vapor into a liquid, and a recovery cartridge 456 which recovers the carrier liquid from the condensing part 455 are mounted on the carrier liquid recovering part 453.

The transfer fixing part 460 (an example of a secondary transfer unit) is configured by a transfer support roll 461 which rotates and supports the belt-shaped intermediate transfer member 401 and a transfer fixing roll 462 which rotates while pressing a recording medium passing through the transfer fixing part 460 against the belt-shaped intermediate transfer member 401, and both of them have a heating element therein.

In addition, a cleaning roll 470 and a cleaning web 471 which perform cleaning on the belt-shaped intermediate transfer member 401 prior to the formation of the color image on the belt-shaped intermediate transfer member 401, and support rolls 441 to 444 and support shoes 445 to 447 which support the rotary drive of the belt-shaped intermediate transfer member 401 are provided.

Regarding the belt-shaped intermediate transfer member 401, the transfer rolls 417 of the respective color image forming units, the heating roll 451, the transfer support roll 461, the support rolls 441 to 444, the support shoes 445 to 447, the cleaning roll 470, and the cleaning web 471 constitute an intermediate unit 402, and the intermediate unit 402 in the vicinity of the support roll 441 is integrally moved up and down around the vicinity of the heating roll 451.

Hereinafter, an operation of the image forming apparatus shown in FIG. 6 which uses a liquid developer will be described.

First, in the image forming unit 481, an image exposure according to yellow image information is performed by the LED array head 412 on the electrophotographic photoreceptor 410 having a surface charged by the charging device 411 to form an electrostatic latent image. The electrostatic latent image is developed with a yellow liquid developer by the developing device 414.

Here, the developing is performed in the following steps. The yellow liquid developer passes through the liquid developer supply path 4146 from the developer cartridge 4147 by a circulation pump and is supplied around a position at which the developing roll 4141 and the electrophotographic photoreceptor 410 approach each other. Due to a developing electric field which is formed between the electrostatic latent image on the electrophotographic photoreceptor 410 and the developing roll 4141, the colored solid content having a charge in the supplied liquid developer transfers to the electrostatic latent image part as an image part on the electrophotographic photoreceptor 410.

Next, the carrier liquid is removed from the electrophotographic photoreceptor 410 by the liquid drain-off roll 4142 so as to obtain a carrier liquid ratio which is necessary in the next transfer process. In this manner, a yellow image by the yellow liquid developer is formed on the surface of the electrophotographic photoreceptor 410 passing through the developing device 414.

In the developing device 414, the developer cleaning roll 4143 removes the liquid developer on the developing roll 4141 after the developing operation and the liquid developer adhered to a squeeze roll due to a squeeze operation, and the developer cleaning blade 4144 and the developer cleaning brush 4145 clean the developer cleaning roll 4143 to always perform a stable developing operation. The configuration and the operation of the developing device are described in detail in JP-A-11-249444.

In order to supply a liquid developer having a constant solid content ratio to the developing roll 4141, at least one of the developing device 414 and the developer cartridge 4147 automatically controls the concentration of the solid content in the liquid developer.

The yellow developed image formed on the electrophotographic photoreceptor 410 contacts the belt-shaped intermediate transfer member 401 on its upper surface due to the rotation of the electrophotographic photoreceptor 410, and electrostatically transferred onto the belt-shaped intermediate transfer member 401 in a contact manner by the transfer roll 417 which is disposed to be opposed to and brought into pressure contact with the electrophotographic photoreceptor 410 via the belt-shaped intermediate transfer member 401 and to which a transfer bias is applied.

In the electrophotographic photoreceptor 410 in which the contact electrostatic transfer is ended, the liquid developer remaining after the transfer is removed by the cleaner 415, and the electrophotographic photoreceptor 410 is erased by the erasing device 416 so as to be used in the next image formation.

Other image forming units 482, 483, and 484 also perform the same operation. As the electrophotographic photoreceptors in the respective image forming units, electrophotographic photoreceptors 410 having the same peripheral length are used, and developed color images formed on the respective photoreceptors are electrostatically transferred in order onto the belt-shaped intermediate transfer member 401 by the transfer rolls which are provided at an interval which is the same as the peripheral length of photoreceptor, or the integral multiple of the peripheral length. Accordingly, the developed images of yellow, magenta, cyan, and black formed on the respective photoreceptors 410 in consideration of the overlapping positions on the belt-shaped intermediate transfer member 401 overlap each other in order with high accuracy on the belt-shaped intermediate transfer member 401 without a position deviation and are electrostatically transferred in a contact manner even when there is eccentricity of the electrophotographic photoreceptor 410, and the images developed with the respective color liquid developers are formed on the belt-shaped intermediate transfer member 401 passing through the image forming unit 484.

The developed images formed on the belt-shaped intermediate transfer member 401 are heated from a rear surface of the belt-shaped intermediate transfer member 401 by the heating roll 451 in the heating part 450, and the carrier liquid which is a dispersion medium almost evaporates, whereby an image formed into a film is obtained. The reason for this is that when the liquid developer contains dispersed particles including a heating fusing fixing-type resin as a main component, the dispersed particles are melted due to the removal of the surplus dispersion medium and the heating by the heating roll 451 and form a film. Otherwise, the reason is that the liquid developer is formed into a film by removing a surplus dispersion medium (carrier liquid) and increasing the ratio of the solid content in the liquid developer.

In the heating part 450, a carrier liquid vapor in the reservoir tank 452 which is generated by evaporation by heating by the heating roll 451 is guided to and liquefied in the condensing part 455 by the suction blade 454 in the carrier liquid recovering part 453, and the reliquefied carrier liquid is guided to the recovery cartridge 456 and recovered.

In the transfer fixing part 460, the belt-shaped intermediate transfer member 401 with the film-shaped (layer-shaped) image formed thereon which passes through the heating part 450 is transferred onto a transfer medium (for example, plain paper) which is transported at the right time from a paper storage part 490 in a lower part of the device, through heating and pressing by the transfer support roll 461 and the transfer fixing roll 462 to form the image on the transfer medium. The transfer medium is output and discharged to the outside of the device by discharge rolls 491 and 492. Here, in the transfer, the adhesion of the image formed into a film on the belt-shaped intermediate transfer member 401 to the belt-shaped intermediate transfer member 401 is weaker than the adhesion of the image formed into a film to the transfer medium, and the transfer is performed on the transfer medium by a difference in the adhesion. No electrostatic force is applied at the time of transfer. The bonding power of the image formed into a film is greater than the adhesion to the transfer medium.

In the belt-shaped intermediate transfer member 401 passing through the transfer fixing part 460, the solid content remaining after the transfer or a substance which is contained in the solid content and inhibits the function of the belt-shaped intermediate transfer member 401 is recovered and removed by the cleaning roll 470 having a heating element therein and the cleaning web 471. Thereafter, the belt-shaped intermediate transfer member 401 is used in the next image formation.

After the image is formed as described above, the intermediate unit 402 in the vicinity of the support roll 441 integrally moves upward around the vicinity of the heating roll 451, and the belt-shaped intermediate transfer member 401 is separated from the electrophotographic photoreceptors 410 of the respective image forming units. In addition, the transfer fixing roll 462 is also separated from the belt-shaped intermediate transfer member 401.

When there is again an image forming request, the intermediate unit 402 is operated so as to bring the belt-shaped intermediate transfer member 401 into contact with the electrophotographic photoreceptors 410 of the image forming units. Likewise, the transfer fixing roll 462 is also operated so as to contact with the belt-shaped intermediate transfer member 401. The operation of the transfer fixing roll 462 may be carried out in accordance with a time at which an image is transferred onto a recording medium.

Figure 8:
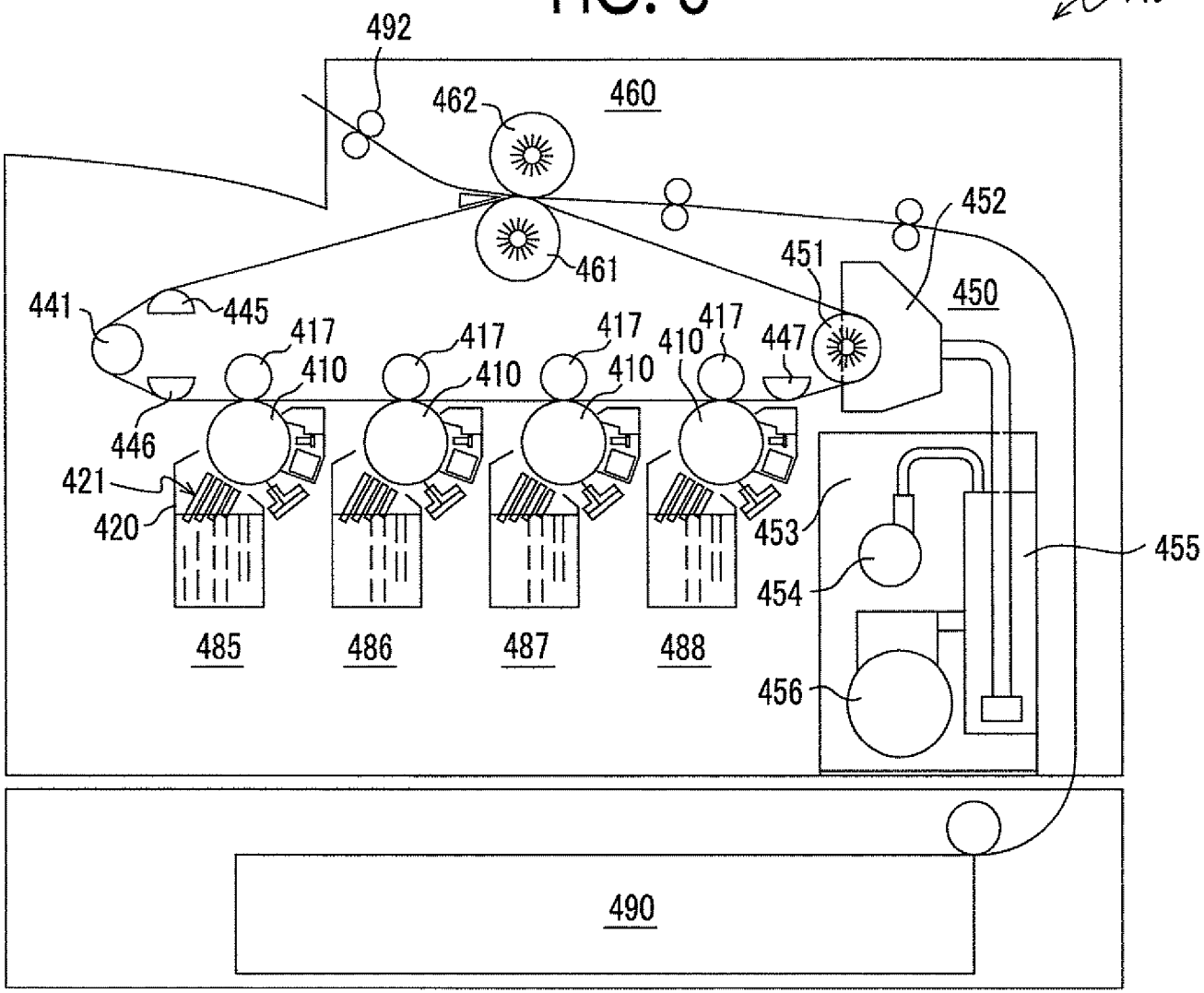
FIG. 8 is a schematic diagram showing a further example of the configuration of the image forming apparatus according to the exemplary embodiment.

The image forming apparatus using a liquid developer is not limited to the above-described image forming apparatus 130 shown in FIG. 6, and may be, for example, an image forming apparatus shown in FIG. 8.

FIG. 8 is a schematic diagram showing a further example of the configuration of the image forming apparatus according to this exemplary embodiment.

An image forming apparatus 140 shown in FIG. 8 is mainly configured by a belt-shaped intermediate transfer member 401, color image forming units 485, 486, 487, and 488, a heating part 450, and a transfer fixing part 460 as in the image forming apparatus 130 shown in FIG. 6.

The image forming apparatus 140 shown in FIG. 8 is different from the image forming apparatus 130 shown in FIG. 6 in that the belt-shaped intermediate transfer member 401 runs in a substantially triangular form and a developing device 420 in each of the color image forming units 485, 486, 487, and 488 has a different configuration. The heating part 450 and the transfer fixing part 460 are the same as those in the image forming apparatus 130 shown in FIG. 6. A cleaning roll 470 and a cleaning web 471 are omitted in the drawing.

The belt-shaped intermediate transfer member 401 performs a bending operation with the rotation of the belt-shaped intermediate transfer member 401. However, since the bending operation affects the stable running and the lifetime of the belt-shaped intermediate transfer member 401, a substantially triangular running form with a minimized bending operation is employed.

In the developing device 420, there are no developing rolls and liquid drain-off rolls, but plural recording heads 421 which selectively jet and adhere a liquid developer to an electrostatic latent image formed on an electrophotographic photoreceptor 410 are arranged in plural rows.

In addition, a large number of recording electrodes 422 are uniformly provided in a longitudinal direction of the electrophotographic photoreceptor 410 in the respective rows of the recording heads 421, and a jetting electric field is formed between an electrostatic latent image potential formed on the electrophotographic photoreceptor 410 and a jetting bias potential applied to the recording electrode 422, whereby the colored solid content having a charge in the liquid developer supplied to the recording electrode 422 transfers to the electrostatic latent image part as an image part on the electrophotographic photoreceptor 410, and is developed.

Figure 9:
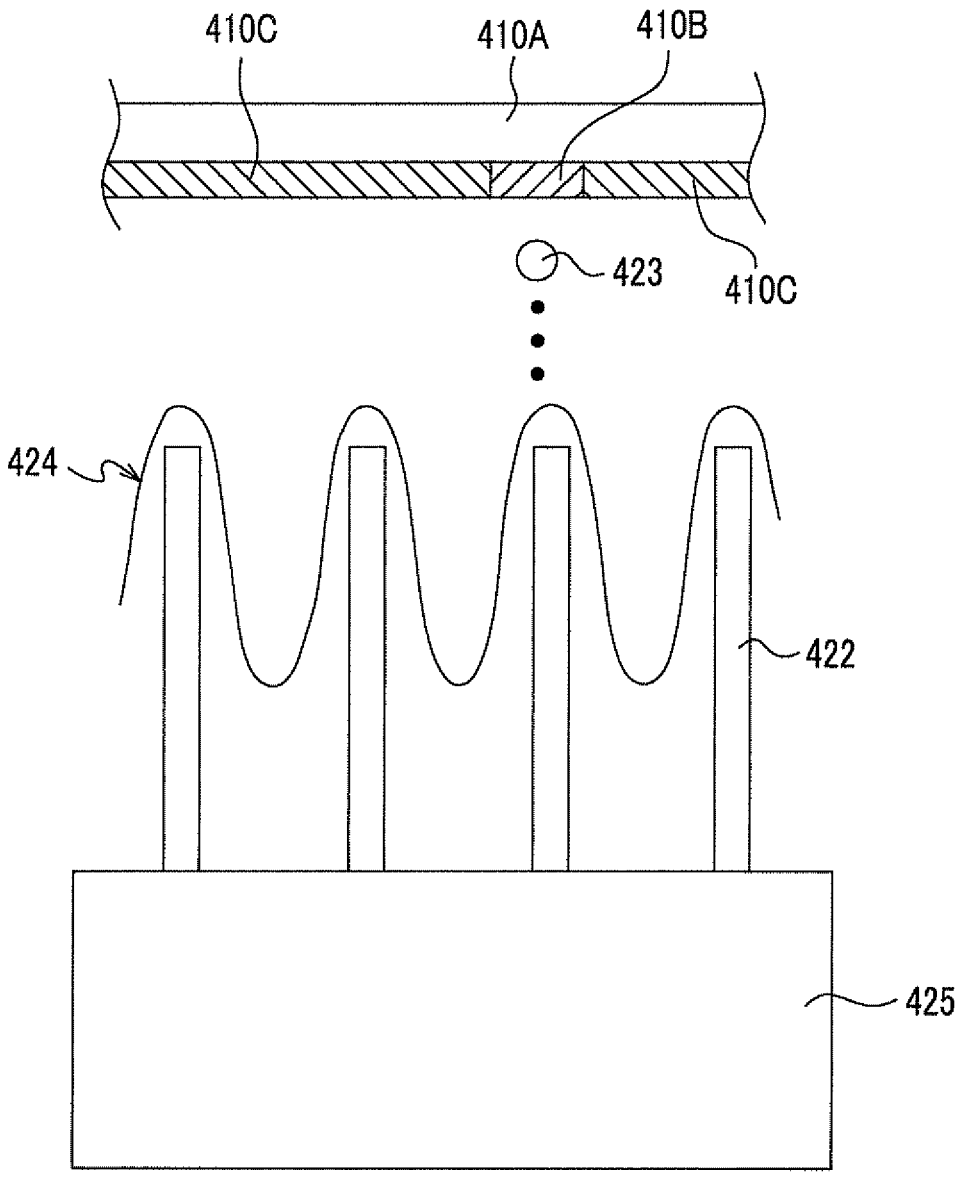
FIG. 9 is a schematic diagram showing a meniscus of a liquid developer which is formed around a recording electrode of the developing device and a moving state of the liquid toward an image part in the image forming apparatus shown in FIG. 8.

A meniscus (liquid holding form which is formed on the member or between the members brought into contact with the liquid by viscosity of the liquid, surface tension, and surface energy of the surface of the member brought into contact with the liquid) 424 of the liquid developer is formed around the recording electrode 422. FIG. 9 is a diagram showing the above state. An electrostatic latent image which becomes an image part is formed on an electrophotographic photoreceptor 410A which is a jetting destination of a liquid droplet 423 of the liquid developer. At this time, for example, an electrostatic latent image potential of from 50 V to 100 V is applied to an image part 410B, and for example, a potential of from 500 V to 600 V is applied to a non-image part 410C. Here, when a jetting bias potential of about 1000 V is applied to the recording electrode 422 via a bias voltage supplier 425, a liquid developer having a solid content ratio higher than the ratio of the solid content in the supplied liquid developer, i.e. a high-concentration liquid developer is supplied to a tip end of the recording electrode 422 by electric field concentration, and the liquid droplet 423 generated by the high-concentration liquid developer is jetted and adhered to the electrostatic latent image part (image part) on the electrophotographic photoreceptor 410A by a potential difference (for example, from 700 V to 800 V is a threshold of the potential difference for jetting) between the electrostatic latent image potential of the image part 410B on the electrophotographic photoreceptor 410A and the jetting bias potential of the recording electrode 422. In addition, in the developing device 420, the developing device itself acts as a developer cartridge.

As for the operation of the image forming apparatus 140 shown in FIG. 8, since only the running form of the belt-shaped intermediate transfer member 401 and the operation of the developing device 420 are different from those in the image forming apparatus 130 shown in FIG. 6 and other operations are the same, the descriptions thereof will be omitted.

Figure 10:
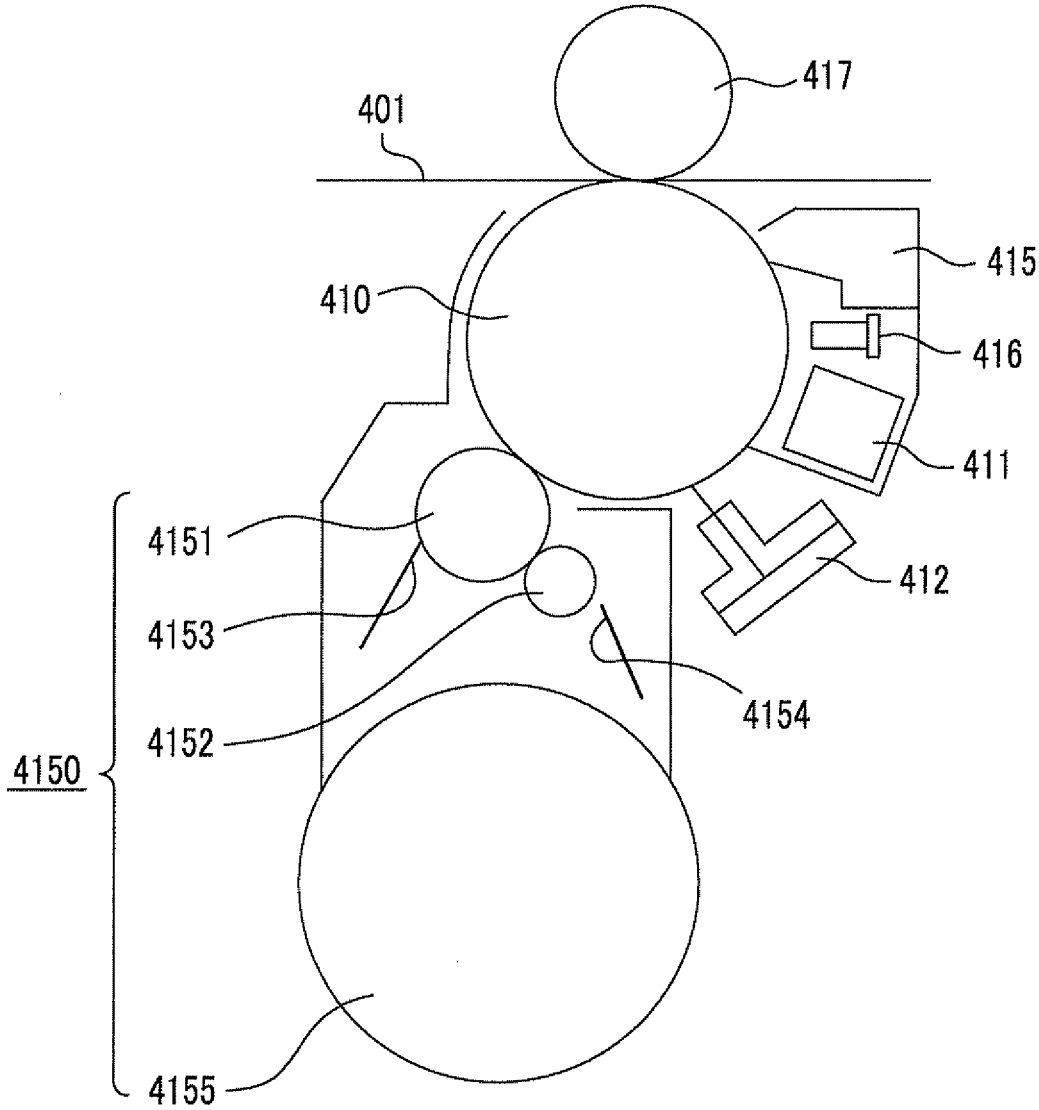
FIG. 10 is a schematic diagram showing another example of the configuration of the developing device in the image forming apparatus shown in FIGS. 6 and 8.

Here, in the image forming apparatus using a liquid developer, the developing device is not limited to the above-described configuration, and for example, may be a developing device shown in FIG. 10.

FIG. 10 is a schematic diagram showing a configuration of another developing device in the image forming apparatus shown in FIG. 6 or 8.

In the image forming apparatus 130 shown in FIG. 6 or the image forming apparatus 140 shown in FIG. 8, when developing an electrostatic latent image formed on an electrophotographic photoreceptor 410 by a developing roll 4151, a developing device 4150 shown in FIG. 10 forms, on the developing roll 4151, a liquid developer layer having a solid content ratio higher than the ratio of the solid content in a liquid developer which is supplied from a developer cartridge 4155, and the developing is carried out by the high-concentration liquid developer layer.

As for the formation of the liquid developer layer having an increased solid content ratio on the developing roll 4151, by forming an electric field by providing a potential difference between a supply roll 4152 and the developing roll 4151, a liquid developer layer having a solid content ratio higher than that of the liquid developer from the developer cartridge 4155 is formed on the developing roll 4151. Cleaning blades 4153 and 4154 are provided to clean roll surfaces of the developing roll 4151 and the supply roll 4152.

The above-described image forming apparatus (process cartridge) according to this exemplary embodiment is not limited to the above-described configuration, and a known configuration may be applied.

Charge Transporting Film (and Photoelectric Conversion Device Provided with Charge Transporting Film)

A charge transporting film according to this exemplary embodiment is configured by a cured film of a composition containing at least one selected from reactive compounds represented by Formula (I).

In the charge transporting film according to this exemplary embodiment, a reduction in the mobility due to repeated use is suppressed. The reason for this is not clear, but it is thought that the reason is the same as that in the description of the electrophotographic photoreceptor according to this exemplary embodiment.

In addition, in a photoelectric conversion device provided with the charge transporting film according to this exemplary embodiment, a reduction in the brightness and an increase in the drive voltage are suppressed even when the photoelectric conversion device is repeatedly used.

In addition, since the charge transporting film according to this exemplary embodiment has an excellent mechanical strength, the photoelectric conversion device provided with the charge transporting film as an outermost layer is also excellent in the mechanical strength of the surface thereof.

Examples of the photoelectric conversion device include organic electroluminescence (EL) elements, memory devices, and wavelength conversion elements, other than the electrophotographic photoreceptor.

EXAMPLES

Hereinafter, the invention will be described in more detail using examples, but is not limited thereto.

Example 1

Preparation of Electrophotographic Photoreceptor

Preparation of Undercoat Layer 100 parts by weight of zinc oxide (average particle size: 70 nm, manufactured by Tayca Corporation, specific surface area: 15 $m^2/g$) is stirred and mixed with 500 parts by weight of toluene, and 1.3 parts by weight of a silane coupling agent (KBM503, manufactured by Shin-Etsu Chemical Co., Ltd.) is added thereto, followed by stirring for 2 hours. Thereafter, the toluene is distilled away by distillation under reduced pressure, and baking is performed at 120° C. for 3 hours to obtain the zinc oxide having a surface treated with the silane coupling agent. 110 parts by weight of the surface-treated zinc oxide is stirred and mixed with 500 parts by weight of tetrahydrofuran, and a solution in which 0.6 parts by weight of alizarin is dissolved in 50 parts by weight of tetrahydrofuran is added thereto, followed by stirring at 50° C. for 5 hours. Thereafter, the zinc oxide to which the alizarin is added is collected by filtration under reduced pressure, and dried under reduced pressure at 60° C. to obtain alizarin-added zinc oxide.

38 parts by weight of a solution obtained by mixing 60 parts by weight of the alizarin-added zinc oxide, 13.5 parts by weight of a curing agent (blocked isocyanate, SUMIDUR 3175, manufactured by Sumitomo Bayer Urethane Co., Ltd.), and 15 parts by weight of a butyral resin (S-LEC BM-1, manufactured by Sekisui Chemical Co., Ltd.) with 85 parts by weight of methyl ethyl ketone is mixed with 25 parts by weight of methyl ethyl ketone. The mixture is dispersed with a sand mill using glass beads having a diameter of 1 mmϕ for 2 hours to obtain a dispersion. 0.005 part by weight of dioctyltin dilaurate as a catalyst and 40 parts by weight of silicone resin particles (TOSPAL 145, manufactured by GE Toshiba Silicones Co., Ltd.) are added to the obtained dispersion to obtain an undercoat layer-forming coating liquid. The coating liquid is applied to an aluminum substrate through a dipping coating method, and dried and cured at 170° C. for 40 minutes, thereby obtaining an undercoat layer having a thickness of 20 μm.

Preparation of Charge Generating Layer

A mixture of 15 parts by weight of hydroxy gallium phthalocyanine (CGM-1) as a charge generating material having diffraction peaks at least at Bragg angles (2θ±0.2°) of 7.3°, 16.0°, 24.9°, and 28.0° in an X-ray diffraction spectrum using CuKα characteristic X-rays, 10 parts by weight of a vinyl chloride-vinyl acetate copolymer resin (VMCH, manufactured by Nippon Unicar Company Ltd.) as a binder resin, and 200 parts by weight of n-butyl acetate is dispersed with a sand mill using glass beads having a diameter of 1 mmϕ for 4 hours. 175 parts by weight of n-butyl acetate and 180 parts by weight of methyl ethyl ketone are added to the obtained dispersion and the resultant is stirred to obtain a charge generating layer-forming coating liquid. The charge generating layer-forming coating liquid is applied to the undercoat layer by dipping, and dried at room temperature (25° C.), thereby forming a charge generating layer having a thickness of 0.2 μm.

Preparation of Charge Transporting Layer

A charge transporting layer-forming coating liquid having the following composition is prepared.

Charge Transporting Material: N,N'-diphenyl-N,N'-bis(3-methylphenyl)-[1,1']biphenyl-4,4'-diamine (CTM-1), 45 parts by weight Resin: bisphenol-Z polycarbonate resin (hereinafter, referred to as "PCZ 500", viscosity average molecular weight: 50,000), 55 parts by weight Solvent: chlorobenzene, 800 parts by weight The coating liquid is applied to the charge generating layer and dried at 130° C. for 45 minutes, thereby forming a charge transporting layer having a thickness of 20 μm.

Preparation of Protective Layer

A protective layer-forming coating liquid having the following composition is prepared.

Reactive Group-Containing Charge Transporting Material: Exemplary Compound (Ia)-2, 100 parts by weight Initiator: Otazo 15 (manufactured by Otsuka Chemical Co., Ltd.), 2 parts by weight Solvent: tetrahydrofuran (THF)/toluene mixed solvent (weight ratio 60/40), 150 parts by weight The coating liquid is applied to the charge transporting layer 2B-1 and heated at 150° C. for 40 minutes under an atmosphere of an oxygen concentration of about 100 ppm to form a protective layer having a thickness of 7 μm.

An electrophotographic photoreceptor is obtained through the above method. The electrophotographic photoreceptor is set as Photoreceptor 1.

Examples 2 to 32, Comparative Examples 1 and 2

Preparation of Electrophotographic Photoreceptor

Electrophotographic photoreceptors are obtained in the same manner as in Example 1, except that the charge transporting material in the protective layer-forming coating liquid in Example 1 is changed according to Tables 1 and 2. The photoreceptors are set to Photoreceptors 2 to 32 and Comparative Photoreceptors 1 and 2.

Evaluations

Evaluation of Initial Electric Characteristics

The obtained electrophotographic photoreceptors are subjected to the following processes (A) to (C) at high temperature and high humidity (28° C., 67% RH).

(A): process of charging electrophotographic photoreceptor by scorotron charger having grid applied voltage of −700 V (B): exposure process including performing irradiation with light of 10.0 erg/cm$^2$ using semiconductor laser having wavelength of 780 nm after 1 second from process (A)

(C): charge removing process including performing irradiation with red LED light of 50.0 erg/cm$^2$ after 3 seconds from process (A)

VH (surface potential of the photoreceptor after charged in Process (A)), VL (surface potential of the photoreceptor after exposed in Process (B)), and VRP (surface potential (residual potential) of the photoreceptor after erased in Process (C)) are measured.

A surface electrometer MODEL 344 (manufactured by Trek Japan Co., Ltd.) is used in the measurement of the surface potential (residual potential). A+ represents the most excellent characteristic.

The evaluation indices are as follows.

Evaluation Indices of VL

A+: −230 V or greater

A: −240 V or greater

B: from −280 V to less than −240 V

C: from −300 V to less than −280 V

D: less than −300 V

Evaluation Indices of VRP

A+: −120 V or greater

A: −130 V or greater

B: from −150 V to less than −130 V

C: from −170 V to less than −150 V

D: less than −170 V

Photoreceptor Running Evaluation 1

Figure 11A:
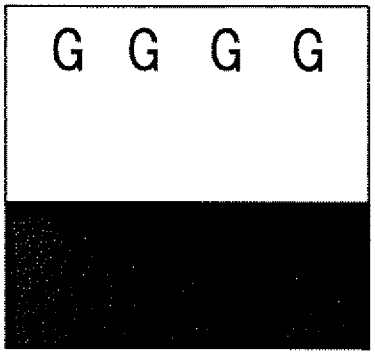
FIGS. 11A to 11C are diagrams showing an image pattern for use in image evaluation.

The electrophotographic photoreceptors prepared in the above-described Examples 1 to 32 and Comparative Examples 1 and 2 are mounted on DocuCentre Color 400CP (manufactured by Fuji Xerox Co., Ltd.), and an image evaluation pattern shown in FIG. 11A is output under a normal environment (20° C., 50% RH). Thereafter, 50000 black solid patterns are continuously output, and then the image evaluation pattern is output again. The light intensity is adjusted using a filter in accordance with sensitivity of the charge generating material.

Image Stability

The image evaluation patterns output before and after Photoreceptor Running Evaluation 1 are compared and a degree of image quality deterioration is visually evaluated as follows. A++ represents the most excellent characteristic.

A++: The most excellent (almost no deterioration is shown in all of the output image patterns).

A+: Changes are confirmed in magnified images of some of the plural output image patterns.

A: Excellent (changes may not be visually confirmed, but are confirmed in magnified images).

B: Acceptable level even at which an image quality deterioration may be confirmed.

C: Level having a problem at which an image quality deterioration occurs.

Electric Characteristic Stability

The photoreceptors are negatively charged by a scorotron charger having a grid applied voltage of −700 V under a normal environment (20° C., 50% RH) before or after carrying out the above-described Photoreceptor Running Evaluation 1. Next, the charged photoreceptors are subjected to flash exposure using a 780 nm-semiconductor laser at a light intensity of 10 mJ/m$^2$. After 10 seconds from the exposure, the potential (V) of the photoreceptor surface is measured and this value is set as a value of the residual potential. In any of the photoreceptors, the residual potential has a negative value. In the respective photoreceptors, a value of (residual potential before carrying out Running Evaluation 1)−(residual potential after carrying out Running Evaluation 1) is calculated to evaluate the electric characteristic stability. A++ represents the most excellent characteristic.

A++: less than 10 V

A+: from 10 V to less than 20 V

A: from 20 V to less than 30 V

B: from 30 V to less than 50 V

C: 50 V or greater

Mechanical Strength

A scratch degree of the photoreceptor surface after performing Photoreceptor Running Evaluation 1 is evaluated as follows. Thereafter, 100,000 black solid patterns are further output under the same conditions as in Photoreceptor Running Evaluation 1, and then the scratch degree of the photoreceptor surface is evaluated as follows. A+ represents the most excellent characteristic.

A+: No scratches are confirmed even in microscope observation.

A: No scratches are visually confirmed, but small scratches are confirmed in microscope observation.

B: Scratches are partially generated.

C: Scratches are generated on the entire surface.

Photoreceptor Running Evaluation 2

The electrophotographic photoreceptors prepared in Examples 1 to 32 and Comparative Examples 1 and 2 are mounted on DocuCentre Color 400CP (manufactured by Fuji Xerox Co., Ltd.). First, the image evaluation pattern shown in FIG. 11A is output under a low-temperature and low-humidity environment (20° C., 30% RH) and set as "Evaluation Image 1".

Next, 10,000 black solid patterns are continuously output under a low-temperature and low-humidity environment (20° C., 30% RH), and then the image evaluation pattern shown in FIG. 11A is output and set as "Evaluation Image 2".

Next, after leaving for 24 hours still under a low-temperature and low-humidity environment (20° C., 30% RH), the image evaluation pattern shown in FIG. 11A is output and set as "Evaluation Image 3".

Next, 5,000 black solid patterns are output under a high-temperature and high-humidity environment (28° C., 67% RH), and then the image evaluation pattern shown in FIG. 11A is output and set as "Evaluation Image 4".

Next, after leaving for 24 hours still under a high-temperature and high-humidity environment (28° C., 67% RH), the image evaluation pattern is output and set as "Evaluation Image 5".

Next, returning to the low-temperature and low-humidity environment (20° C., 30% RH), 20,000 black solid patterns are output, and the image evaluation pattern is output and set as "Evaluation Image 6".

Ghosting Evaluation

"Evaluation Image 3" and "Evaluation Image 5" are compared with "Evaluation Image 2" and "Evaluation Image 4", respectively, to visually evaluate a degree of image quality deterioration. A+ represents the most excellent characteristic.

A+: Excellent state as shown in FIG. 11A.

A: Excellent state in which only a very slight deterioration occurs as shown in FIG. 11A.

Figure 11B:
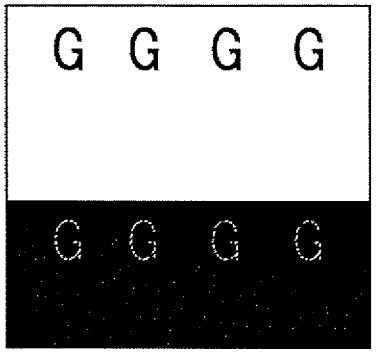

B: State in which a deterioration is slightly visually shown as shown in FIG. 11B.

Figure 11C:
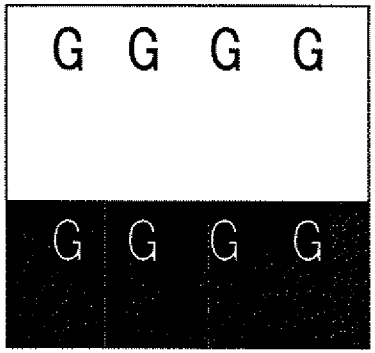

C: State in which a noticeable deterioration is confirmed as shown in FIG. 11C.

TABLE 1

| | Composition of Protective Layer | Evaluation Results | | | | | | |
|---|---|---|---|---|---|---|---|---|
| | Reactive Group-Containing Charge Transporting Material | Initial Electric Characteristic VL | Initial Electric Characteristic VRP | Image Stability | Electric Characteristic Stability | Mechanical Strength (after printing on 50,000 sheets) | Mechanical Strength (after printing on 100,000 sheets) | Ghosting |
| Example 1 | (Ia)-2 | A | A | A | A | A | A | A |
| Comparative Example 1 | Ca-1 | A | B | A | B | A | B | A |
| Comparative Example 2 | Ca-2 | B | C | B | C | B | C | C |
| Example 2 | (Ia)-15 | A | A | A | A | A+ | A | A |
| Example 3 | (Ia)-22 | A+ | A+ | A+ | A+ | A+ | A | A+ |
| Example 4 | (Ia)-27 | A+ | A | A+ | A | A+ | A | A+ |
| Example 5 | (Ia)-30 | A+ | A+ | A+ | A+ | A+ | A | A+ |
| Example 6 | (Ib)-14 | A+ | A+ | A++ | A++ | A+ | A | A+ |
| Example 7 | (Ia)-31 | A+ | A | A+ | A | A+ | A+ | A+ |
| Example 8 | (Ia)-35 | A+ | A+ | A+ | A+ | A+ | A+ | A+ |
| Example 9 | (Ia)-36 | A+ | A+ | A+ | A+ | A+ | A+ | A+ |
| Example 10 | (Ia)-43 | A+ | A | A+ | A | A+ | A+ | A+ |
| Example 11 | (Ia)-53 | A | A | A | A | A+ | A+ | A |
| Example 12 | (Ia)-48 | A+ | A | A+ | A | A+ | A+ | A+ |
| Example 13 | (Ia)-54 | A | A | A | A | A+ | A+ | A |
| Example 14 | (Ib)-23 | A+ | A+ | A+ | A++ | A+ | A+ | A+ |
| Example 15 | (Ib)-28 | A+ | A | A+ | A | A+ | A+ | A+ |

TABLE 2

| | Composition of Protective Layer | Evaluation Results | | | | | | |
|---|---|---|---|---|---|---|---|---|
| | Reactive Group-Containing Charge Transporting Material | Initial Electric Characteristic VL | Initial Electric Characteristic VRP | Image Stability | Electric Characteristic Stability | Mechanical Strength (after printing on 50,000 sheets) | Mechanical Strength (after printing on 100,000 sheets) | Ghosting |
| Example 16 | (Ib)-14 | A+ | A | A+ | A | A+ | A+ | A+ |
| Example 17 | (Ia)-40 | A+ | A | A+ | A | A+ | A+ | A+ |
| Example 18 | (Ia)-58 | A+ | A | A+ | A | A+ | A+ | A+ |
| Example 19 | (Ia)-44 | A+ | A | A+ | A | A+ | A | A+ |
| Example 20 | (Ia)-45 | A+ | A | A | A | A+ | A | A+ |
| Example 21 | (Ia)-46 | A | A | A | A | A | A | A |
| Example 22 | (Ia)-103 | A+ | A | A | A | A+ | A | A+ |
| Example 23 | (Ia)-104 | A+ | A | A | A | A+ | A | A+ |
| Example 24 | (Ia)-105 | A+ | A | A | A | A+ | A | A+ |
| Example 25 | (Ia)-106 | A+ | A | A | A | A+ | A | A+ |
| Example 26 | (Ia)-47 | A+ | A | A+ | A | A | A | A+ |
| Example 27 | (Ia)-55 | A | A | A | A | A+ | A+ | A |
| Example 28 | (Ia)-56 | A | A | A | A | A+ | A+ | A |
| Example 29 | (Ib)-30 | A+ | A+ | A+ | A++ | A+ | A+ | A+ |
| Example 30 | (Ib)-87 | A+ | A+ | A+ | A+ | A+ | A | A+ |
| Example 31 | (Ib)-116 | A+ | A | A+ | A | A+ | A | A+ |
| Example 32 | (Ib)-47 | A+ | A | A+ | A | A+ | A+ | A+ |

From the above results, it is found that in the examples, excellent results are obtained in the evaluations of the initial electric characteristics (VL and VRP), the image stability, the electric characteristic stability, the mechanical strength, and the ghosting, as compared with the comparative examples.

Examples 33 to 48

Preparation of Electrophotographic Photoreceptor

Electrophotographic photoreceptors are obtained in the same manner as in Example 1, except that the kinds of the charge generating material in the charge generating layer, the charge transporting material of the charge transporting layer, and the components and the coating solvent of the protective layer used in Example 1 are changed as in Table 3. The photoreceptors are set to Photoreceptors 33 to 48.

Photoreceptors 33 to 48 are subjected to the same evaluations as in Example 1. The results are shown in Table 4.

TABLE 3

| | Charge Generating Layer Charge Generating Material | Charge Transporting Layer Charge Transporting Material (in brackets, weight ratio) | Protective Layer | | | | | |
|---|---|---|---|---|---|---|---|---|
| | | | Reactive Group-Containing Charge Transporting Material | Initiator | Non-reactive Charge Transporting Material | Radical Polymerizable Monomer Having No Charge Transporting Capability | Resin | Coating Solvent (in brackets, weight ratio) |
| Example 33 | CGM-1 | CTM-1 | (Ia)-15 | VE-073 | None | None | None | THF/Toluene (60/40) |
| Example 34 | CGM-1 | CTM-1 | (Ia)-43 | V-40 | None | None | None | THF/Toluene (60/40) |
| Example 35 | CGM-1 | CTM-1 | (Ia)-54 | V-601 | None | None | None | THF/Toluene (60/40) |
| Example 36 | CGM-1 | CTM-1 | (Ib)-28 | PERHEXYL O | None | None | None | THF/Toluene (60/40) |
| Example 37 | CGM-1 | CTM-1 | (Ia)-43 | OTazo 15 | None | None | PCZ 500 | THF/Toluene (60/40) |
| Example 38 | CGM-1 | CTM-1 | (Ia)-54 | OTazo 15 | None | None | BX-L | THF/Toluene (60/40) |
| Example 39 | CGM-1 | CTM-1 | (Ib)-28 | OTazo 15 | None | None | None | n-Butyl Acetate |
| Example 40 | CGM-1 | CTM-1 | (Ia)-15 | OTazo 15 | None | None | None | Methyl i-Butyl Ketone |
| Example 41 | CGM-1 | CTM-1 | (Ia)-15 | OTazo 15 | CTM-2 (10 parts by weight) | None | None | THF/Toluene (60/40) |
| Example 42 | CGM-1 | CTM-1 | (Ia)-43 | OTazo 15 | CTM-3 (15 parts by weight) | None | None | THF/Toluene (60/40) |
| Example 43 | CGM-1 | CTM-1 | (Ib)-28 | OTazo 15 | None | Monomer 1 (10 parts by weight) | None | THF/Toluene (60/40) |
| Example 44 | CGM-1 | CTM-1 | (Ia)-15 | OTazo 15 | None | Monomer 2 (5 parts by weight) | None | THF/Toluene (60/40) |
| Example 45 | CGM-1 | CTM-1 | (Ia)-43 | OTazo 15 | None | Monomer 3 (10 parts by weight) | None | THF/Toluene (60/40) |
| Example 46 | CGM-1 | CTM-2 | (Ia)-15 | OTazo 15 | None | None | None | THF/Toluene (60/40) |

TABLE 3-continued

| | Charge Generating Layer Charge Generating Material | Charge Transporting Layer Charge Transporting Material (in brackets, weight ratio) | Protective Layer: Reactive Group-Containing Charge Transporting Material | Initiator | Non-reactive Charge Transporting Material | Radical Polymerizable Monomer Having No Charge Transporting Capability | Resin | Coating Solvent (in brackets, weight ratio) |
|---|---|---|---|---|---|---|---|---|
| Example 47 | CGM-1 | CTM-1/ CTM-3 (70/30) | (Ia)-54 | OTazo 15 | None | None | None | THF/Toluene (60/40) |
| Example 48 | CGM-2 | CTM-1 | (Ia)-43 | OTazo 15 | None | None | None | THF/Toluene (60/40) |

TABLE 4

| | Evaluation Results: Initial Electric Characteristic VL | Initial Electric Characteristic VRP | Image Stability | Electric Characteristic Stability | Mechanical Strength (after printing on 50,000 sheets) | Mechanical Strength (after printing on 100,000 sheets) | Ghosting |
|---|---|---|---|---|---|---|---|
| Example 33 | A | A | A | A | A+ | A | A |
| Example 34 | A+ | A+ | A+ | A | A+ | A+ | A+ |
| Example 35 | A | A | A | A | A+ | A+ | A |
| Example 36 | A+ | A | A+ | A | A+ | A+ | A+ |
| Example 37 | A+ | A | A+ | A | A+ | A+ | A+ |
| Example 38 | A | A | A | A | A+ | A+ | A |
| Example 39 | A+ | A | A+ | A+ | A+ | A+ | A+ |
| Example 40 | A | A | A | A | A+ | A | A |
| Example 41 | A+ | A+ | A+ | A+ | A+ | A | A |
| Example 42 | A+ | A+ | A++ | A+ | A+ | A+ | A+ |
| Example 43 | A+ | A | A+ | A | A+ | A+ | A+ |
| Example 44 | A | A | A | A | A+ | A+ | A |
| Example 45 | A+ | A | A+ | A | A+ | A+ | A+ |
| Example 46 | A+ | A+ | A+ | A+ | A+ | A | A |
| Example 47 | A+ | A+ | A+ | A | A+ | A+ | A |
| Example 48 | A+ | A | A+ | A | A+ | A+ | A+ |

From the above results, it is found that in the examples, excellent results are obtained in the evaluations of the initial electric characteristics (VL and VRP), the image stability, the electric characteristic stability, the mechanical strength, and the ghosting, as compared with the comparative examples.

Example 49

Preparation of Charge Transporting Film-Forming Coating Liquid

A charge transporting film-forming coating liquid having the following composition is prepared.

Reactive Group-Containing Charge Transporting Material: Exemplary Compound (Ia)-2, 100 parts by weight Initiator: OTazo 15 (manufactured by Otsuka Chemical Co., Ltd.), 2 parts by weight Solvent: tetrahydrofuran (THF)/Toluene Mixed Solvent (weight ratio 40/60), 150 parts by weight

Preparation of Charge Transporting Film

An ITO glass substrate in which an ITO film is provided on a glass substrate is provided, and the ITO film is subjected to etching into a strip shape having a width of 2 mm to form an ITO electrode (anode). The ITO glass substrate is subjected to ultrasonic cleaning by isopropanol (for electronics industry, manufactured by Kanto Kagaku), and then dried by a spin coater.

The charge transporting film-forming coating liquid is applied to the surface of the ITO glass substrate on which the ITO electrode is formed, and heating is performed at 150° C. for 40 minutes under an atmosphere of an oxygen concentration of about 100 ppm to form a charge transporting film 49 having a thickness of 5 μm.

Preparation of Organic Electroluminescent Element

An ITO glass substrate in which an ITO film is provided on a glass substrate is provided, and the ITO film is subjected to etching into a strip shape having a width of 2 mm to form an ITO electrode (anode). The ITO glass substrate is subjected to ultrasonic cleaning by isopropanol (for electronics industry, manufactured by Kanto Kagaku), and then dried by a spin coater.

Next, copper phthalocyanine subjected to sublimation purification is vacuum-deposited on the surface of the ITO glass substrate on which the ITO electrode is formed, and thus a thin film having a thickness of 0.015 μm is formed.

The charge transporting film-forming coating liquid is applied to the copper phthalocyanine film, and heated at 145° C. for 40 minutes under an atmosphere of an oxygen concentration of about 100 ppm to form a thin film having a thickness of 0.05 μm. Accordingly, a hole transporting layer having a two-layer structure is formed on the ITO electrode.

Next, a light-emitting layer having a thickness of 0.060 μm is formed by depositing tris(8-hydroxyquinoline)aluminum (Alq) as a light-emitting material on the hole transporting layer.

Next, a strip-shaped Mg—Ag electrode (cathode) having a width of 2 mm and a thickness of 0.13 μm is formed by depositing a Mg—Ag alloy on the light-emitting layer through codeposition, and thus an organic electroluminescent element 49 is obtained. The ITO electrode and the Mg—Ag electrode are formed so that the extending directions thereof are perpendicular to each other. The effective area of the obtained organic electroluminescent element 49 is 0.04 $cm^2$.

Comparative Examples 3 and 4

Comparative charge transporting films 3 and 4 and comparative organic electroluminescent elements 3 and 4 are obtained in the same manner as in Example 49, except that the exemplary compound (Ia)-2 as a reactive group-containing charge transporting material is changed to reactive group-containing charge transporting materials (Ca-1) and (Ca-2) for comparison in the respective cases.

Examples 50 to 78

Charge transporting films 50 to 78 and organic electroluminescent elements 50 to 78 are obtained in the same manner as in Example 49, except that the reactive group-containing charge transporting material used in Example 49 is changed as described in Table 5.

Evaluations

Measurement of Stability of Mobility

An electric field of 30 V/μm is applied to the charge transporting films obtained in Examples 49 to 78 and Comparative Examples 3 and 4 using TOF-401 (manufactured by Sumitomo Heavy Industries, Ltd.) to repeatedly measure mobility 100 times, and stability of the mobility is evaluated using the following expression. The results thereof are shown in Table 5.

"|" represents an absolute value. A++ represents the most excellent characteristic.

Stability of Mobility=|(mobility measured in first measurement)−(mobility measured in 100-th measurement)|/(mobility measured in first measurement)

A++: less than 0.05
A+: from 0.05 to less than 0.08
A: from 0.08 to less than 0.1
B: from 0.1 to less than 0.2
C: 0.2 or greater Evaluation of Element Characteristics The element characteristics of the organic electroluminescent elements obtained in Examples 49 to 78 and Comparative Examples 3 and 4 are evaluated as follows. The results thereof are shown in Table 5.

Maximum Brightness

In a vacuum (0.125 Pa), the ITO electrode is set as a positive terminal (anode), the Mg—Ag electrode is set as a negative terminal (cathode), a DC voltage is applied between the electrodes to emit light, and the maximum brightness at that time is evaluated.

The evaluation standards of the maximum brightness are as follows (the unit of the numerical values is cd/$m^2$). A++ represents the most excellent characteristic.

A++: 800 or greater
A+: from 750 to less than 800
A: from 700 to less than 750
B: from 650 to less than 700
C: less than 650

Element Lifetime

The emission lifetime of the organic electroluminescent element in dry nitrogen is measured as follows. A relative time when an initial brightness is 500 cd/$m^2$ at room temperature in a DC drive system and a drive time at the time when a brightness (brightness L/initial brightness L0) of the element in Comparative Example 4 (initial brightness L0: 500 cd/$m^2$) is 0.5 is 1.0, and an increase in the voltage (=voltage/initial drive voltage) at the time when the brightness (brightness L/initial brightness L0) of the element is 0.5 are used for evaluation.

The evaluation standards of the relative time (L/L0=0.5) and the increase in the voltage (when L/L0 is 0.5) are as follows.

Relative Time (L/L0=0.5). A++ represents the most excellent characteristic.

A++: 1.6 or greater
A+: from 1.4 to less than 1.6
A: from 1.2 to less than 1.4
B: from 1.0 to less than 1.2
C: less than 1.0

Increase in Voltage (when L/L0 is 0.5). A++ represents the most excellent characteristic.

A++: from 1.0 to less than 1.1
A+: from 1.1 to less than 1.2
A: from 1.2 to less than 1.3
B: from 1.3 to less than 1.4
C: 1.4 or greater

TABLE 5

| | Reactive Group-Containing Charge Transporting Material | Characteristics of Charge Transporting Film Stability of Mobility | Characteristics of Organic Electroluminescent Element: Maximum Brightness | Increase in Voltage (@L/L0 = 0.5) | Relative Time (L/L0 = 0.5) |
|---|---|---|---|---|---|
| Example 49 | (Ia)-2 | A | A | A | A |
| Comparative Example 3 | Ca-1 | B | B | B | B |
| Comparative Example 4 | Ca-2 | C | C | C | C |
| Example 50 | (Ia)-15 | A | A | A | A |
| Example 51 | (Ia)-22 | A+ | A+ | A+ | A |
| Example 52 | (Ia)-27 | A | A | A | A |
| Example 53 | (Ia)-30 | A+ | A+ | A+ | A |
| Example 54 | (Ib)-14 | A++ | A+ | A++ | A |
| Example 55 | (Ia)-31 | A | A | A | A+ |
| Example 56 | (Ia)-35 | A+ | A+ | A+ | A+ |
| Example 57 | (Ia)-36 | A+ | A+ | A+ | A+ |
| Example 58 | (Ia)-43 | A | A | A | A+ |

TABLE 5-continued

| | Reactive Group-Containing Charge Transporting Material | Characteristics of Charge Transporting Film Stability of Mobility | Characteristics of Organic Electroluminescent Element: Maximum Brightness | Increase in Voltage (@L/L0 = 0.5) | Relative Time (L/L0 = 0.5) |
|---|---|---|---|---|---|
| Example 59 | (Ia)-53 | A | A | A | A+ |
| Example 60 | (Ia)-48 | A | A | A | A+ |
| Example 61 | (Ia)-54 | A | A | A | A+ |
| Example 62 | (Ib)-23 | A++ | A+ | A++ | A+ |
| Example 63 | (Ib)-28 | A | A | A | A+ |
| Example 64 | (Ib)-14 | A | A | A | A+ |
| Example 65 | (Ia)-40 | A | A | A | A+ |
| Example 66 | (Ia)-58 | A | A | A | A+ |
| Example 67 | (Ia)-44 | A | A | A | A |
| Example 68 | (Ia)-45 | A | A | A | A |
| Example 69 | (Ia)-46 | A | A | A | A |
| Example 70 | (Ia)-103 | A | A | A | A |
| Example 71 | (Ia)-104 | A | A | A | A |
| Example 72 | (Ia)-105 | A | A | A | A |
| Example 73 | (Ia)-106 | A | A | A | A |
| Example 74 | (Ia)-47 | A | A | A | A |
| Example 75 | (Ia)-55 | A | A | A | A+ |
| Example 76 | (Ia)-56 | A | A | A | A+ |
| Example 77 | (Ib)-30 | A++ | A+ | A++ | A+ |
| Example 78 | (Ib)-87 | A+ | A+ | A+ | A |

From the above results, it is found that in the examples, excellent results are obtained in the evaluations of the stability of the mobility of the charge transporting film and the characteristics of the organic electroluminescent element, as compared with the comparative examples.

Hereinafter, the abbreviations in the tables will be described in detail.

Charge Generating Material

CGM-1: hydroxygallium phthalocyanine having diffraction peaks at least at Bragg angles (2θ±0.2°) of 7.3°, 16.0°, 24.9°, and 28.0° in an X-ray diffraction spectrum using CuKα characteristic X-rays CGM-2: titanyl phthalocyanine having diffraction peaks at least at Bragg angles (2θ±0.2°) of 9.6°, 42.1°, and 27.2° in an X-ray diffraction spectrum using CuKα characteristic X-rays Charge Transporting Material (Non-Reactive Charge Transporting Material)

CTM-1: N,N'-diphenyl-N,N'-bis(3-methylphenyl)-[1,1'] biphenyl-4,4'-diamine

CTM-2: charge transporting material represented by the following Structural Formula CTM-3: charge transporting material represented by the following Structural Formula (CTM-2)

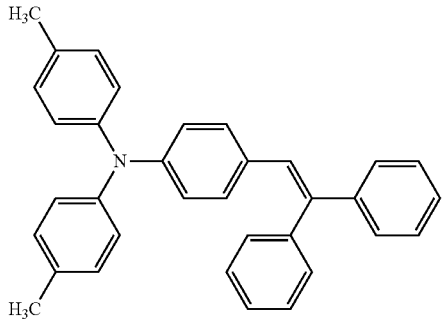

-continued (CTM-3)

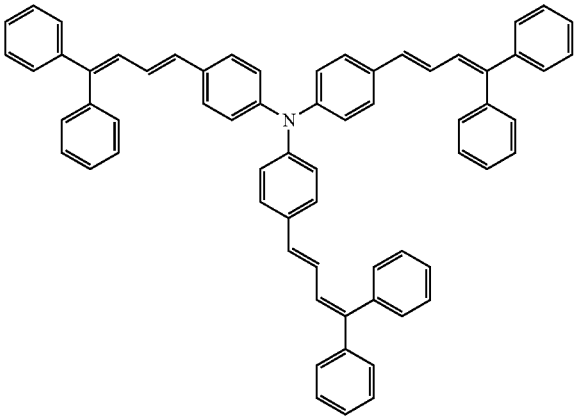

Reactive Group-Containing Charge Transporting Material (Ia)-2: Exemplary Compound (Ia)-2

(Ia)-15: Exemplary Compound (Ia)-15 (see the following synthesis method)

(Ia)-22: Exemplary Compound (Ia)-22

(Ia)-27: Exemplary Compound (Ia)-27

(Ia)-30: Exemplary Compound (Ia)-30

(Ia)-31: Exemplary Compound (Ia)-31

(Ia)-35: Exemplary Compound (Ia)-35

(Ia)-36: Exemplary Compound (Ia)-36

(Ia)-40: Exemplary Compound (Ia)-40

(Ia)-43: Exemplary Compound (Ia)-43 (see the following synthesis method)

(Ia)-44: Exemplary Compound (Ia)-44

(Ia)-45: Exemplary Compound (Ia)-45

(Ia)-46: Exemplary Compound (Ia)-46

(Ia)-47: Exemplary Compound (Ia)-47

(Ia)-48: Exemplary Compound (Ia)-48

(Ia)-53: Exemplary Compound (Ia)-53

(Ia)-54: Exemplary Compound (Ia)-54

(Ia)-55: Exemplary Compound (Ia)-55

(Ia)-56: Exemplary Compound (Ia)-56

(Ia)-58: Exemplary Compound (Ia)-58
(Ia)-103: Exemplary Compound (Ia)-103
(Ia)-104: Exemplary Compound (Ia)-104
(Ia)-105: Exemplary Compound (Ia)-105
(Ia)-106: Exemplary Compound (Ia)-106
(Ib)-14: Exemplary Compound (Ib)-14
(Ib)-23: Exemplary Compound (Ib)-23
(Ib)-28: Exemplary Compound (Ib)-28
(Ib)-30: Exemplary Compound (Ib)-30
(Ib)-47: Exemplary Compound (Ib)-47
(Ib)-87: Exemplary Compound (Ib)-87

Ca-1: reactive group-containing charge transporting material represented by the following Structural Formula (Ca-1)

Ca-2: reactive group-containing charge transporting material represented by the following Structural Formula (Ca-2)

(Ca-1)

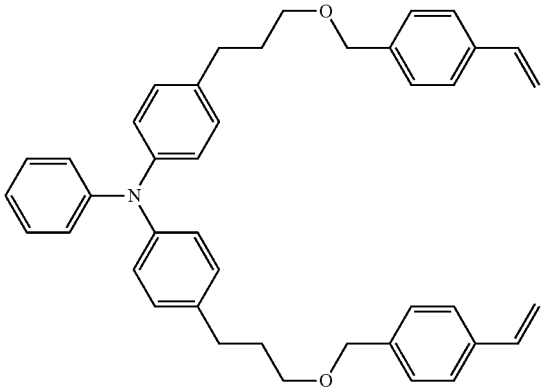

(Ca-2)

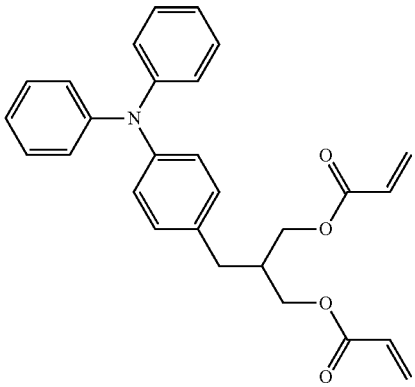

Synthesis of Exemplary Compound (Ia)-15

Exemplary Compound (Ia)-15 is synthesized in accordance with the following synthesis route.

68.3 g of 4,4'-bis(2-methoxycarbonylethyl)diphenylamine, 46.4 g of 4-iodoxylene, 30.4 g of potassium carbonate, 1.5 g of copper sulfate pentahydrate, and 50 ml of n-tridecane are added to a three-necked flask of 500 ml. While nitrogen is allowed to flow in the system, the materials are stirred for 20 hours while being heated at 220° C. Thereafter, the temperature is reduced to the room temperature, and 200 ml of toluene and 150 ml of water are added thereto to perform a liquid separation operation. The toluene layer is collected and 20 g of sodium sulfate is added, followed by stirring for 10 minutes. Then, the sodium sulfate is filtered out. A crude product obtained by distilling away the toluene under reduced pressure is purified by silica gel column chromatography using toluene/ethyl acetate as an eluent, thereby obtaining 65.1 g of Compound (Ia)-15a (yield: 73%).

59.4 g of Compound (Ia)-15a and 450 ml of tetrahydrofuran are added to a three-necked flask of 3 L, and an aqueous solution obtained by dissolving 11.7 g of sodium hydroxide in 450 ml of water is added thereto, followed by stirring at 60° C. for 3 hours. Thereafter, the reaction solution is dripped to an aqueous solution of 1 L of water/60 ml of a concentrated hydrochloric acid, and the precipitated solid substance is collected by suction filtration. Furthermore, 50 ml of an acetone/water mixed solvent (volume ratio 40/60) is added to the solid substance, followed by stirring in a suspended form, and then collection by suction filtration is performed. The collected substance is vacuum-dried for 10 hours, thereby obtaining 46.2 g of Compound (Ia)-15b (yield: 83%).

29.2 g of Compound (Ia)-15b, 27.51 g of 1-chloromethyl-3,5-divinylbenzene, 21.3 g of potassium carbonate, 0.17 g of nitrobenzene, and 175 ml of N,N-dimethylformamide (DMF) are added to a three-necked flask of 500 ml. While nitrogen is allowed to flow in the system, the materials are stirred for 3 hours while being heated at 75° C. Thereafter, the temperature is reduced to the room temperature, and 200 ml of ethyl acetate and 200 ml of water are added to the reaction solution to perform a liquid separation operation. The ethyl acetate layer is collected and 10 g of sodium sulfate is added, followed by stirring for 10 minutes. Then, the sodium sulfate is filtered out. A crude product obtained by distilling away the ethyl acetate under reduced pressure is purified by silica gel column chromatography using toluene/ethyl acetate as an eluent, thereby obtaining 36.4 g of Exemplary Compound (Ia)-15 (yield: 74%).

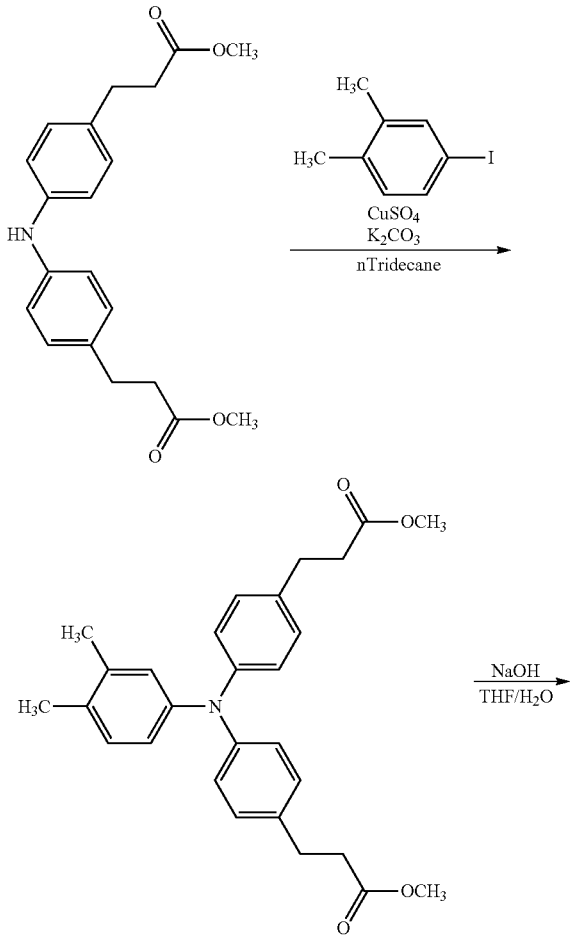

(Ia)-15a

-continued

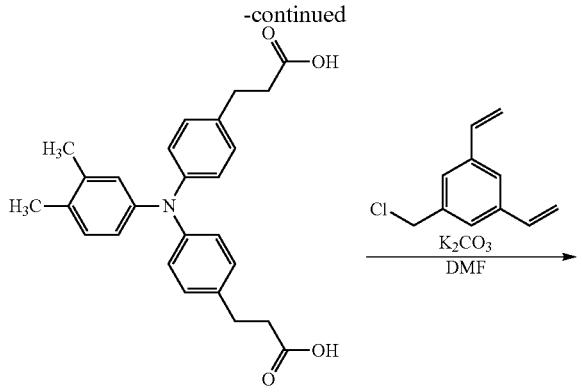

(Ia)-15b

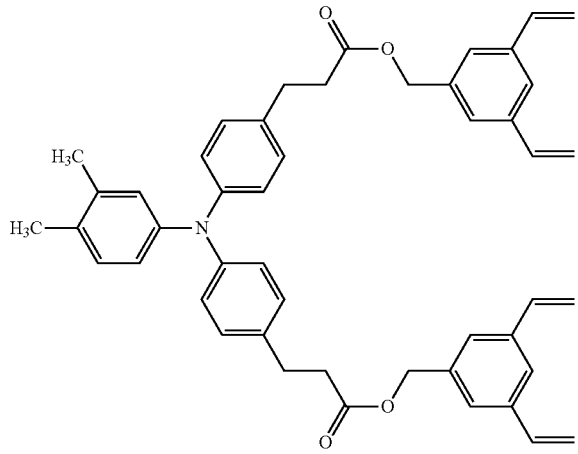

(Ia)-15

Synthesis of Exemplary Compound (Ia)-43

Exemplary Compound (Ia)-43 is synthesized in accordance with the following synthesis route.

68.3 g of 4,4'-bis(2-methoxycarbonylethyl)diphenylamine, 43.4 g of 4,4'-diiodo-3,3'-dimethyl-1,1'-biphenyl, 30.4 g of potassium carbonate, 1.5 g of copper sulfate pentahydrate, and 50 ml of n-tridecane are added to a three-necked flask of 500 ml. While nitrogen is allowed to flow in the system, the materials are stirred for 20 hours while being heated at 220° C. Thereafter, the temperature is lowered to the room temperature, and 200 ml of toluene and 150 ml of water are added thereto to perform a liquid separation operation. The toluene layer is collected and 10 g of sodium sulfate is added, followed by stirring for 10 minutes. Then, the sodium sulfate is filtered out. A crude product obtained by distilling away the toluene under reduced pressure is purified by silica gel column chromatography using toluene/ethyl acetate as an eluent, thereby obtaining 56.0 g of Compound (Ia)-43a (yield: 65%).

43.1 g of Compound (Ia)-43a and 350 ml of tetrahydrofuran are added to a three-necked flask of 3 L, and an aqueous solution obtained by dissolving 8.8 g of sodium hydroxide in 350 ml of water is added thereto, followed by stirring for 5 hours while being heated at 60° C. Thereafter, the reaction solution is dripped to an aqueous solution of 1 L of water/40 ml of a concentrated hydrochloric acid, and the precipitated solid substance is collected by suction filtration. 50 ml of an acetone/water mixed solvent (volume ratio 40/60) is added to the solid substance, followed by stirring in a suspended form, and then collection by suction filtration is performed. The collected substance is vacuum-dried for 10 hours, thereby obtaining 36.6 g of Compound (Ia)-43b (yield: 91%).

28.2 g of Compound (Ia)-43b, 27.51 g of 1-chloromethyl-3,5-divinylbenzene, 21.3 g of potassium carbonate, 0.09 g of nitrobenzene, and 175 ml of N,N-dimethylformamide (DMF) are added to a three-necked flask of 500 ml. While nitrogen is allowed to flow in the system, the materials are stirred for 5 hours while being heated at 75° C. Thereafter, the temperature is lowered to the room temperature, and 200 ml of ethyl acetate and 200 ml of water are added to the reaction solution to perform a liquid separation operation. The ethyl acetate layer is collected and 10 g of sodium sulfate is added, followed by stirring for 10 minutes. Then, the sodium sulfate is filtered out. A crude product obtained by distilling away the ethyl acetate under reduced pressure is purified by silica gel column chromatography using toluene/ethyl acetate as an eluent, thereby obtaining 37.5 g of Exemplary Compound (Ia)-43 (yield: 78%).

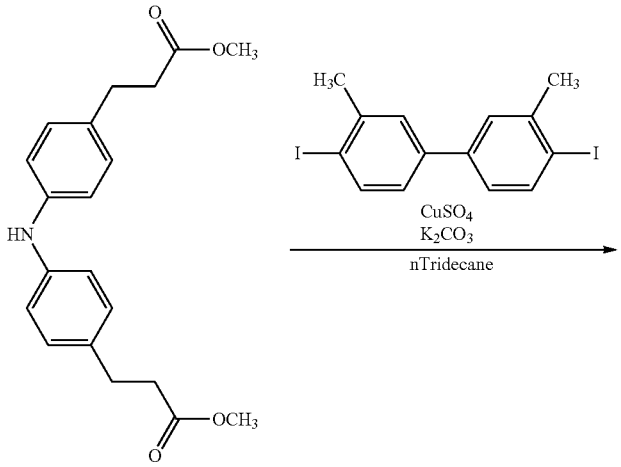

-continued

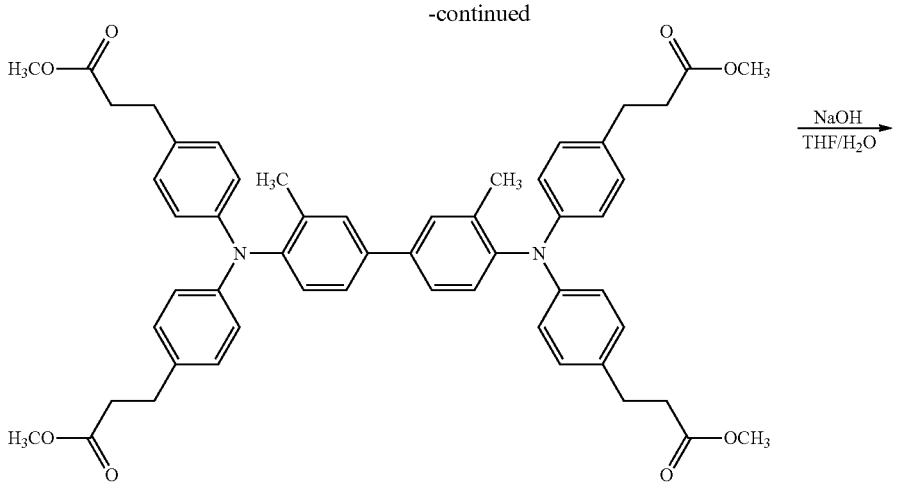

(Ia)-43a

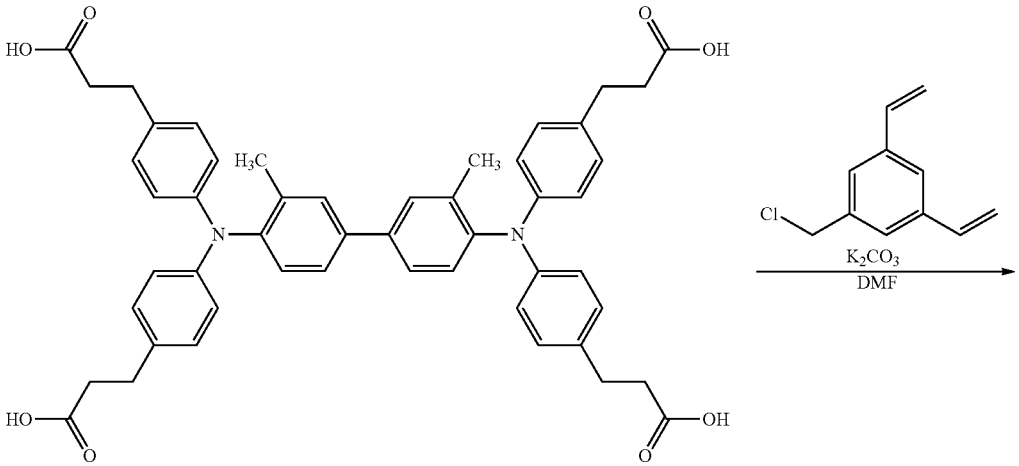

(Ia)-43b

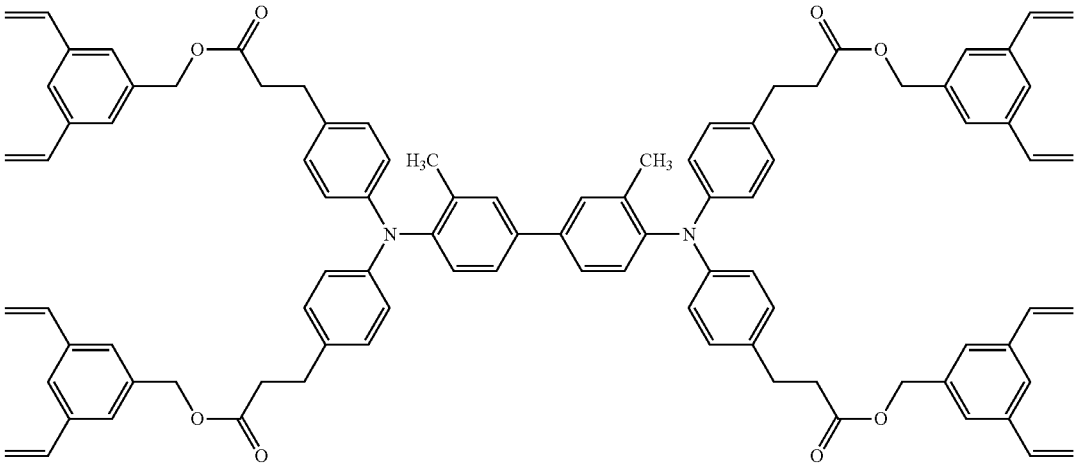

(Ia)-43

Other exemplary compounds are also synthesized according to the above-described synthesis.

Radical Polymerizable Monomer Having No Charge Transporting Capability (Compound Having Unsaturated Bond Having No Charge Transporting Component)

Monomer 1: A-DCP (bifunctional acrylate monomer manufactured by Shin-Nakamura Chemical Co., Ltd.)

Monomer 2: A-DPH (hexafunctional acrylate monomer manufactured by Shin-Nakamura Chemical Co., Ltd.)

Monomer 3: BPE-200 (bifunctional methacrylate monomer manufactured by Shin-Nakamura Chemical Co., Ltd.)

Resin

BX-L: S-LEC B BX-L, polyvinyl butyral resin manufactured by Sekisui Chemical Co., Ltd.

PCZ 500: bisphenol-Z polycarbonate resin (viscosity average molecular weight: 50,000)

Initiator

V-40: initiator manufactured by Wako Pure Chemical Industries, Ltd. (thermal radical generating agent)

VE-073: initiator manufactured by Wako Pure Chemical Industries, Ltd. (thermal radical generating agent)

V-601: initiator manufactured by Wako Pure Chemical Industries, Ltd. (thermal radical generating agent)

PERHEXYL O: initiator manufactured by NOF Corporation (thermal radical generating agent)

OTazo 15: initiator manufactured by Otsuka Chemical Co., Ltd. (thermal radical generating agent)

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charge transporting film comprising:

a cured film of a composition containing at least one selected from reactive compounds represented by the following Formula (I):

$$F\text{—}(D)_m \quad \text{(I)}$$

$$*\text{—}L\text{—}(E)_n \quad \text{(IIa)}$$

wherein F represents a charge transporting skeleton, D represents a group represented by Formula (IIa), m represents an integer of from 1 to 8, wherein the group represented by Formula (IIa) is a group represented by Formula (IIIa):

$$*\text{—}L^1\text{—}(E^1)_{n1} \quad \text{(IIIa)}$$

(IIIb)

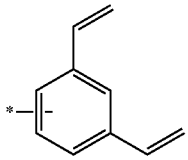

(IVb)

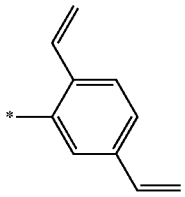

wherein $L^1$ represents a (n1+1)-valent linking group including a group obtained by combining one selected from the group consisting of —O—and —C(=O)—O—with one or more selected from the group consisting of an alkylene group, an alkenylene group, and a trivalent or tetravalent group derived from alkane or alkene, n1 represents an integer of from 1 to 3, and $E^1$ represents a group represented by Formula (IIIb) or Formula (IVb), and wherein the group represented by Formula (IIIc) is a group selected from groups represented by the following Formulae (IIIa-3) to (IIIa-6):

(IIIa-1)

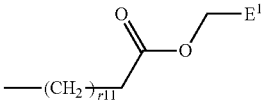

(IIIa-2)

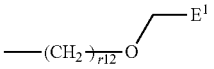

(IIIa-3)

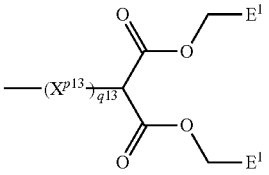

(IIIa-4)

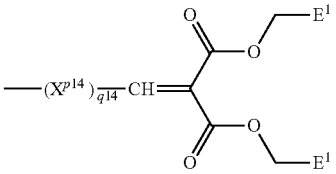

(IIIa-5)

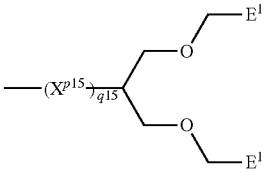

(IIIa-6)

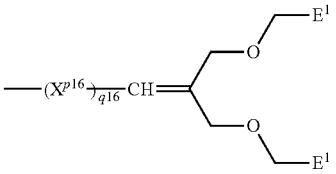

wherein each of $X^{p13}$ to $X^{p16}$ independently represents a divalent linking group, and each of q13 to q16 independently represents an integer of 0 or 1.

2. The charge transporting film according to claim 1, wherein the reactive compound represented by Formula (I) is a reactive compound represented by the following Formula (V):

(V)

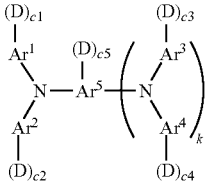

wherein each of $Ar^1$ to $Ar^4$ independently represents a substituted or unsubstituted aryl group, $Ar^5$ represents a substituted or unsubstituted aryl group, or a substituted or unsubstituted arylene group, D represents a group represented by Formula (IIa), each of c1 to c5 independently represents an integer of from 0 to 2, k represents 0 or 1, and the total number of D is from 1 to 8.

3. The charge transporting film according to claim 1, wherein the total number of E in Formula (I) is from 2 to 6.

4. The charge transporting film according to claim 1, wherein the total number of E in Formula (I) is from 4 to 6.

5. A photoelectric conversion device comprising: the charge transporting film according to claim 1.

6. An electrophotographic photoreceptor comprising:

a conductive substrate; and a photosensitive layer which is provided on the conductive substrate, wherein an outermost layer contains the charge transporting film according to claim 1.

7. An image forming apparatus comprising:

an electrophotographic photoreceptor;

a charging unit that charges a surface of the electrophotographic photoreceptor;

a latent image forming unit that forms an electrostatic latent image on a charged surface of the electrophotographic photoreceptor;

a developing unit that develops the electrostatic latent image formed on the surface of the electrophotographic photoreceptor with a toner to form a toner image; and a transfer unit that transfers the toner image formed on the surface of the electrophotographic photoreceptor onto a recording medium, wherein the electrophotographic photoreceptor is the electrophotographic photoreceptor according to claim 6.

8. A process cartridge which is detachable from an image forming apparatus, comprising:

an electrophotographic photoreceptor, wherein the electrophotographic photoreceptor is the electrophotographic photoreceptor according to claim 6.

* * * * *